US009658003B2

(12) United States Patent
Numata et al.

(10) Patent No.: US 9,658,003 B2
(45) Date of Patent: May 23, 2017

(54) HEAT EXCHANGER

(71) Applicant: DAIKIN APPLIED AMERICAS INC., Minneapolis, MN (US)

(72) Inventors: Mitsuharu Numata, Plymouth, MN (US); Kazushige Kasai, Minnetonka, MN (US)

(73) Assignee: DAIKIN APPLIED AMERICAS INC., Minneapolis, MN (US)

( * ) Notice: Subject to any disclaimer, the term of this patent is extended or adjusted under 35 U.S.C. 154(b) by 822 days.

(21) Appl. No.: 13/939,786

(22) Filed: Jul. 11, 2013

(65) Prior Publication Data

US 2015/0013950 A1 Jan. 15, 2015

(51) Int. Cl.

| | |
|---|---|
| ***F25B 39/02*** | (2006.01) |
| ***F28D 3/04*** | (2006.01) |
| ***F28F 9/22*** | (2006.01) |
| ***F28F 9/02*** | (2006.01) |

(Continued)

(52) U.S. Cl.

CPC ..... *F28F 9/22* (2013.01); *F25B 39/02* (2013.01); *F28D 3/02* (2013.01); *F28D 3/04* (2013.01);

(Continued)

(58) Field of Classification Search

CPC .. F25B 39/028; F25B 2339/0242; F28D 3/02; F28D 3/04; F28D 5/02

(Continued)

(56) References Cited

U.S. PATENT DOCUMENTS 2,012,183 A 8/1935 Carrier
3,240,265 A * 3/1966 Weller ..... F25B 39/02 62/525

(Continued)

FOREIGN PATENT DOCUMENTS

WO 2013/162761 A1 10/2013

OTHER PUBLICATIONS

International Preliminary Report on Patentability for the corresponding international application No. PCT/US2014/046217, issued on Jan. 12, 2016.

International Search Report for the corresponding International Application No. PCT/US2014/046217 mailed Sep. 24, 2014.

*Primary Examiner* — Leonard R Leo

(74) *Attorney, Agent, or Firm* — Global IP Counselors, LLP

(57) ABSTRACT

A heat exchanger includes a shell, a refrigerant distribution assembly, a heat transferring unit and a canopy member. The refrigerant distribution assembly receives a refrigerant that enters the shell and discharges the refrigerant. The refrigerant distribution assembly has at least one outermost lateral end. The heat transferring unit is disposed below the refrigerant distribution assembly so that the refrigerant discharged from the refrigerant distribution assembly is supplied to the heat transferring unit. The heat transferring unit includes a plurality heat transfer tubes. The canopy member includes at least one lateral side portion extending laterally outwardly and downwardly from a position above the refrigerant distribution assembly. The lateral side portion has a free end disposed laterally further from a vertical plane than the refrigerant distribution assembly, and lower than an upper edge of the outermost lateral end of the refrigerant distribution assembly.

19 Claims, 40 Drawing Sheets

(51) Int. Cl.

| | |
|---|---|
| ***F28D 3/02*** | (2006.01) |
| ***F28D 7/16*** | (2006.01) |
| *F28D 5/02* | (2006.01) |
| *F28D 21/00* | (2006.01) |

(52) U.S. Cl.
CPC ..... *F28D 7/163* (2013.01); *F28F 9/0275* (2013.01); *F25B 39/028* (2013.01); *F25B 2339/024* (2013.01); *F25B 2339/0242* (2013.01); *F28D 5/02* (2013.01); *F28D 2021/0071* (2013.01)

(58) Field of Classification Search
USPC ..... 165/111, 115, 117; 62/515
See application file for complete search history.

(56) References Cited

U.S. PATENT DOCUMENTS

| | | | | | |
|---|---|---|---|---|---|
| 3,276,217 | A * | 10/1966 | Bourne | F25B 15/06 | 252/69 |
| 3,316,727 | A * | 5/1967 | Bourne | F25B 15/06 | 165/117 |
| 3,538,983 | A * | 11/1970 | Thomae | F01B 3/0052 | 165/110 |
| 4,158,295 | A * | 6/1979 | Sibley | F25B 15/06 | 122/32 |
| 5,839,294 | A | 11/1998 | Chiang et al. | | |
| 6,167,713 | B1 * | 1/2001 | Hartfield et al. | F25B 39/028 | 165/160 |
| 7,849,710 | B2 | 12/2010 | De Larminat et al. | | |
| 2010/0107676 | A1 | 5/2010 | Liu et al. | | |

* cited by examiner

HEAT EXCHANGER

BACKGROUND OF THE INVENTION

Field of the Invention

This invention generally relates to a heat exchanger adapted to be used in a vapor compression system. More specifically, this invention relates to a heat exchanger including a canopy member extending from a position above a refrigerant distribution assembly.

Background Information

Vapor compression refrigeration has been the most commonly used method for air-conditioning of large buildings or the like. Conventional vapor compression refrigeration systems are typically provided with an evaporator, which is a heat exchanger that allows the refrigerant to evaporate from liquid to vapor while absorbing heat from liquid to be cooled passing through the evaporator. One type of evaporator includes a tube bundle having a plurality of horizontally extending heat transfer tubes through which the liquid to be cooled is circulated, and the tube bundle is housed inside a cylindrical shell. There are several known methods for evaporating the refrigerant in this type of evaporator. In a flooded evaporator, the shell is filled with liquid refrigerant and the heat transfer tubes are immersed in a pool of the liquid refrigerant so that the liquid refrigerant boils and/or evaporates as vapor. In a falling film evaporator, liquid refrigerant is deposited onto exterior surfaces of the heat transfer tubes from above so that a layer or a thin film of the liquid refrigerant is formed along the exterior surfaces of the heat transfer tubes. Heat from walls of the heat transfer tubes is transferred via convection and/or conduction through the liquid film to the vapor-liquid interface where part of the liquid refrigerant evaporates, and thus, heat is removed from the water flowing inside of the heat transfer tubes. The liquid refrigerant that does not evaporate falls vertically from the heat transfer tube at an upper position toward the heat transfer tube at a lower position by force of gravity. There is also a hybrid falling film evaporator, in which the liquid refrigerant is deposited on the exterior surfaces of some of the heat transfer tubes in the tube bundle and the other heat transfer tubes in the tube bundle are immersed in the liquid refrigerant that has been collected at the bottom portion of the shell.

Although the flooded evaporators exhibit high heat transfer performance, the flooded evaporators require a considerable amount of refrigerant because the heat transfer tubes are immersed in a pool of the liquid refrigerant. With the recent development of new and high-cost refrigerant having a much lower global warming potential (such as R1234ze or R1234yf), it is desirable to reduce the refrigerant charge in the evaporator. The main advantage of the falling film evaporators is that the refrigerant charge can be reduced while ensuring good heat transfer performance. Therefore, the falling film evaporators have a significant potential to replace the flooded evaporators in large refrigeration systems.

U.S. Pat. No. 5,839,294 discloses a hybrid falling film evaporator that has a section that operates in a flooded mode and a section that operates in a falling film mode. More specifically, the evaporator disclosed in this publication includes an outer shell through which passes a plurality of horizontal heat transfer tubes in a tube bundle. A distribution system is provided in overlying relationship with the upper most level of the heat transfer tubes in the tube bundle so that refrigerant which enters into the shell is dispensed onto the top of the tubes. The liquid refrigerant forms a film along an exterior wall of each of the heat transfer tubes where part of the liquid refrigerant evaporates as the vapor refrigerant. The rest of the liquid refrigerant collects in the lower portion of the shell. In steady state operation, the level of liquid refrigerant within the outer shell is maintained at a level such that at least twenty-five percent of the horizontal heat transfer tubes near the lower end of the shell are immersed in liquid refrigerant. Therefore, in this publication, the evaporator operates with the heat transfer tubes in the lower section of the shell operating in a flooded heat transfer mode, while the heat transfer tubes which are not immersed in liquid refrigerant operate in a falling film heat transfer mode.

U.S. Pat. No. 7,849,710 discloses a falling film evaporator in which liquid refrigerant collected in a lower portion of an evaporator shell is recirculated. More specifically, the evaporator disclosed in this publication includes the shell having a tube bundle with a plurality of heat transfer tubes extending substantially horizontally in the shell. Liquid refrigerant that enters in the shell is directed from a distributor to the heat transfer tubes. The liquid refrigerant creates a film along an exterior wall of each of the heat transfer tubes where part of the liquid refrigerant evaporates as the vapor refrigerant. The rest of the liquid refrigerant collects in a lower portion of the shell. In this publication, a pump or an ejector is provided to draw the liquid refrigerant collected in the lower portion of the shell to recirculate the liquid refrigerant from the lower portion of the shell to the distributor.

SUMMARY OF THE INVENTION

The hybrid falling film evaporator disclosed in U.S. Pat. No. 5,839,294 as mentioned above still presents a problem that it requires a relatively large amount of refrigerant charge because of the existence of the flooded section at the bottom portion of the shell. On the other hand, with the evaporator disclosed in U.S. Pat. No. 7,849,710, which recirculates the collected liquid refrigerant from the bottom portion of the shell to the distributor, an excess amount of circulated refrigerant is required in order to rewet dry patches on the heat transfer tubes in case such dry patches are formed due to fluctuation in performance of the evaporator. Moreover, when a compressor in the vapor compression system utilizes lubrication oil (refrigerant oil), the oil migrated from the compressor into the refrigeration circuit of the vapor compression system tends to accumulate in the evaporator because the oil is less volatile than the refrigerant. Thus, with the refrigerant recirculation system as disclosed in U.S. Pat. No. 7,849,710, the oil is recirculated within the evaporator along with the liquid refrigerant, which causes a high concentration of the oil in the liquid refrigerant circulating in the evaporator. Therefore, performance of the evaporator is degraded. In addition, it has been discovered that, even with falling film evaporators that work very well, vapor refrigerant velocity from the distribution part can be elevated, which can result in liquid drops accompanying gas to the outlet.

In view of the above, one object of the present invention is to provide a heat exchanger that can reduce the amount of refrigerant charge while ensuring good performance of the heat exchanger.

Another object of the present invention is to provide a heat exchanger that accumulates refrigerant oil migrated from a compressor into a refrigeration circuit of a vapor compression system and discharges the refrigerant oil outside of the evaporator.

Another object of the present invention is to provide a heat exchanger that decreases vapor refrigerant velocity around the free end of a canopy member so that liquid drops do not accompanied gas, and thus, almost all fall downward. When this object is achieved, hardly any liquid refrigerant will be introduced in the gas refrigerant pipe.

A heat exchanger according to a first aspect of the present invention is adapted to be used in a vapor compression system. The heat exchanger includes a shell, a refrigerant distribution assembly, a heat transferring unit and a canopy member. The shell has a longitudinal center axis extending generally parallel to a horizontal plane. The refrigerant distribution assembly is disposed inside the shell. The refrigerant distribution assembly extends generally parallel to the longitudinal center axis of the shell to receive a refrigerant that enters the shell and to discharge the refrigerant. The refrigerant distribution assembly has at least one outermost lateral end. The heat transferring unit is disposed inside of the shell below the refrigerant distribution assembly so that the refrigerant discharged from the refrigerant distribution assembly is supplied to the heat transferring unit. The heat transferring unit includes a plurality heat transfer tubes extending generally parallel to the longitudinal axis. The canopy member is disposed inside the casing, and includes at least one lateral side portion extending laterally outwardly and downwardly from a position above the refrigerant distribution assembly, as viewed along the longitudinal center axis. The lateral side portion having a free end disposed further from a vertical plane passing through the longitudinal center axis than the refrigerant distribution assembly, as viewed along the longitudinal center axis, and lower than an upper edge of the outermost lateral end of the refrigerant distribution assembly, as viewed along the longitudinal center axis.

These and other objects, features, aspects and advantages of the present invention will become apparent to those skilled in the art from the following detailed description, which, taken in conjunction with the annexed drawings, discloses preferred embodiments.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Figure 1:
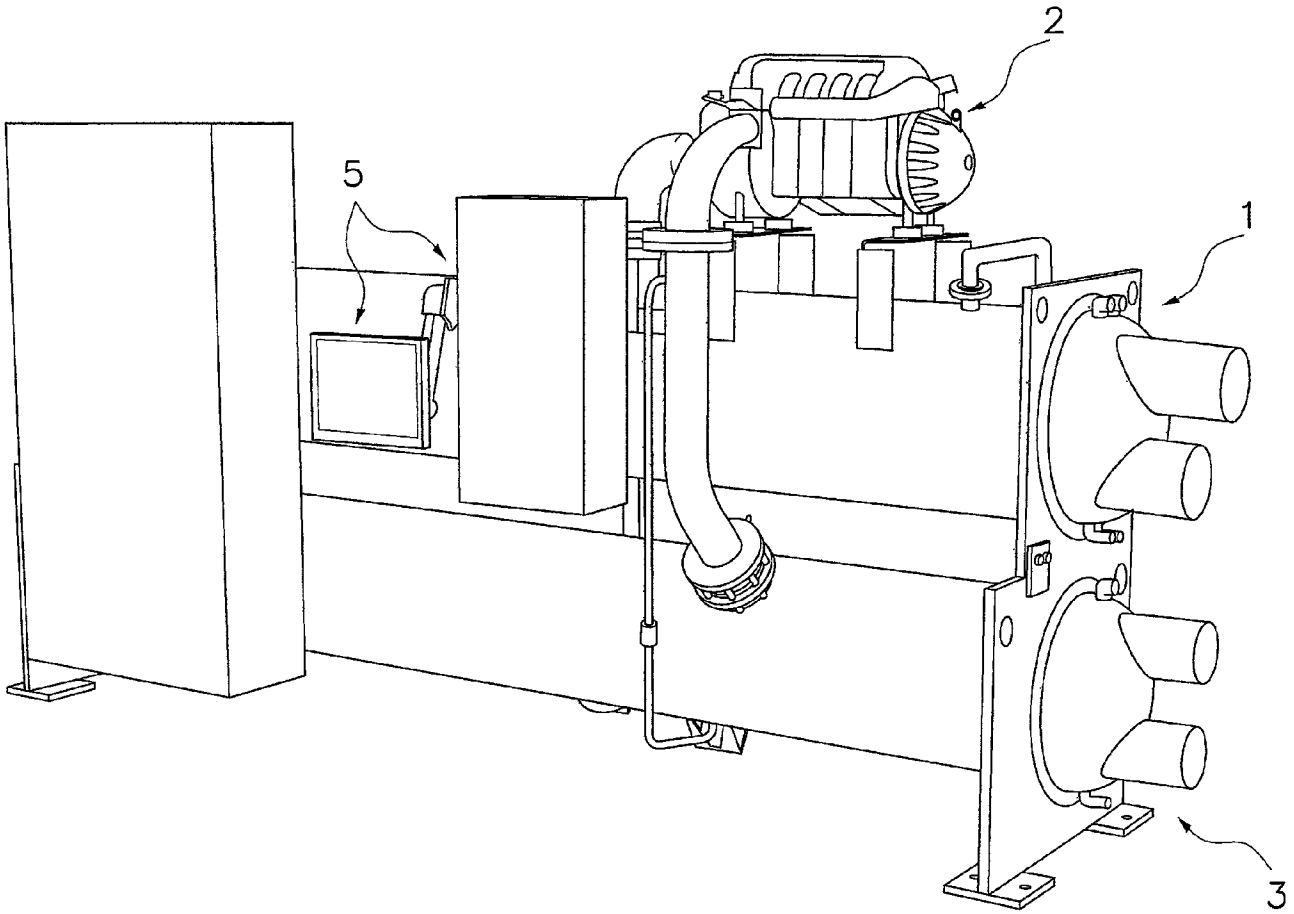
FIG. 1 is a simplified, overall perspective view of a vapor compression system including a heat exchanger according to a first embodiment of the present invention.
Figure 2:
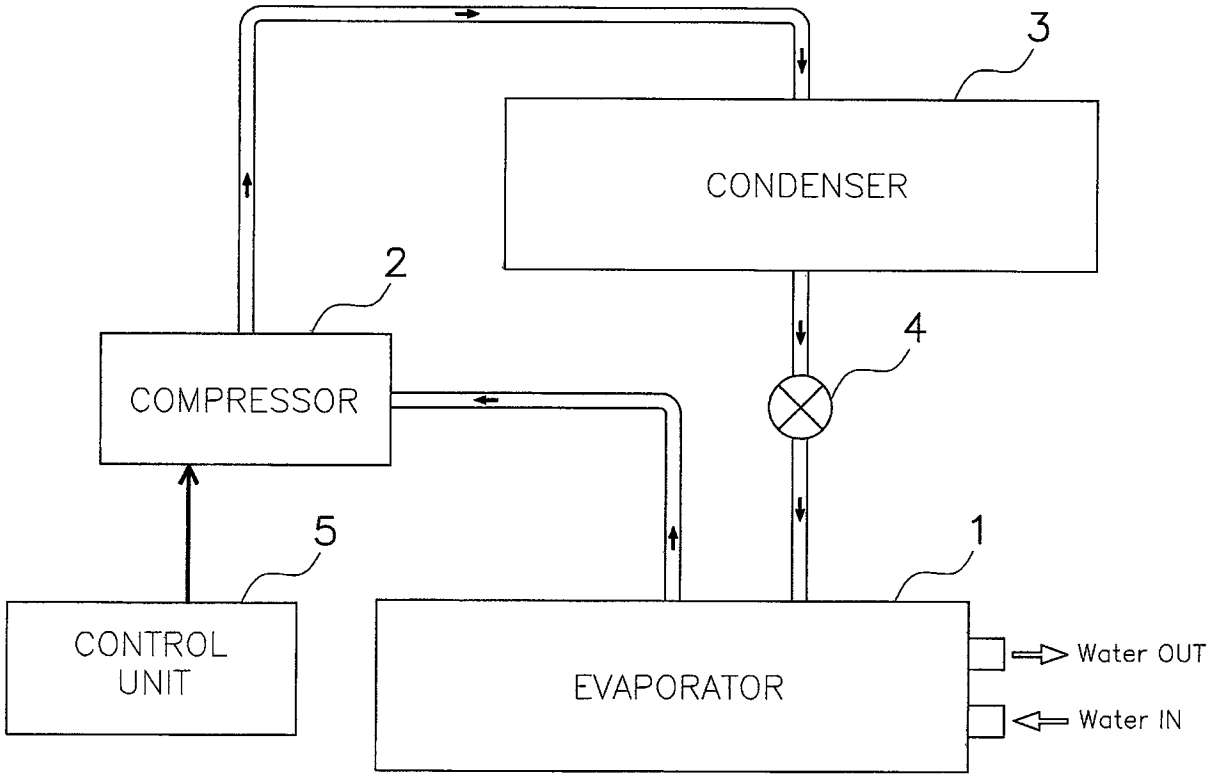
FIG. 2 is a block diagram illustrating a refrigeration circuit of the vapor compression system including the heat exchanger according to the first embodiment of the present invention.

Referring initially to FIGS. 1 and 2, a vapor compression system including a heat exchanger according to a first embodiment will be explained. As seen in FIG. 1, the vapor compression system according to the first embodiment is a chiller that may be used in a heating, ventilation and air conditioning (HVAC) system for air-conditioning of large buildings and the like. The vapor compression system of the first embodiment is configured and arranged to remove heat from liquid to be cooled (e.g., water, ethylene, ethylene glycol, calcium chloride brine, etc.) via a vapor-compression refrigeration cycle.

As shown in FIGS. 1 and 2, the vapor compression system includes the following four main components: an evaporator 1, a compressor 2, a condenser 3 and an expansion device 4.

The evaporator 1 is a heat exchanger that removes heat from the liquid to be cooled (in this example, water) passing through the evaporator 1 to lower the temperature of the water as a circulating refrigerant evaporates in the evaporator 1. The refrigerant entering the evaporator 1 is in a two-phase gas/liquid state. The liquid refrigerant evaporates as the vapor refrigerant in the evaporator 1 while absorbing heat from the water.

The low pressure, low temperature vapor refrigerant is discharged from the evaporator 1 and enters the compressor 2 by suction. In the compressor 2, the vapor refrigerant is compressed to the higher pressure, higher temperature vapor. The compressor 2 may be any type of conventional compressor, for example, centrifugal compressor, scroll compressor, reciprocating compressor, screw compressor, etc.

Next, the high temperature, high pressure vapor refrigerant enters the condenser 3, which is another heat exchanger that removes heat from the vapor refrigerant causing it to condense from a gas state to a liquid state. The condenser 3 may be an air-cooled type, a water-cooled type, or any suitable type of condenser. The heat raises the temperature of cooling water or air passing through the condenser 3, and the heat is rejected to outside of the system as being carried by the cooling water or air.

The condensed liquid refrigerant then enters through the expansion device 4 where the refrigerant undergoes an abrupt reduction in pressure. The expansion device 4 may be as simple as an orifice plate or as complicated as an electronic modulating thermal expansion valve. The abrupt pressure reduction results in partial evaporation of the liquid refrigerant, and thus, the refrigerant entering the evaporator 1 is in a two-phase gas/liquid state.

Some examples of refrigerants used in the vapor compression system are hydrofluorocarbon (HFC) based refrigerants, for example, R-410A, R-407C, and R-134a, hydrofluoro olefin (HFO), unsaturated HFC based refrigerant, for example, R-1234ze, and R-1234yf, natural refrigerants, for example, R-717 and R-718, or any other suitable type of refrigerant.

The vapor compression system includes a control unit 5 that is operatively coupled to a drive mechanism of the compressor 2 to control operation of the vapor compression system.

It will be apparent to those skilled in the art from this disclosure that conventional compressor, condenser and expansion device may be used respectively as the compressor 2, the condenser 3 and the expansion device 4 in order to carry out the present invention. In other words, the compressor 2, the condenser 3 and the expansion device 4 are conventional components that are well known in the art. Since the compressor 2, the condenser 3 and the expansion device 4 are well known in the art, these structures will not be discussed or illustrated in detail herein. The vapor compression system may include a plurality of evaporators 1, compressors 2 and/or condensers 3.

Figure 3:
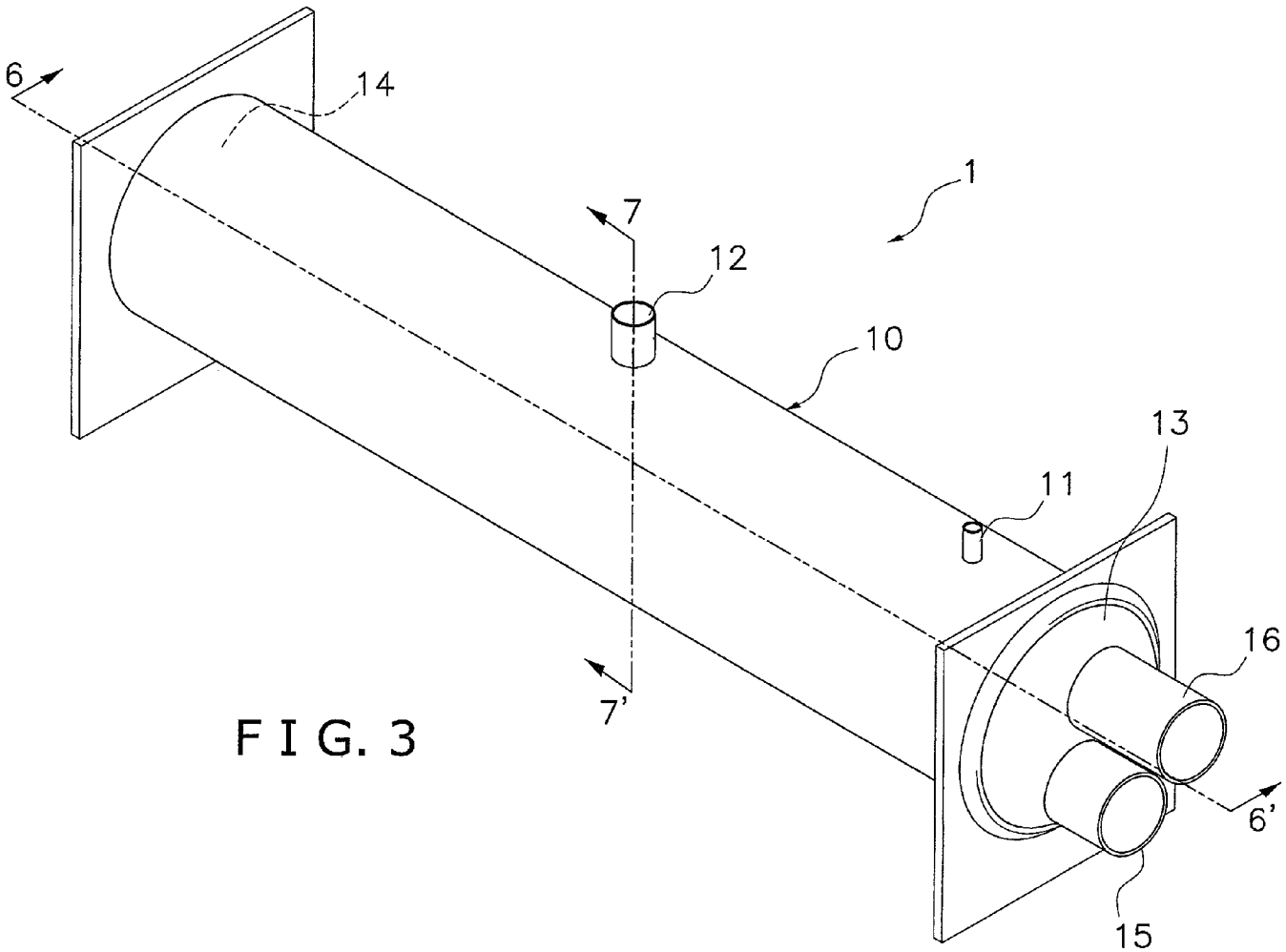
FIG. 3 is a simplified perspective view of the heat exchanger according to the first embodiment of the present invention.
Figure 4:
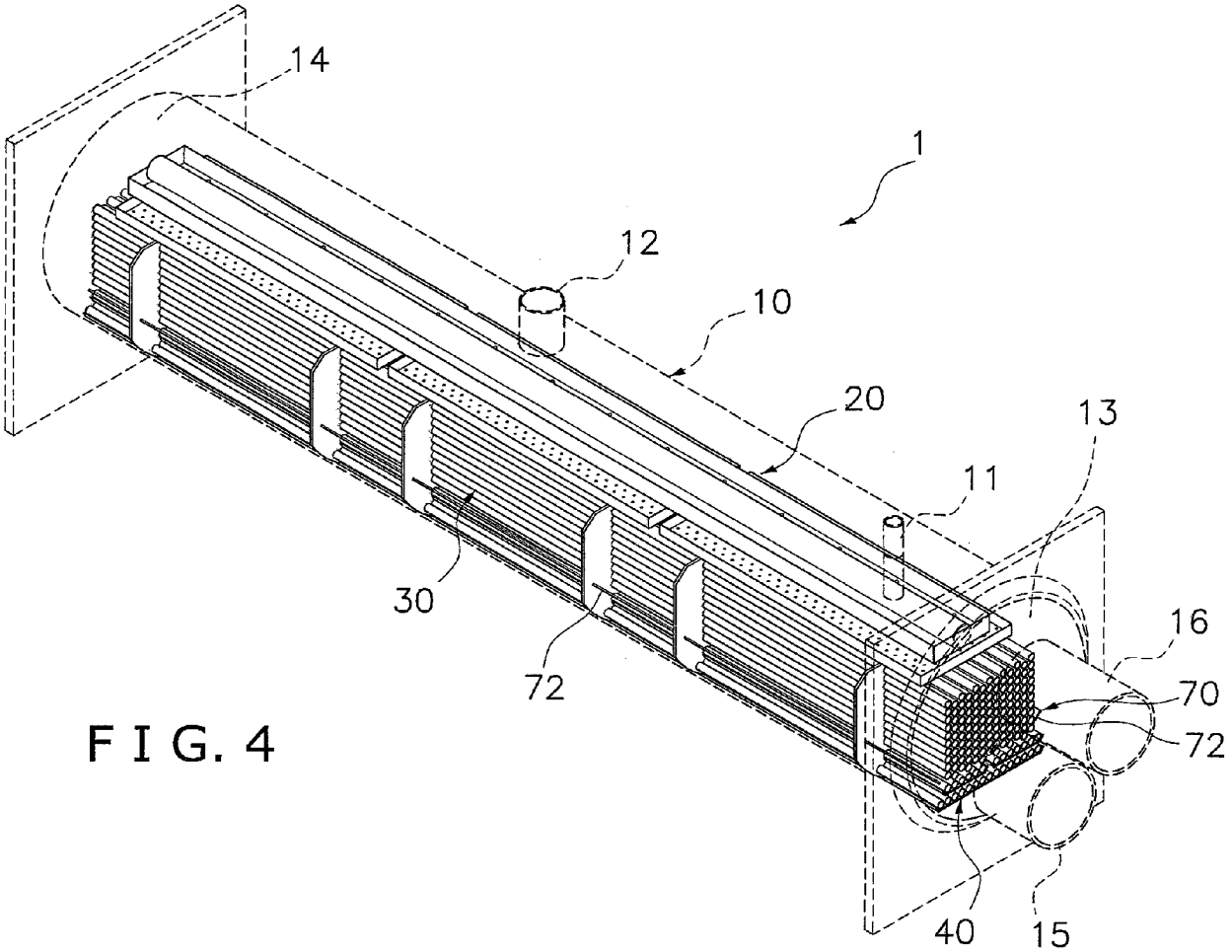
FIG. 4 is a simplified perspective view of an internal structure of the heat exchanger according to the first embodiment of the present invention.
Figure 5:
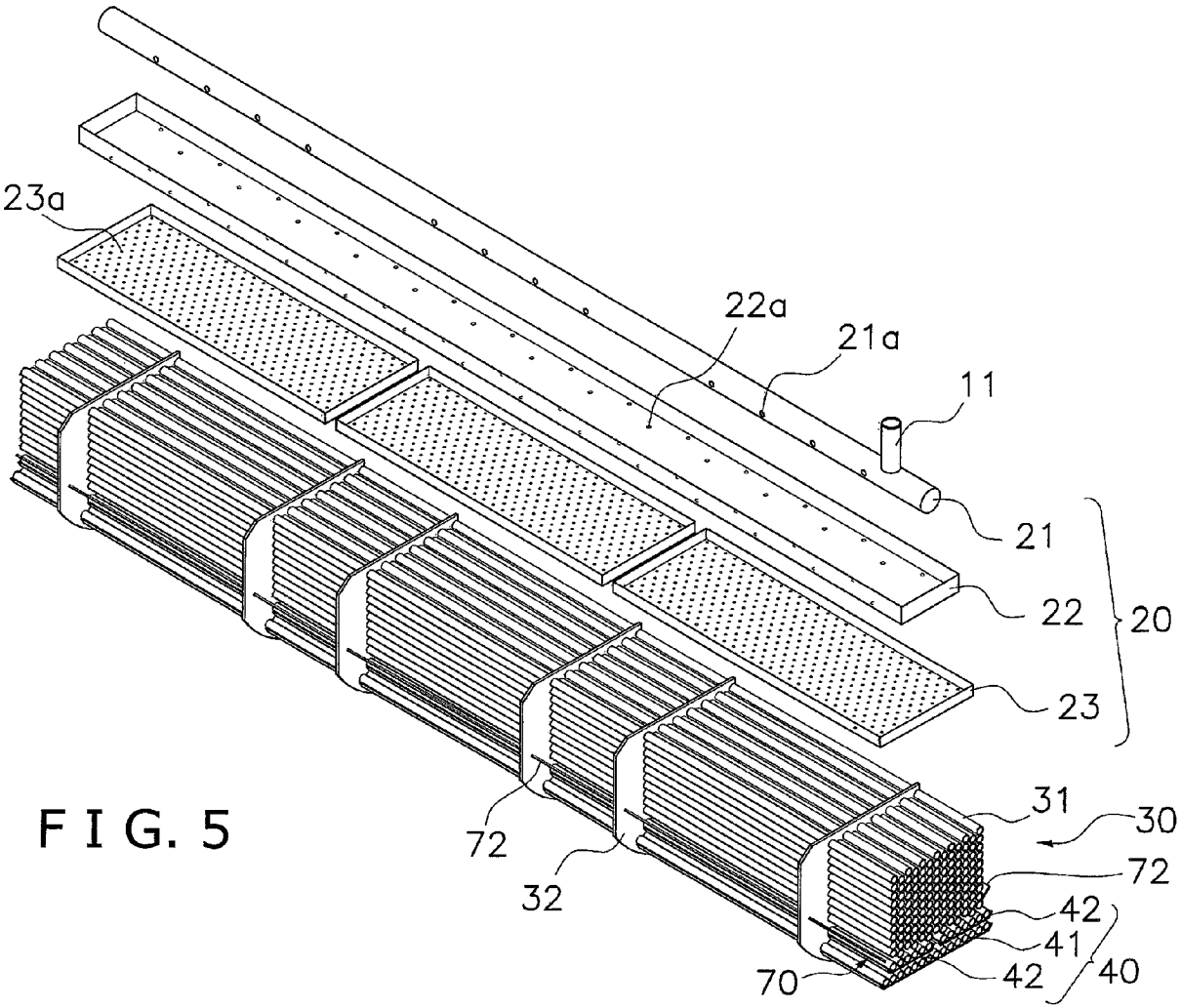
FIG. 5 is an exploded view of the internal structure of the heat exchanger according to the first embodiment of the present invention.
Figure 6:
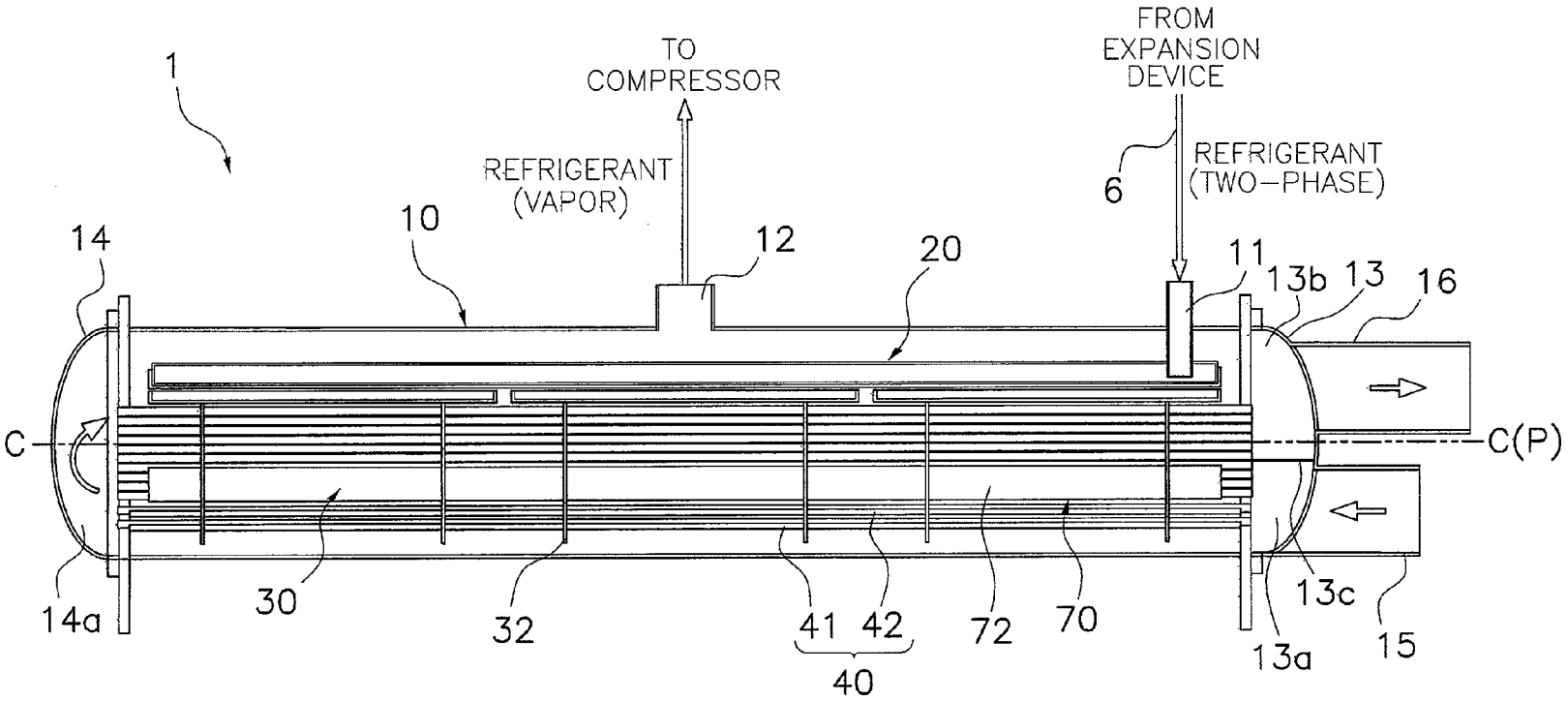
FIG. 6 is a simplified longitudinal cross sectional view of the heat exchanger according to the first embodiment of the present invention as taken along a section line 6-6' in FIG. 3.

Referring now to FIGS. 3 to 5, the detailed structure of the evaporator 1, which is the heat exchanger according to the first embodiment, will be explained. As shown in FIGS. 3 and 6, the evaporator 1 includes a shell 10 having a generally cylindrical shape with a longitudinal center axis C (FIG. 6) extending generally in the horizontal direction. The shell 10 includes a connection head member 13 defining an inlet water chamber 13*a* and an outlet water chamber 13*b*, and a return head member 14 defining a water chamber 14*a*. The connection head member 13 and the return head member 14 are fixedly coupled to longitudinal ends of a cylindrical body of the shell 10. The inlet water chamber 13*a* and the outlet water chamber 13*b* are partitioned by a water baffle 13*c*. The connection head member 13 includes a water inlet pipe 15 through which water enters the shell 10 and a water outlet pipe 16 through which the water is discharged from the shell 10. As shown in FIGS. 3 and 6, the shell 10 further includes a refrigerant inlet pipe 11 and a refrigerant outlet pipe 12. The refrigerant inlet pipe 11 is fluidly connected to the expansion device 4 via a supply conduit 6 (FIG. 7) to introduce the two-phase refrigerant into the shell 10. The expansion device 4 may be directly coupled at the refrigerant inlet pipe 11. The liquid component in the two-phase refrigerant boils and/or evaporates in the evaporator 1 and goes through phase change from liquid to vapor as it absorbs heat from the water passing through the evaporator 1. The vapor refrigerant is drawn from the refrigerant outlet pipe 12 to the compressor 2 by suction.

Figure 7:
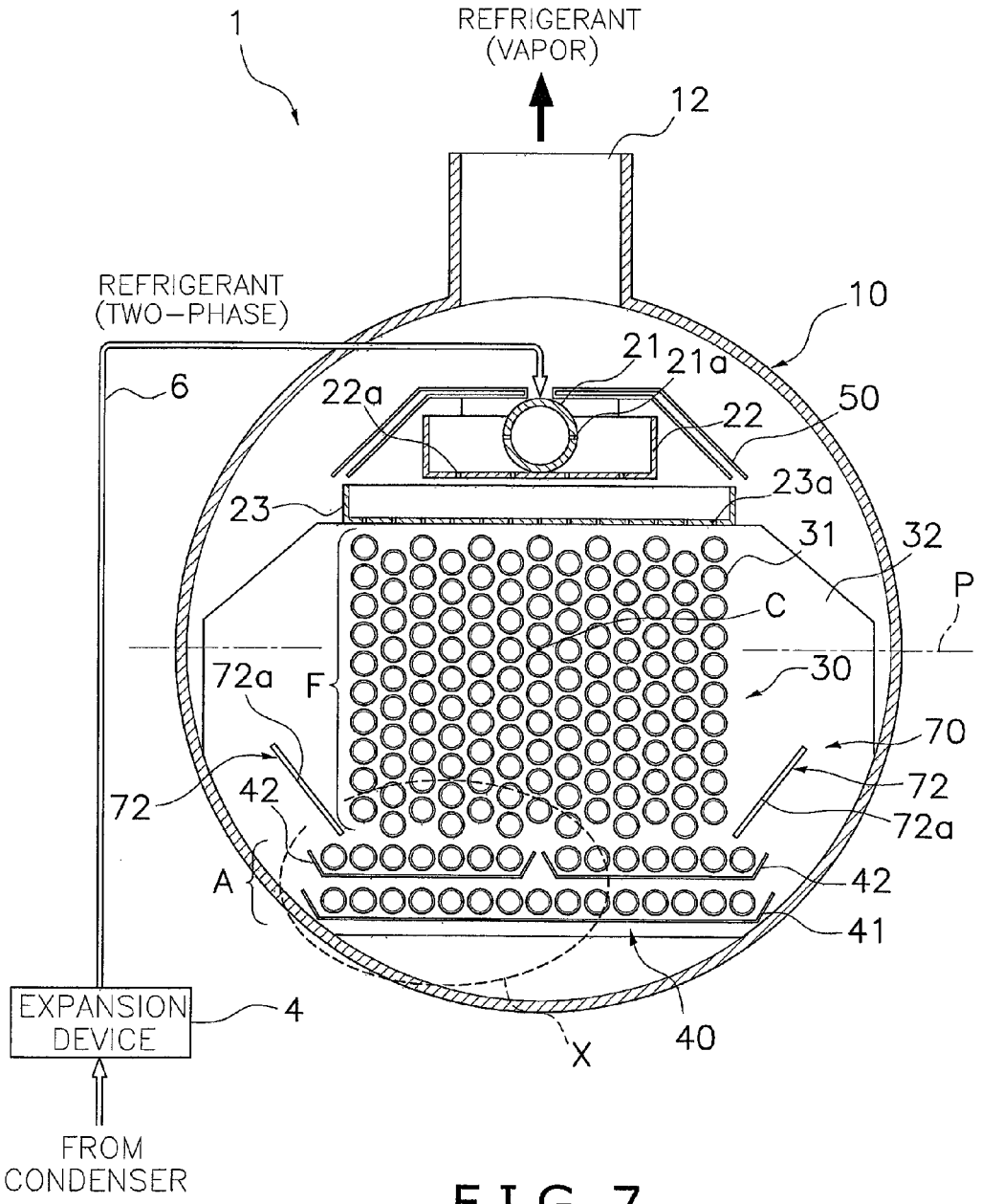
FIG. 7 is a simplified transverse cross sectional view of the heat exchanger according to the first embodiment of the present invention as taken along a section line 7-7' in FIG. 3.

FIG. 4 is a simplified perspective view illustrating an internal structure accommodated in the shell 10. FIG. 5 is an exploded view of the internal structure shown in FIG. 4. As shown in FIGS. 4 and 5, the evaporator 1 basically includes a distributing part 20, a tube bundle 30, and a trough part 40. The evaporator 1 preferably further includes a baffle structure 50 as shown in FIG. 7 although illustration of the baffle structure 50 is omitted in FIGS. 4-6 for the sake of brevity.

The distributing part 20 is configured and arranged to serve as both a gas-liquid separator and a refrigerant distributor. As shown in FIG. 5, the distributing part 20 includes an inlet pipe part 21, a first tray part 22 and a plurality of second tray parts 23.

As shown in FIG. 6, the inlet pipe part 21 extends generally parallel to the longitudinal center axis C of the shell 10. The inlet pipe part 21 is fluidly connected to the refrigerant inlet pipe 11 of the shell 10 so that the two-phase refrigerant is introduced into the inlet pipe part 21 via the refrigerant inlet pipe 11. The inlet pipe part 21 includes a plurality of openings 21*a* disposed along the longitudinal length of the inlet pipe part 21 for discharging the two-phase refrigerant. When the two-phase refrigerant is discharged from the openings 21*a* of the inlet pipe part 21, the liquid component of the two-phase refrigerant discharged from the openings 21*a* of the inlet pipe part 21 is received by the first tray part 22. On the other hand, the vapor component of the two-phase refrigerant flows upwardly and impinges the baffle structure 50 shown in FIG. 7, so that liquid droplets entrained in the vapor are captured by the baffle structure 50. The liquid droplets captured by the baffle structure 50 are guided along a slanted surface of the baffle structure 50 toward the first tray part 22. The baffle structure 50 may be configured as a plate member, a mesh screen, or the like. The vapor component flows downwardly along the baffle structure 50 and then changes its direction upwardly toward the outlet pipe 12. The vapor refrigerant is discharged toward the compressor 2 via the outlet pipe 12.

As shown in FIGS. 5 and 6, the first tray part 22 extends generally parallel to the longitudinal center axis C of the shell 10. As shown in FIG. 7, a bottom surface of the first tray part 22 is disposed below the inlet pipe part 21 to receive the liquid refrigerant discharged from the openings 21*a* of the inlet pipe part 21. In the first embodiment, the inlet pipe part 21 is disposed within the first tray part 22 so that no vertical gap is formed between the bottom surface of the first tray part 22 and the inlet pipe part 21 as shown in FIG. 7. In other words, in the first embodiment, a majority of the inlet pipe part 21 overlaps the first tray part 22 when viewed along a horizontal direction perpendicular to the longitudinal center axis C of the shell 10 as shown in FIG. 6. This arrangement is advantageous because an overall volume of the liquid refrigerant accumulated in the first tray part 22 can be reduced while maintaining a level (height) of the liquid refrigerant accumulated in the first tray part 22 relatively high. Alternatively, the inlet pipe part 21 and the first tray part 22 may be arranged such that a larger vertical gap is formed between the bottom surface of the first tray part 22 and the inlet pipe part 21. The inlet pipe part 21, the first tray part 22 and the baffle structure 50 are preferably coupled together and suspended from above in an upper portion of the shell 10 in a suitable manner.

As shown in FIGS. 5 and 7, the first tray part 22 has a plurality of first discharge apertures 22*a* from which the liquid refrigerant accumulated therein is discharged downwardly. The liquid refrigerant discharged from the first discharge apertures 22*a* of the first tray part 22 is received by one of the second tray parts 23 disposed below the first tray part 22.

As shown in FIGS. 5 and 6, the distributing part 20 of the first embodiment includes three identical second try parts 23. The second tray parts 23 are aligned side-by-side along the longitudinal center axis C of the shell 10. As shown in FIG. 6, an overall longitudinal length of the three second tray parts 23 is substantially the same as a longitudinal length of the first tray part 22 as shown in FIG. 6. A transverse width of the second tray part 23 is set to be larger than a transverse width of the first tray part 22 so that the second tray part 23 extends over substantially an entire width of the tube bundle 30 as shown in FIG. 7. The second tray parts 23 are arranged so that the liquid refrigerant accumulated in the second tray parts 23 does not communicate between the second tray parts 23. As shown in FIGS. 5 and 7, each of the second tray parts 23 has a plurality of second discharge apertures 23*a* from which the liquid refrigerant is discharged downwardly toward the tube bundle 30.

It will be apparent to those skilled in the art from this disclosure that structure and configuration of the distributing part 20 are not limited to the ones described herein. Any conventional structure for distributing the liquid refrigerant downwardly onto the tube bundle 30 may be utilized to carry out the present invention. For example, a conventional distributing system utilizing spraying nozzles and/or spray tree tubes may be used as the distributing part 20. In other words, any conventional distributing system that is compatible with a falling film type evaporator can be used as the distributing part 20 to carry out the present invention.

The tube bundle 30 is disposed below the distributing part 20 so that the liquid refrigerant discharged from the distributing part 20 is supplied onto the tube bundle 30. The tube bundle 30 includes a plurality of heat transfer tubes 31 that extend generally parallel to the longitudinal center axis C of the shell 10 as shown in FIG. 6. The heat transfer tubes 31 are made of materials having high thermal conductivity, such as metal. The heat transfer tubes 31 are preferably provided with interior and exterior grooves to further promote heat exchange between the refrigerant and the water flowing inside the heat transfer tubes 31. Such heat transfer tubes including the interior and exterior grooves are well known in the art. For example, Thermoexel-E tubes by Hitachi Cable Ltd. may be used as the heat transfer tubes 31 of this embodiment. As shown in FIG. 5, the heat transfer tubes 31 are supported by a plurality of vertically extending support plates 32, which are fixedly coupled to the shell 10. In the first embodiment, the tube bundle 30 is arranged to form a two-pass system, in which the heat transfer tubes 31 are divided into a supply line group disposed in a lower portion of the tube bundle 30, and a return line group disposed in an upper portion of the tube bundle 30. As shown in FIG. 6, inlet ends of the heat transfer tubes 31 in the supply line group are fluidly connected to the water inlet pipe 15 via the inlet water chamber 13*a* of the connection head member 13 so that water entering the evaporator 1 is distributed into the heat transfer tubes 31 in the supply line group. Outlet ends of the heat transfer tubes 31 in the supply line group and inlet ends of the heat transfer tubes 31 of the return line tubes are fluidly communicated with a water chamber 14*a* of the return head member 14. Therefore, the water flowing inside the heat transfer tubes 31 in the supply line group is discharged into the water chamber 14*a*, and redistributed into the heat transfer tubes 31 in the return line group. Outlet ends of the heat transfer tubes 31 in the return line group are fluidly communicated with the water outlet pipe 16 via the outlet water chamber 13*b* of the connection head member 13. Thus, the water flowing inside the heat transfer tubes 31 in the return line group exits the evaporator 1 through the water outlet pipe 16. In a typical two-pass evaporator, the temperature of the water entering at the water inlet pipe 15 may be about 54 degrees F. (about 12° C.), and the water is cooled to about 44 degrees F. (about 7° C.) when it exits from the water outlet pipe 16. Although, in this embodiment, the evaporator 1 is arranged to form a two-pass system in which the water goes in and out on the same side of the evaporator 1, it will be apparent to those skilled in the art from this disclosure that the other conventional system such as a one-pass or three-pass system may be used. Moreover, in the two-pass system, the return line group may be disposed below or side-by-side with the supply line group instead of the arrangement illustrated herein.

The detailed arrangement for a heat transfer mechanism of the evaporator 1 according to the first embodiment will be explained with reference to FIG. 7. FIG. 7 is a simplified transverse cross sectional view of the evaporator 1 taken along a section line 7-7' in FIG. 3.

As described above, the refrigerant in a two-phase state is supplied through the supply conduit 6 to the inlet pipe part 21 of the distributing part 20 via the inlet pipe 11. In FIG. 7, the flow of refrigerant in the refrigeration circuit is schematically illustrated, and the inlet pipe 11 is omitted for the sake of brevity. The vapor component of the refrigerant supplied to the distributing part 20 is separated from the liquid component in the first tray section 22 of the distributing part 20 and exits the evaporator 1 through the outlet pipe 12. On the other hand, the liquid component of the two-phase refrigerant is accumulated in the first tray part 22 and then in the second tray parts 23, and discharged from the discharge apertures 23*a* of the second tray part 23 downwardly towards the tube bundle 30.

As shown in FIG. 7, the tube bundle 30 of the first embodiment includes a falling film region F and an accumulating region A. The heat transfer tubes 31 in the falling film region F are configured and arranged to perform falling film evaporation of the liquid refrigerant. More specifically, the heat transfer tubes 31 in the falling film region F are arranged such that the liquid refrigerant discharged from the distributing part 20 forms a layer (or a film) along an exterior wall of each of the heat transfer tubes 31, where the liquid refrigerant evaporates as vapor refrigerant while it absorbs heat from the water flowing inside the heat transfer tubes 31. As shown in FIG. 7, the heat transfer tubes 31 in the falling film region F are arranged in a plurality of vertical columns extending parallel to each other when seen in a direction parallel to the longitudinal center axis C of the shell 10 (as shown in FIG. 7). Therefore, the refrigerant falls downwardly from one heat transfer tube to another by force of gravity in each of the columns of the heat transfer tubes 31. The columns of the heat transfer tubes 31 are disposed with respect to the second discharge openings 23*a* of the second tray part 23 so that the liquid refrigerant discharged from the second discharge openings 23*a* is deposited onto an uppermost one of the heat transfer tubes 31 in each of the columns. In the first embodiment, the columns of the heat transfer tubes 31 in the falling film region F are arranged in a staggered pattern as shown in FIG. 7. In the first embodiment, a vertical pitch between two adjacent ones of the heat transfer tubes 31 in the falling film region F is substantially constant. Likewise, a horizontal pitch between two adjacent ones of the columns of the heat transfer tubes 31 in the falling film region F is substantially constant.

The liquid refrigerant that did not evaporate in the falling film region F continues falling downwardly by force of gravity into the accumulating region A, where the trough part 40 is provided as shown in FIG. 7. The trough part 40 is configured and arranged to accumulate the liquid refrigerant flowing from above so that the heat transfer tubes 31 in the accumulating region A are at least partially immersed in the liquid refrigerant that is accumulated in the trough part 40. A number of rows of the heat transfer tubes 31 in the accumulating region A, to which the trough part 40 is provided, is preferably about 10% to about 20% of a total number of rows of the heat transfer tubes 31 of the tube bundle 30. In other words, a ratio between the number of rows of the heat transfer tubes 31 in the accumulating region A and the number of the heat transfer tubes 31 in one of the columns in the falling film region F is preferably about 1:9 to about 2:8. Alternatively, when the heat transfer tubes 31 is arranged in an irregular pattern (e.g., the number of heat transfer tubes in each of the columns is different), a number of heat transfer tubes 31 disposed in the accumulating region A (i.e., at least partially immersed in the liquid refrigerant accumulated in the trough part 40) is preferably about 10% to about 20% of a total number of the heat transfer tubes in the tube bundle 30. In the example shown in FIG. 7, the trough part 40 is provided to two rows of the heat transfer tubes 31 in the accumulating region A, while each of the columns of the heat transfer tubes 31 in the falling film region F includes ten rows (i.e., the total number of rows in the tube bundle 30 is twelve). It will be apparent to those skilled in the art from this disclosure that, when the evaporator has a larger capacity and includes a larger number of heat transfer tubes, the number of columns of the heat transfer tubes in the falling film region F and/or the number of rows of the heat transfer tubes in the accumulating region A also increase.

As shown in FIG. 7, the trough part 40 includes a first trough section 41 and a pair of second trough sections 42. As seen in FIG. 6, the first trough section 41 and the second trough sections 42 extend generally parallel to the longitudinal center axis C of the shell 10 over a longitudinal length that is substantially the same as a longitudinal length of the heat transfer tubes 31. The first trough section 41 and the second trough sections 42 of the trough part 40 are spaced apart from an interior surface of the shell 10 when viewed along the longitudinal center axis C as seen in FIG. 7. The first trough section 41 and the second trough sections 42 may be made of a variety of materials such as metal, alloy, resin, etc. In the first embodiment, the first trough section 41 and the second trough sections 42 are made of metallic material, such as a steel plate (steel sheet). The first trough section 41 and the second trough sections 42 are supported by the support plates 32. The support plates 32 include openings (not shown) disposed at positions corresponding to an internal region of the first trough section 41 so that all segments of the trough section 41 are in fluid communication along the longitudinal length of the first trough section 41. Therefore, the liquid refrigerant accumulated in the first trough section 41 fluidly communicates via the openings in the support plates 32 along the longitudinal length of the trough section 41. Likewise, openings (not shown) are provided in the support plates 32 at positions corresponding to an internal region of each of the second trough sections 42 so that all segments of the second trough section 42 are in fluid communication along the longitudinal length of the second trough section 42. Therefore, the liquid refrigerant accumulated in the trough section 42 fluidly communicates via the openings in the support plates 32 along the longitudinal length of the second trough section 42.

As shown in FIG. 7, the first trough section 41 is disposed below the lowermost row of the heat transfer tubes 31 in the accumulating region A while the second trough sections 42 are disposed below the second lowermost row of the heat transfer tubes 31. As shown in FIG. 7, the second lowermost row in of the heat transfer tubes 31 in the accumulating region A is divided into two groups, and each of the second trough sections 42 is respectively disposed below each of the two groups. A gap is formed between the second trough sections 42 to allow an overflow of the liquid refrigerant from the second trough sections 42 toward the first trough section 41.

In the first embodiment, the heat transfer tubes 31 in the accumulating region A are arranged so that an outermost one of the heat transfer tubes 31 in each row of the accumulating region A is disposed outwardly of an outermost column of the heat transfer tubes 31 in the falling film region F on each side of the tube bundle 30 as shown in FIG. 7. Since the flow of liquid refrigerant tends to flare outwardly as it progresses toward the lower region of the tube bundle 30 due to vapor flow within the shell 10, it is preferable to provide at least one heat transfer tube in each row of the accumulating region A, which is disposed outwardly of the outermost column of the heat transfer tubes 31 in the falling film region F as shown in FIG. 7.

Figure 8:
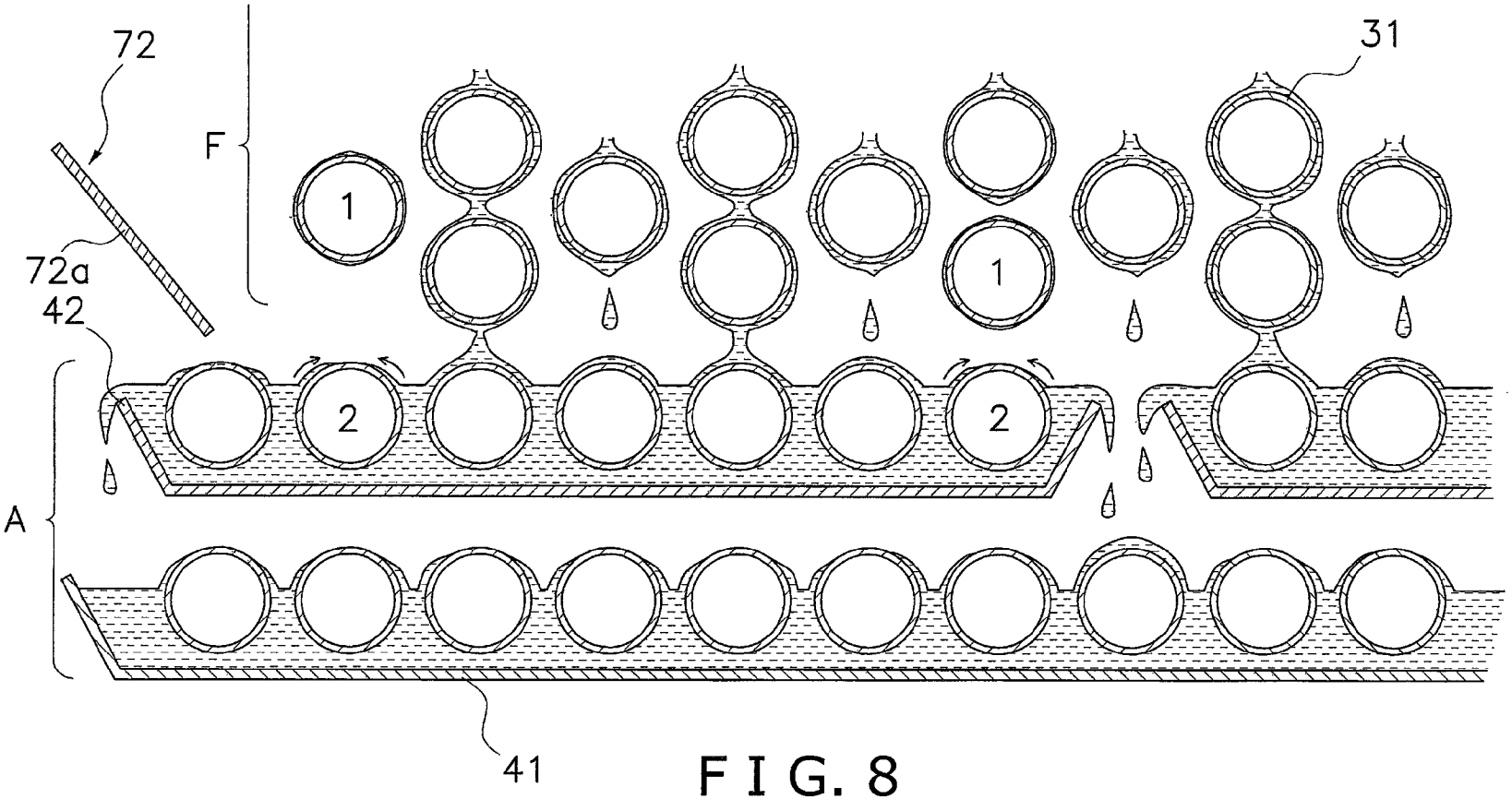
FIG. 8 is an enlarged schematic cross sectional view of heat transfer tubes and a trough part disposed in region X in FIG. 7 illustrating a state in which the heat exchanger is in use according to the first embodiment of the present invention.

FIG. 8 shows an enlarged cross sectional view of the region X in FIG. 7 schematically illustrating a state in which the evaporator 1 is in use under normal conditions. Water flowing inside the heat transfer tubes 31 is not illustrated in FIG. 8 for the sake of brevity. As shown in FIG. 8, the liquid refrigerant forms films along the exterior surfaces of the heat transfer tubes 31 in the falling film region F and part of the liquid refrigerant evaporates as the vapor refrigerant. However, an amount of the liquid refrigerant falling along the heat transfer tubes 31 decreases as it progresses toward the lower region of the tube bundle 30 while the liquid refrigerant evaporates as the vapor refrigerant. Moreover, if distribution of the liquid refrigerant from the distributing part 20 is not be even, there is more chance of formation of dry patches in the heat transfer tubes 31 disposed in a lower region of the tube bundle 30, which is detrimental to heat transfer. Thus, in the first embodiment of the present invention, the trough part 40 is provided in the accumulating region A, which is disposed in the lower region of the tube bundle 30, to accumulate the liquid refrigerant flowing from above and to redistribute the accumulated refrigerant along the longitudinal direction of the shell C. Therefore, all of the heat transfer tubes 31 in the accumulating region A are at least partially immersed in the liquid refrigerant collected in the trough part 40 according to the first embodiment. Thus, formation of dry patch in the lower region of the tube bundle 30 can be prevented, and good heat transfer efficiency of the evaporator 1 can be ensured.

For example, as shown in FIG. 8, when the heat transfer tubes 31 marked "1" receive little refrigerant, the heater transfer tubes 31 marked "2", which are disposed immediately below the ones marked "1," do not receive the liquid refrigerant from above. However, the liquid refrigerant is accumulated in the second trough sections 42 as the liquid refrigerant flows along the other heat transfer tubes 31. Therefore, the heat transfer tubes 31 immediately above the second trough sections 42 are at least partially immersed in the liquid refrigerant accumulated in the second trough sections 42. Moreover, even when the heat transfer tubes 31 are only partially immersed in the liquid refrigerant accumulated in the second trough section 42 (i.e., a part of each of the heat transfer tubes 31 is exposed), the liquid refrigerant accumulated in the trough sections 42 rises up along exposed surfaces of the exterior walls of the heat transfer tubes 31 as indicated by the arrows shown in FIG. 8 due to capillary action. Therefore, the liquid refrigerant accumulated in the second trough sections 42 boils and/or evaporates while absorbing heat from the water passing through the heat transfer tubes 31. Moreover, the second trough sections 42 are designed to allow the liquid refrigerant to overflow from the second trough sections 42 onto the first trough section 41. In order to readily receive the liquid refrigerant overflowed from the second trough section 42, outer edges of the first trough section 41 are disposed outwardly of outer edges of the second trough sections 42 as shown in FIGS. 7 and 8. The heat transfer tubes 31 that are disposed immediately above the first trough section 41 are at least partially immersed in the liquid refrigerant accumulated in the first trough section 41 as shown in FIG. 8. Moreover, even when the heat transfer tubes 31 are only partially immersed in the liquid refrigerant accumulated in the second trough section 41 (i.e., a part of each of the heat transfer tubes 31 is exposed), the liquid refrigerant in the trough section 41 rises up along exposed surfaces of the exterior walls of the heat transfer tubes 31 that are at least partially immersed in the accumulated refrigerant due to capillary action. Therefore, the liquid refrigerant accumulated in the first trough section 41 boils and/or evaporates while absorbing heat from the water passing inside the heat transfer tubes 31. Accordingly, heat transfer effectively takes place between the liquid refrigerant and the water flowing inside the heat transfer tubes 31 in the accumulating region A.

With reference to FIGS. 4-8, the evaporator 1 preferably includes a guide part 70 arranged to guide scattered refrigerant back toward the heat transfer tubes 31 above the trough part 40. In the illustrated embodiment where the shell 10 has a cylindrical configuration, the guide part 70 basically includes a pair of lateral side portions 72 extending upwardly and laterally outwardly from the tube bundle 30 at a vertical position at opposite lateral sides of an upper end of the trough part 40. In any case, the guide part 70 includes at least one lateral side portion 72 extending upwardly and laterally outwardly from the tube bundle 30 at a vertical position at an upper end of the trough part 40, as best seen in FIG. 7. Each lateral side portion 72 is formed of a plurality of separate sections that are welded to vertical plates 32 as best understood from FIGS. 4-6.

Each lateral side portion 72 of the guide part 70 includes an inclined section 72*a* that is inclined between 10 degrees and 45 degrees relative to a horizontal plane P passing through the longitudinal center axis C of the shell 10. More preferably, each inclined section 72*a* is inclined between 30 degrees and 45 degrees relative to the horizontal plane P. In the illustrated embodiment, each inclined section 72*a* is inclined about 40 degrees relative to the horizontal plane P. As seen in FIG. 7, the lateral side portions 72 and the inclined sections 72*a* are identical to each other, except their orientations are mirror images of each other. In the illustrated embodiment, each of the lateral side portions 72 consists only of one of the inclined sections 72*a*. However, it will be apparent to those skilled in the art from this disclosure that each of the lateral side portions 72 can include an additional section or additional sections if needed and/or desired.

Figure 9:
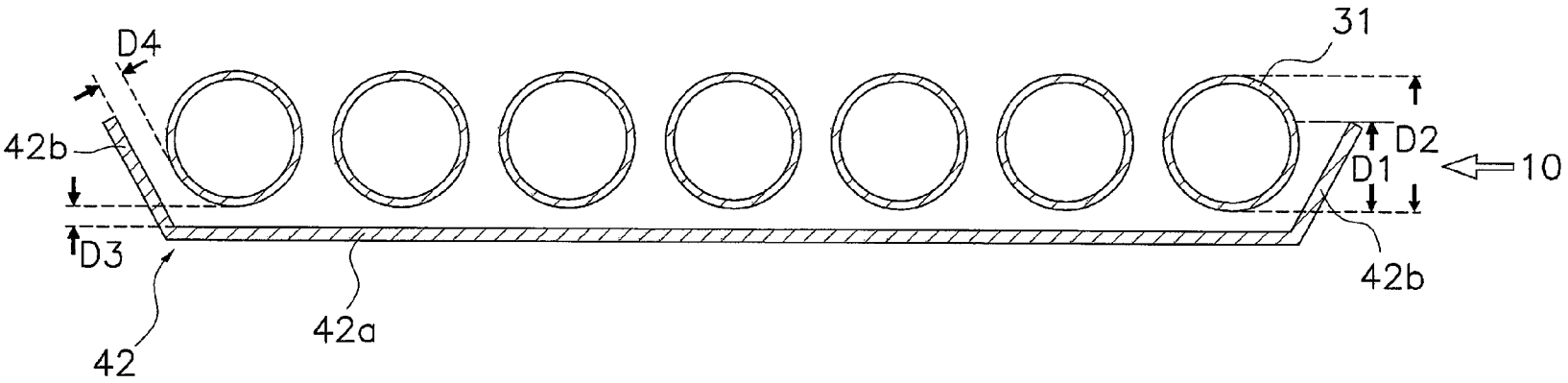
FIG. 9 is an enlarged cross sectional view of the heat transfer tubes and one of trough sections of a trough part according to the first embodiment of the present invention.
Figure 10:
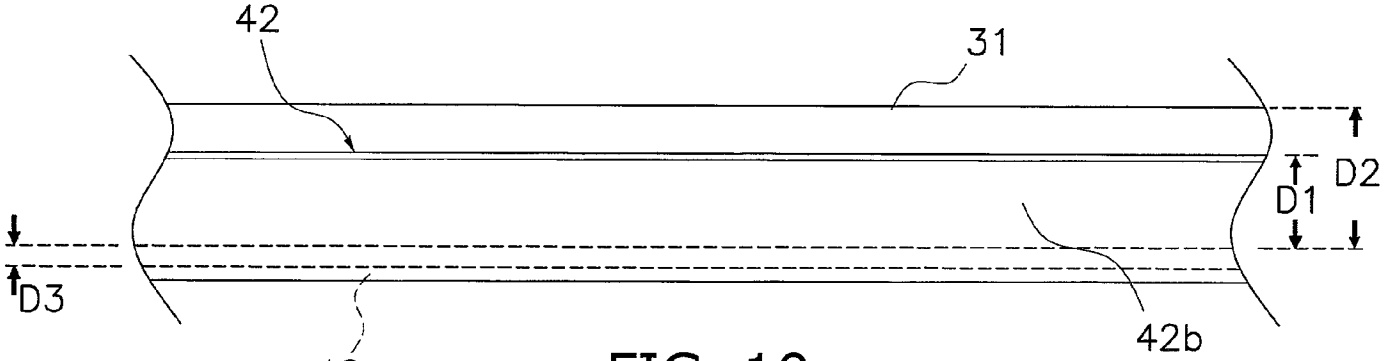
FIG. 10 is a partial side elevational view of the heat transfer tubes and the trough section according to the first embodiment of the present invention as seen in a direction along an arrow 10 in FIG. 9.
Figure 11B:
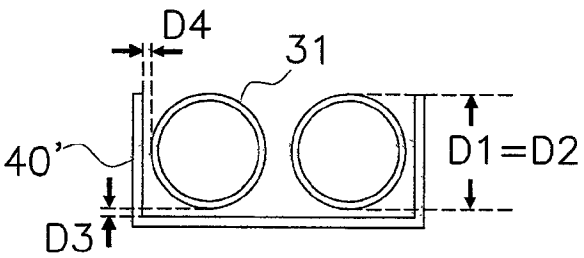
FIGS. 11B to 11D are simplified cross sectional views of the samples used to plot the graph shown in FIG. 11A.
Figure 11C:
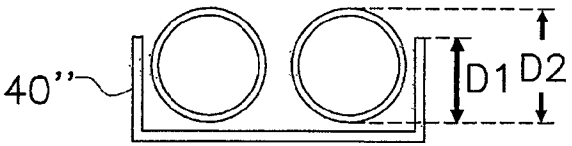
Figure 11D:
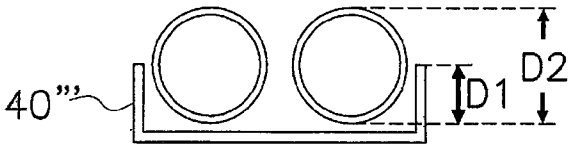

With reference to FIGS. 9 and 10, the detailed structure of the first trough section 41 and the second trough sections 42, and an arrangement of the first trough section 41 and the second trough sections 42 with respect to the heat transfer tubes 31 will be explained using one of the second trough sections 42 as an example. As seen in FIG. 9, the second trough section 42 includes a bottom wall portion 42*a* and a pair of side wall portions 42*b* extending upwardly from transverse ends of the bottom wall portion 42*a*. Although the side wall portions 42*b* have an upwardly tapered profile in the first embodiment, the shape of the second trough section 42 is not limited to this configuration. For example, the side wall portions 42*b* of the second trough section 42 may extend parallel to each other (see, FIG. 11B to 11D).

The bottom wall portion 42*a* and the side wall portions 42*b* form a recess in which the liquid refrigerant is accumulated so that the heat transfer tubes 31 are at least partially immersed in the liquid refrigerant accumulated in the second trough section 42 when the evaporator 1 is operated under normal conditions. More specifically, the side wall portions 42*b* of the second trough part 42 partially overlap with the heat transfer tubes 31 disposed directly above the second trough part 42 when viewed along a horizontal direction perpendicular to the longitudinal center axis C of the shell 10. FIG. 10 shows the trough section 42 and the heat transfer tubes 31 when viewed along the horizontal direction perpendicular to the longitudinal center axis C of the shell 10. An overlapping distance D1 between the side wall portions 42*b* and the heat transfer tubes 31 disposed immediately above the second trough section 42 as viewed along the horizontal direction perpendicular to the longitudinal center axis C of the shell 10 is set such that the heat transfer tubes 31 are at least partially immersed in the liquid refrigerant accumulated in the second trough section 42. The overlapping distance D1 is also set so that the liquid refrigerant reliably overflows from the second trough section 42 when the evaporator 1 runs under normal conditions. Preferably, the overlapping distance D1 is set to be equal to or greater than one-half of a height (outer diameter) D2 of the heat transfer tube 31 ($D1/D2 \geq 0.5$). More preferably, the overlapping distance D1 is set to be equal to or greater than three-quarters of the height (outer diameter) of the heat transfer tube 31 ($D1/D2 \geq 0.75$). In other words, the second trough section 42 is arranged such that, when the second trough section 42 is filled with the liquid refrigerant to the brim, at least one-half (or, more preferably, at least three-quarters) of the height (outer diameter) of each of the heat transfer tubes 31 are immersed in the liquid refrigerant. The overlapping distance D1 may be equal to or greater than the height D2 of the heat transfer tube 31. In such a case, the heat transfer tubes 31 are completely immersed in the liquid refrigerant accumulated in the second trough section 42. However, since the amount of refrigerant charge increases as the capacity of the second trough section 42 increases, it is preferable that the overlapping distance D1 is substantially equal to or smaller than the height D2 of the heat transfer tube 31.

A distance D3 between the bottom wall portion 42*a* and the heat transfer tubes 31 and a distance D4 between the side wall portion 42*b* and the heat transfer tube 31 are not limited to any particular distance as long as a sufficient space is formed between the heat transfer tubes 31 and the second trough section 42 to allow the liquid refrigerant flow between the heat transfer tubes 31 and the second trough section 42. For example, each of the distance D3 and the distance D4 may be set to about 1 mm to about 4 mm. Moreover, the distance D3 and the distance D4 may be the same or different.

The first trough section 41 includes the similar structure as the second trough section 42 as described above except that the height of the first trough section 41 may be the same or different from the height of the second trough section. Since the first trough section 41 is disposed below the lowermost row of the heat transfer tubes 31, it is not necessary to overflow the liquid refrigerant from the first trough section 41. Therefore, an overall height of the first trough section 41 may be set to be higher than that of the second trough section 42. In any event, it is preferable that the overlapping distance D1 between the first trough section 41 and the heat transfer tubes 31 is set to be equal to or greater than one-half (or, more preferably, three-quarters) of the height (outer diameter) D2 of the heat transfer tube 31 as explained above.

Figure 11A:
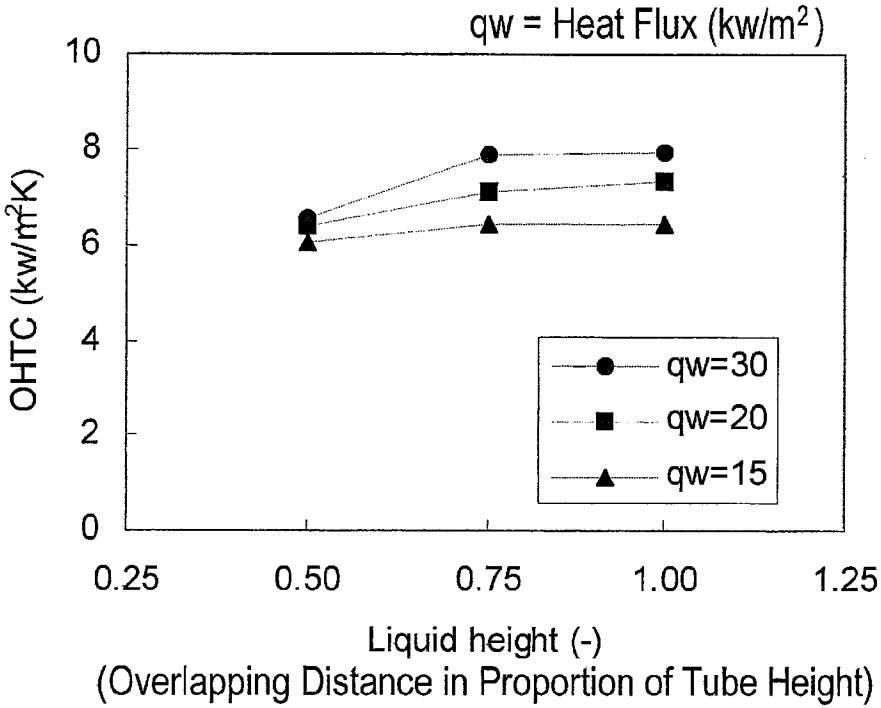
FIG. 11A is a graph of an overall heat transfer coefficient versus an overlapping distance between the trough part and the heat transfer tube according to the first embodiment of the present invention.

FIG. 11A is a graph of an overall heat transfer coefficient versus the overlapping distance D1 between a trough section and the heat transfer tube 31 according to the first embodiment. In the graph shown in FIG. 11A, the vertical axis indicates the overlapping heat transfer coefficient ($kw/m^2K$) and the horizontal axis indicates the overlapping distance D1 as expressed by a proportion of the height D2 of the heat transfer tube 31. An experiment was conducted to measure the overall heat transfer coefficient by using three samples shown in FIG. 11B to 11D. In the first sample shown in FIG. 11B, the overlapping distance D1 between a trough part 40' and the heat transfer tube 31 was equal to the height D2 of the heat transfer tube 31, and thus, the overlapping distance expressed by a proportion of the height of the heat transfer tube 31 was 1.0. In the second sample shown in FIG. 11C, the overlapping distance D1 between a trough part 40" and the heat transfer tube 31 was equal to three-quarters (0.75) of the height D2 of the heat transfer tube 31. In the third sample shown in FIG. 11D, the overlapping distance D1 between a trough part 40''' and the heat transfer tube 31 was equal to one-half (0.5) of the height D2 of the heat transfer tube 31. In the first to third samples shown in FIGS. 11B to 11D, a distance D3 between the bottom wall of the trough section and the heat transfer tube 31 and a distance D4 between the side wall of the trough section and the heat transfer tube 31 were about 1 mm. The first to third samples were filled with the liquid refrigerant (R-134a) to the brim, and the overall heat transfer coefficient was measured under different heat flux levels (30 kw/m$^2$, 20 kw/m$^2$, and 15 kw/m$^2$).

As shown in the graph of FIG. 11A, the overall heat transfer coefficient in the second sample with the overlapping distance of 0.75 (FIG. 11C) was substantially the same as the overall heat transfer coefficient of the first sample with the overlapping distance of 1.0 (FIG. 11B) under all heat flux levels. Moreover, the overall heat transfer coefficient in the third sample with the overlapping distance of 0.5 (FIG. 11D) was about 80% of the overall heat transfer coefficient as the first sample (FIG. 11B) under the higher heat flux level (30 kw/m$^2$), and the overall heat transfer coefficient in the third sample (FIG. 11D) was about 90% of the overall heat transfer coefficient of the first sample (FIG. 11B) under the lower heat flux level (20 kw/m$^2$). In other words, there was no drastic decrease in performance even when the overlapping distance D1 was one-half (0.5) of the height of the heat transfer tube 31. Accordingly, the overlapping distance D1 is preferably set to be equal to or greater than one-half (0.5), and more preferably equal to or greater than three-quarters (0.75), of the height of the heat transfer tube 31.

With the evaporator 1 according to the first embodiment, the liquid refrigerant is accumulated in the trough part 40 in the accumulating region A so that the heat transfer tubes 31 disposed in a lower region of the tube bundle 30 are at least partially immersed in the liquid refrigerant accumulated in the trough part. Therefore, even when the liquid refrigerant is not evenly distributed from above, formation of dry patches in the lower region of the tube bundle 30 can be readily prevented. Moreover, with the evaporator 1 according to the first embodiment, since the trough part 40 is disposed adjacent to the heat transfer tubes 31 and spaced apart from the interior surface of the shell 10, the amount of refrigerant charge can be greatly reduced as compared to a conventional hybrid evaporator including a flooded section, which forms a pool of refrigerant at a bottom portion of an evaporator shell, while ensuring good heat transfer performance.

The arrangements for the tube bundle 30 and the trough part 40 are not limited to the ones illustrated in FIG. 7. It will be apparent to those skilled in the art from this disclosure that various changes and modifications can be made herein without departing from the scope of the invention. Several modified examples will be explained with reference to FIGS. 12 to 18.

Figure 12:
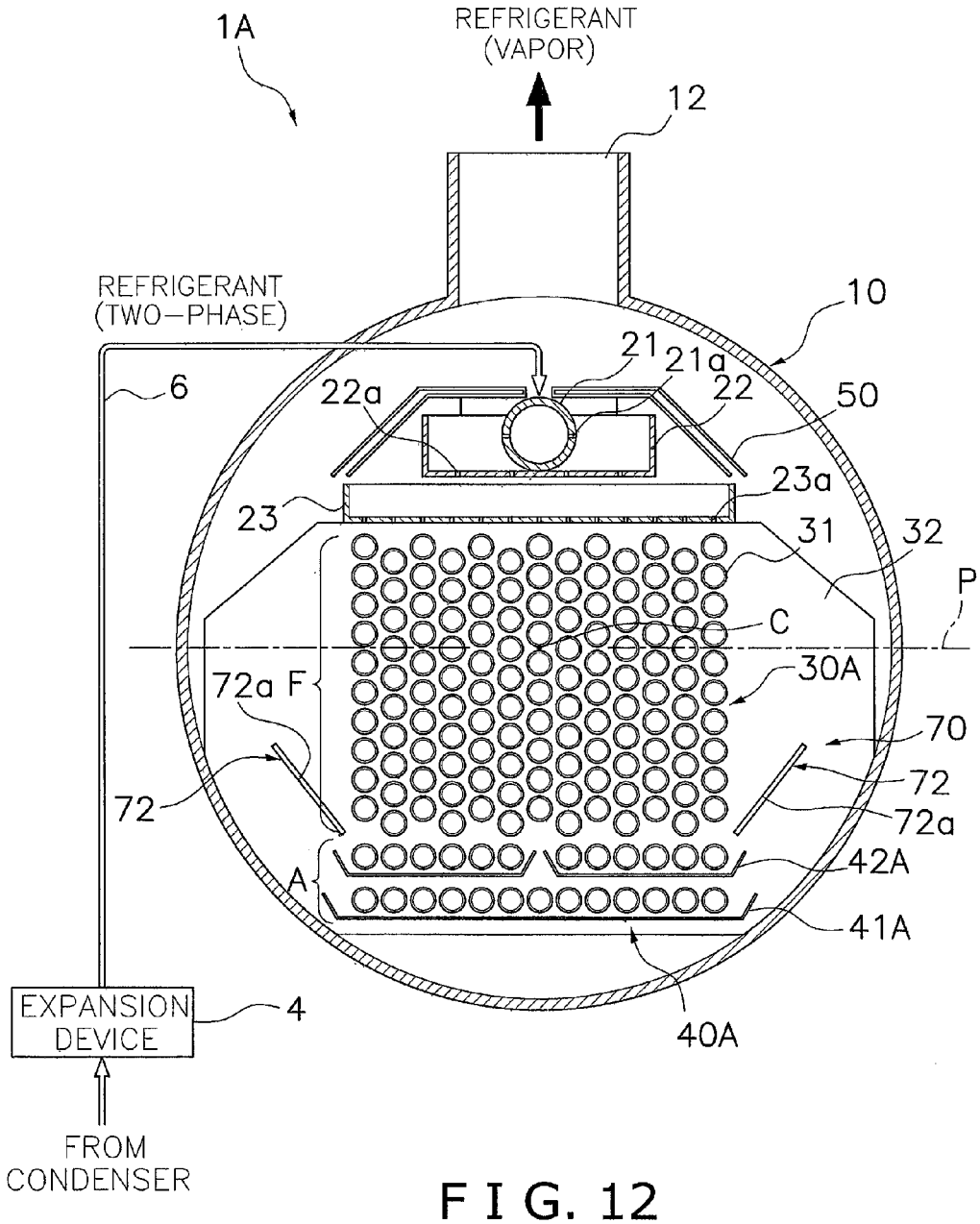
FIG. 12 is a simplified transverse cross sectional view of the heat exchanger illustrating a first modified example for an arrangement of a tube bundle and a trough part according to the first embodiment of the present invention.

FIG. 12 is a simplified transverse cross sectional view of an evaporator 1A illustrating a first modified example for an arrangement of a tube bundle 30A and a trough part 40A according to the first embodiment. The evaporator 1A is basically the same as the evaporator 1 illustrated in FIGS. 2 to 7 except that the outermost one of the heat transfer tubes 31 in the accumulating region A in each row is vertically aligned with the outermost column of the heat transfer tubes 31 in the falling film region F on each side of the tube bundle 30A as shown in FIG. 12. In such a case too, since outermost ends of second trough sections 42A extend outwardly, the liquid refrigerant can be readily received by the second trough sections 42A even when the flow of liquid refrigerant flares outwardly as it progresses toward the lower region of the tube bundle 30A.

Figure 13:
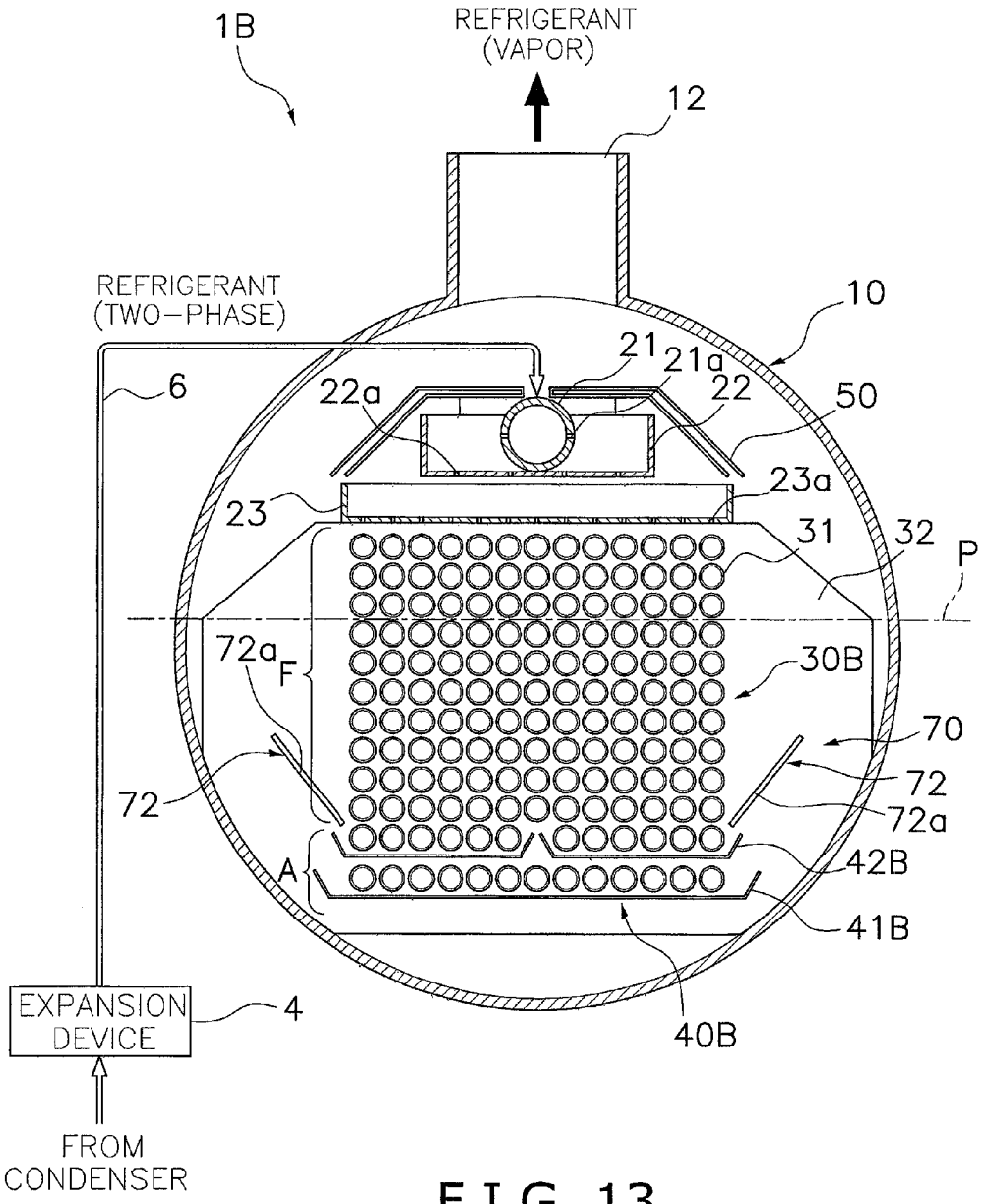
FIG. 13 is a simplified transverse cross sectional view of the heat exchanger illustrating a second modified example for an arrangement of a tube bundle and a trough part according to the first embodiment of the present invention.

FIG. 13 is a simplified transverse cross sectional view of an evaporator 1B illustrating a second modified example for an arrangement of a tube bundle 30B and a trough part 40B according to the first embodiment. The evaporator 1B is basically the same as the evaporator 1A shown in FIG. 12 except that the heat transfer tubes 31 of the tube bundle 30B in the falling film region F are arranged not in a staggered pattern, but in a matrix as shown in FIG. 13.

Figure 14:
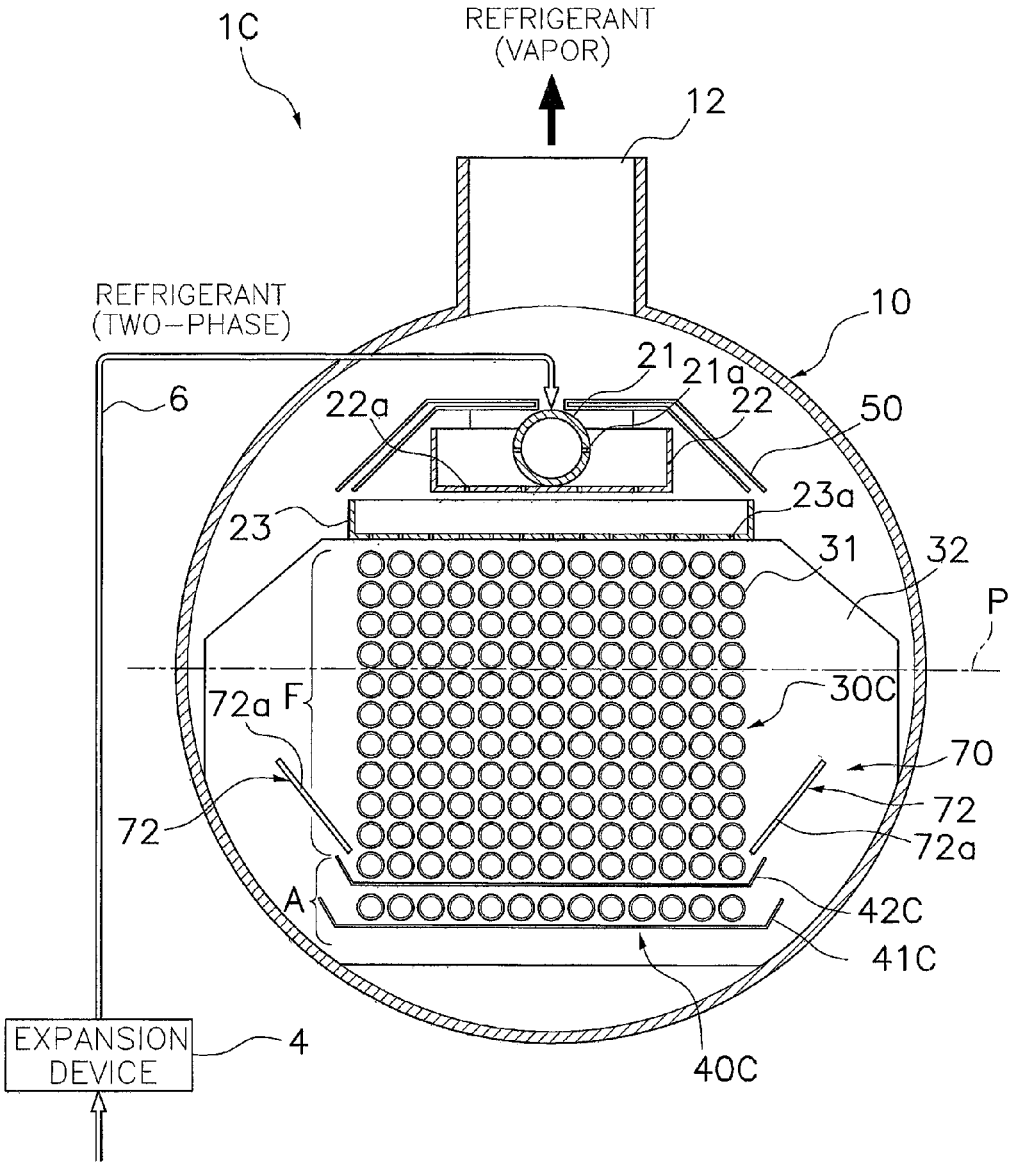
FIG. 14 is a simplified transverse cross sectional view of the heat exchanger illustrating a third modified example for an arrangement of a tube bundle and a trough part according to the first embodiment of the present invention.

FIG. 14 is a simplified transverse cross sectional view of an evaporator 1C illustrating a third modified example for an arrangement of a tube bundle 30C and a trough part 40C according to the first embodiment. The evaporator 1C is basically the same as the evaporator 1B shown in FIG. 13 except that the trough part 40C includes a single second trough section 42C that extends continuously in the transverse direction. In such a case too, the liquid refrigerant accumulated in the second trough section 42C overflows from both transverse sides of the second trough section 42C towards a first trough section 41C.

Figure 15:
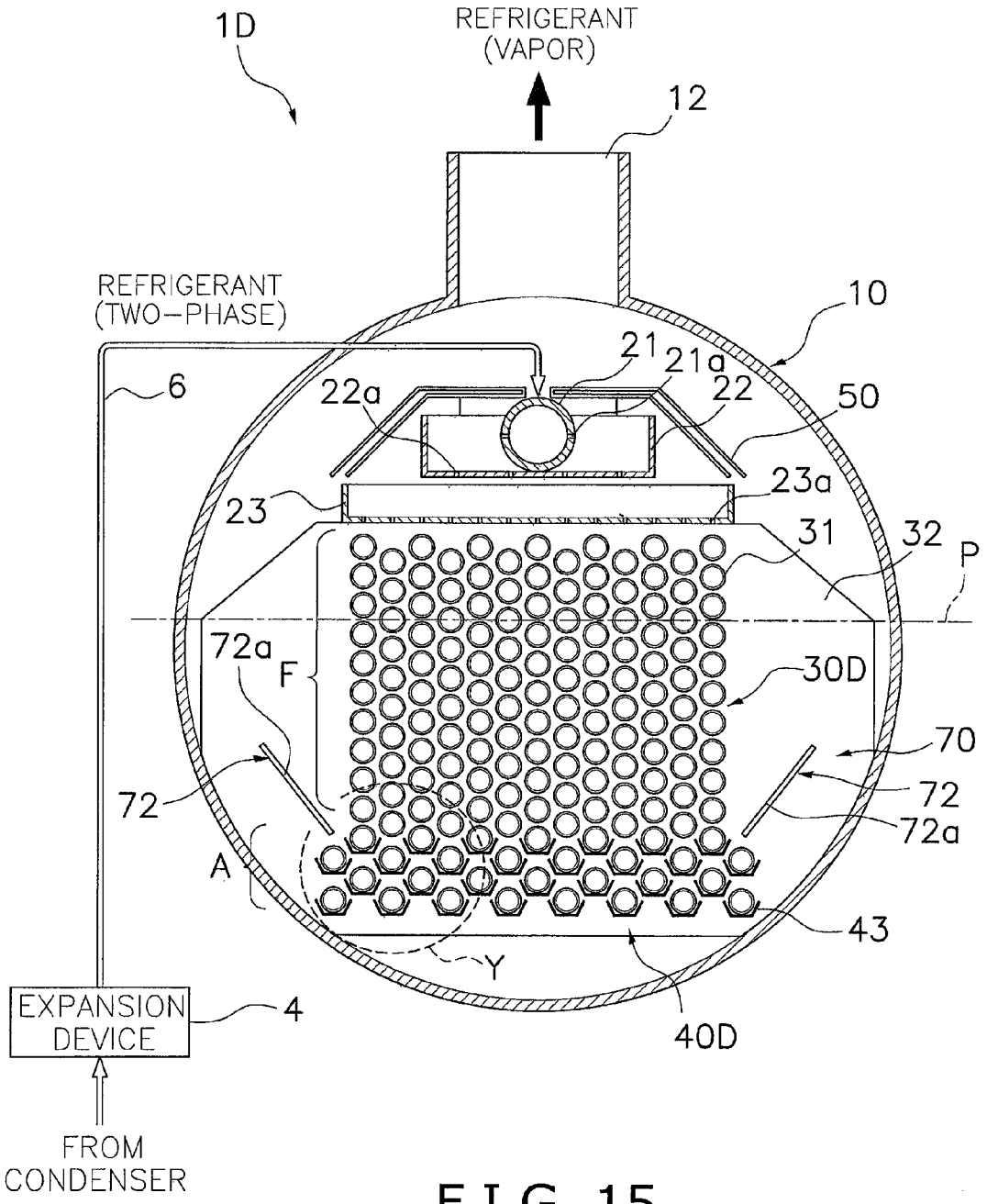
FIG. 15 is a simplified transverse cross sectional view of the heat exchanger illustrating a fourth modified example for an arrangement of a tube bundle and a trough part according to the first embodiment of the present invention.
Figure 16:
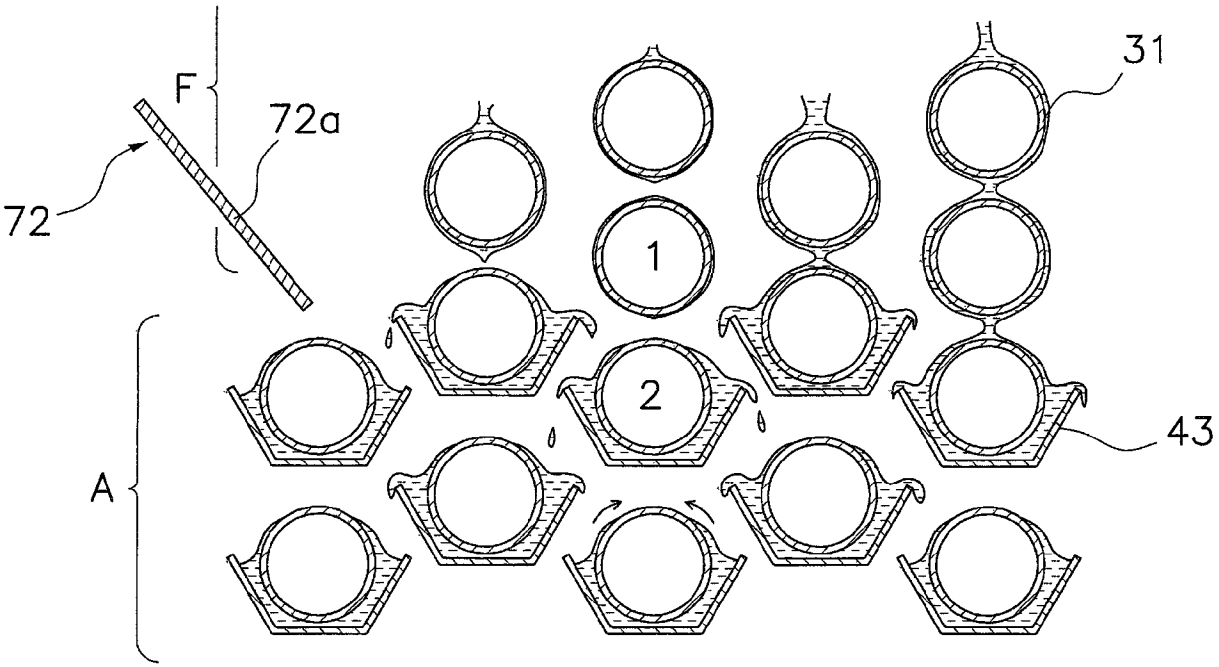
FIG. 16 is an enlarged schematic cross sectional view of the heat transfer tubes and trough sections disposed in region Y in FIG. 15 illustrating a state in which the heat exchanger is in use according to the first embodiment of the present invention.

FIG. 15 is a simplified transverse cross sectional view of an evaporator 1D illustrating a fourth modified example for an arrangement of a tube bundle 30D and a trough part 40D according to the first embodiment. In the example shown in FIG. 15, the trough part 40D includes a plurality of individual trough sections 43 that are disposed respectively below the heat transfer tubes 31 in the accumulating region A. FIG. 16 is an enlarged schematic cross sectional view of the heat transfer tubes 31 and the trough sections 43 disposed in region Y in FIG. 15 illustrating a state in which the evaporator 1D is in use. The liquid refrigerant accumulated in the trough sections 43 in the uppermost row in the accumulating region A overflows towards the trough sections 43 disposed downwardly as shown in FIG. 16. Therefore, all of the heat transfer tubes 31 in the accumulating region A are at least partially immersed in the liquid refrigerant accumulated in the trough sections 43. Accordingly, the liquid refrigerant evaporates as the vapor refrigerant as heat transfer takes place between the liquid refrigerant and the water flowing inside the heat transfer tubes 31.

The shape of the trough section 43 is not limited to the configuration illustrated in FIGS. 15 and 16. For example, a cross section of the trough section 43 may have C-shape, V-shape, U-shape or the like. Similarly to the example discussed above, the overlapping distance between the trough section 43 and the heat transfer tube 31 disposed directly above the trough section 43 is preferably set to be equal to or greater than one-half (0.5), and more preferably equal to or greater than three-quarters (0.75), of the height of the heat transfer tube 31 as viewed along the horizontal direction perpendicular to the longitudinal center axis C.

Figure 17:
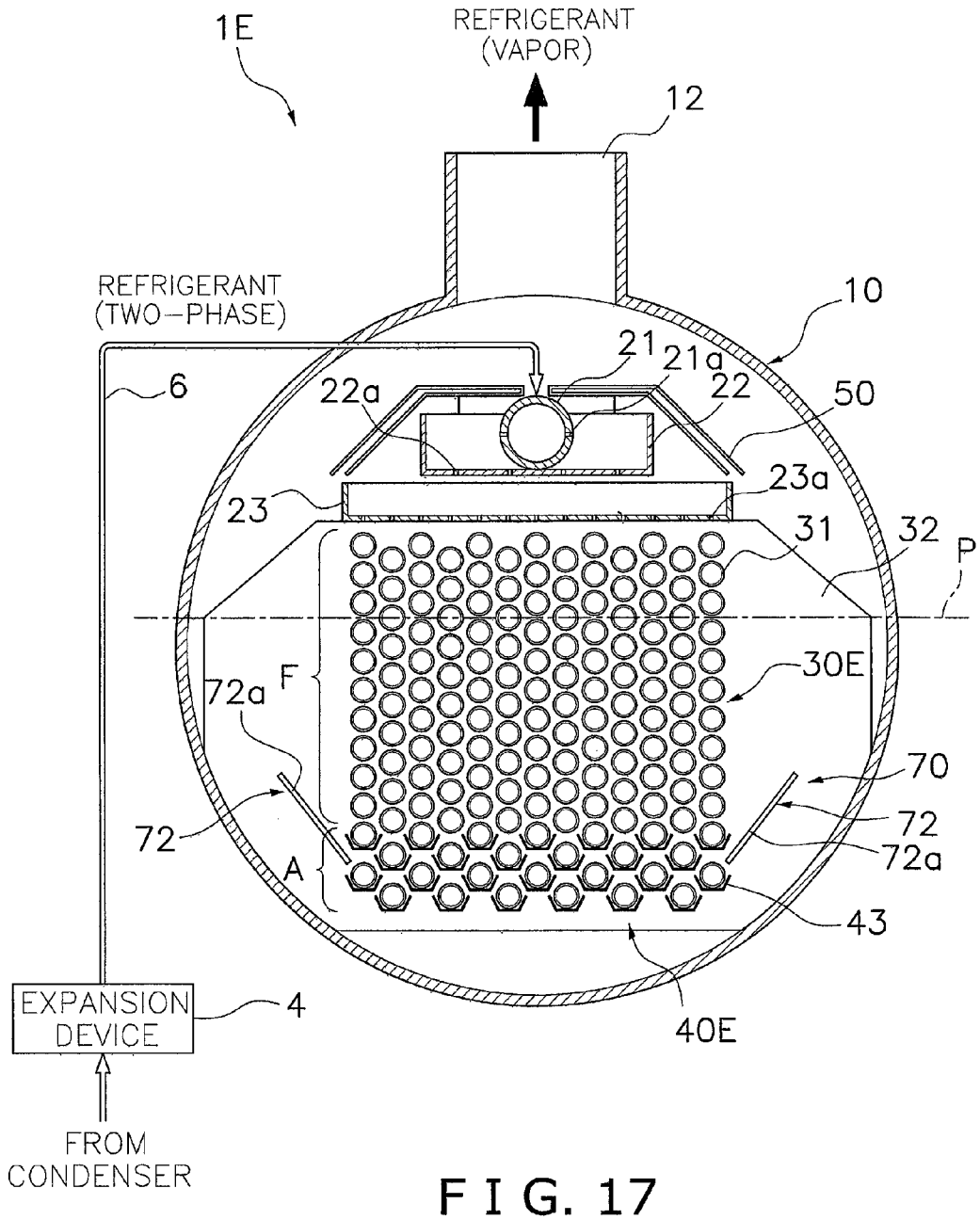
FIG. 17 is a simplified transverse cross sectional view of the heat exchanger illustrating a fifth modified example for an arrangement of a tube bundle and a trough part according to the first embodiment of the present invention.

FIG. 17 is a simplified transverse cross sectional view of an evaporator 1E illustrating a fifth modified example for an arrangement of a tube bundle 30E and a trough part 40E according to the first embodiment. The evaporator 1E is basically the same as the evaporator 1D illustrated in FIG. 16 except that the outermost one of the heat transfer tubes 31 in the accumulating region A in each row is vertically aligned with the outermost column of the heat transfer tubes 31 in the falling film region F on each side of the tube bundle 30E as shown in FIG. 17.

Figure 18:
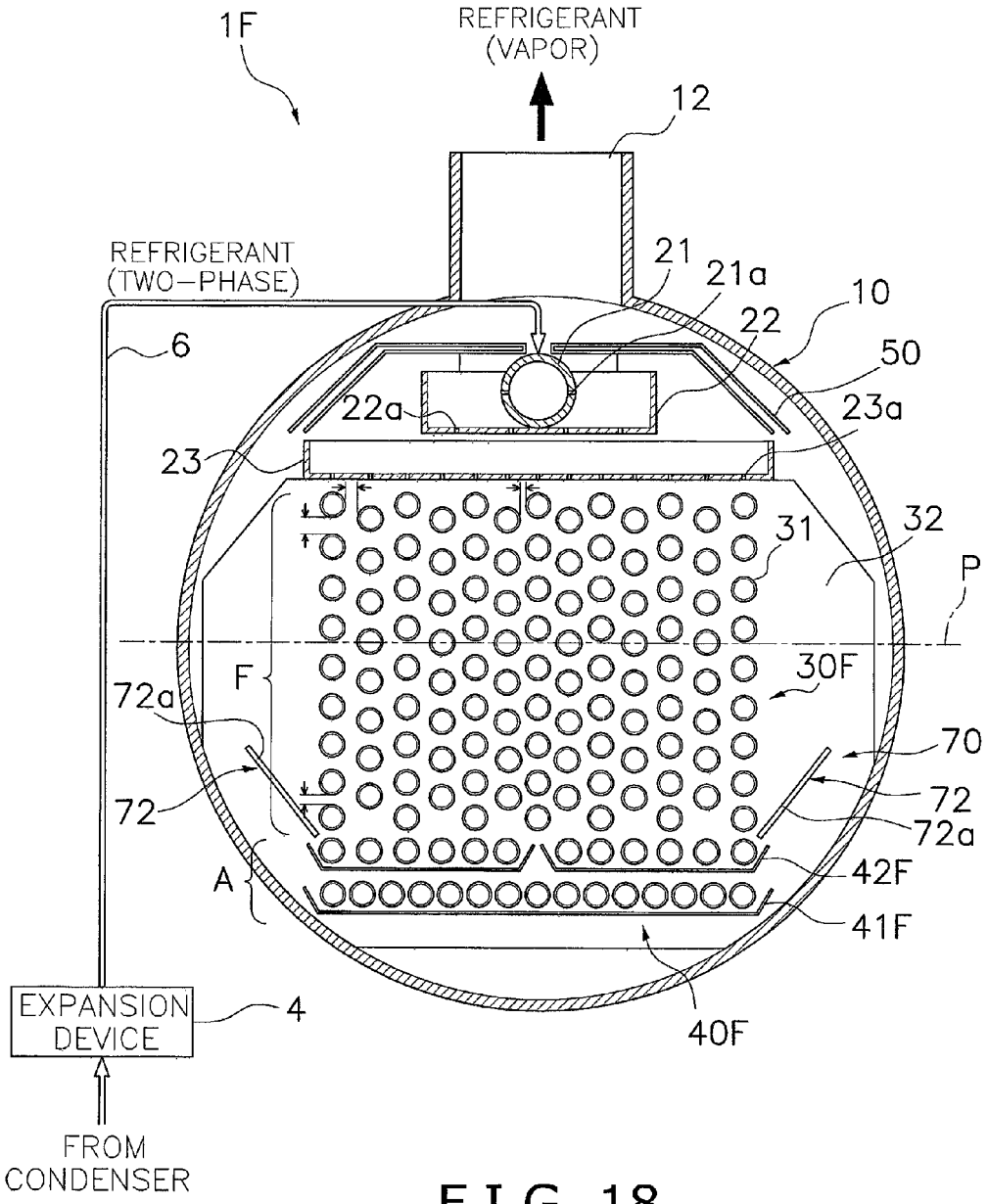
FIG. 18 is a simplified transverse cross sectional view of the heat exchanger illustrating a sixth modified example for an arrangement of a tube bundle and a trough part according to the first embodiment of the present invention.

FIG. 18 is a simplified transverse cross sectional view of an evaporator 1F illustrating a sixth modified example for an arrangement of a tube bundle 30F and a trough part 40F according to the first embodiment. The evaporator 1A is basically the same as the evaporator 1 illustrated in FIGS. 2 to 7 except for an arrangement pattern of the heat transfer tubes 31 in the falling film region F. More specifically, in the example shown in FIG. 18, the heat transfer tubes 31 in the falling film region F are arranged so that a vertical pitch between two adjacent ones of the heat transfer tubes 31 in each column is larger in an upper region of the falling film region F than in a lower region of the falling film region F. Moreover, the heat transfer tubes 31 in the falling film region F are arranged so that a horizontal pitch between two adjacent columns of the heat transfer tubes is larger in a transverse center region of the falling film region F than in an outer region of the falling film region F.

An amount of vapor flow in the shell 10 tends to be larger in the upper region of the falling film region F than in the lower region of the falling film region F. Likewise, the amount of vapor flow in the shell 10 tends to be larger in the transverse center region of the falling film region F than in the outer region of the falling film region F. Therefore, the vapor velocity in the upper region and the outer region of the falling film region F often become very high. As a result, the transverse vapor flow causes disruption of the vertical flow of the liquid refrigerant between the heat transfer tubes 31. Moreover, the liquid refrigerant may be carried over by the high velocity vapor flow to the compressor 2, and the entrained liquid refrigerant may damage the compressor 2. Accordingly, in the example shown in FIG. 18, the vertical pitch and the horizontal pitch of the heat transfer tubes 31 are adjusted to enlarge cross sectional areas of vapor passages formed between the heat transfer tubes 31 in the upper region and the outer region of the falling film region F. Accordingly, the velocity of the vapor flow in the upper region and the outer region of the falling film region F can be decreased. Therefore, disruption of vertical flow of the liquid refrigerant and occurrence of entrained liquid refrigerant by the vapor flow can be prevented.

Second Embodiment

Figure 19:
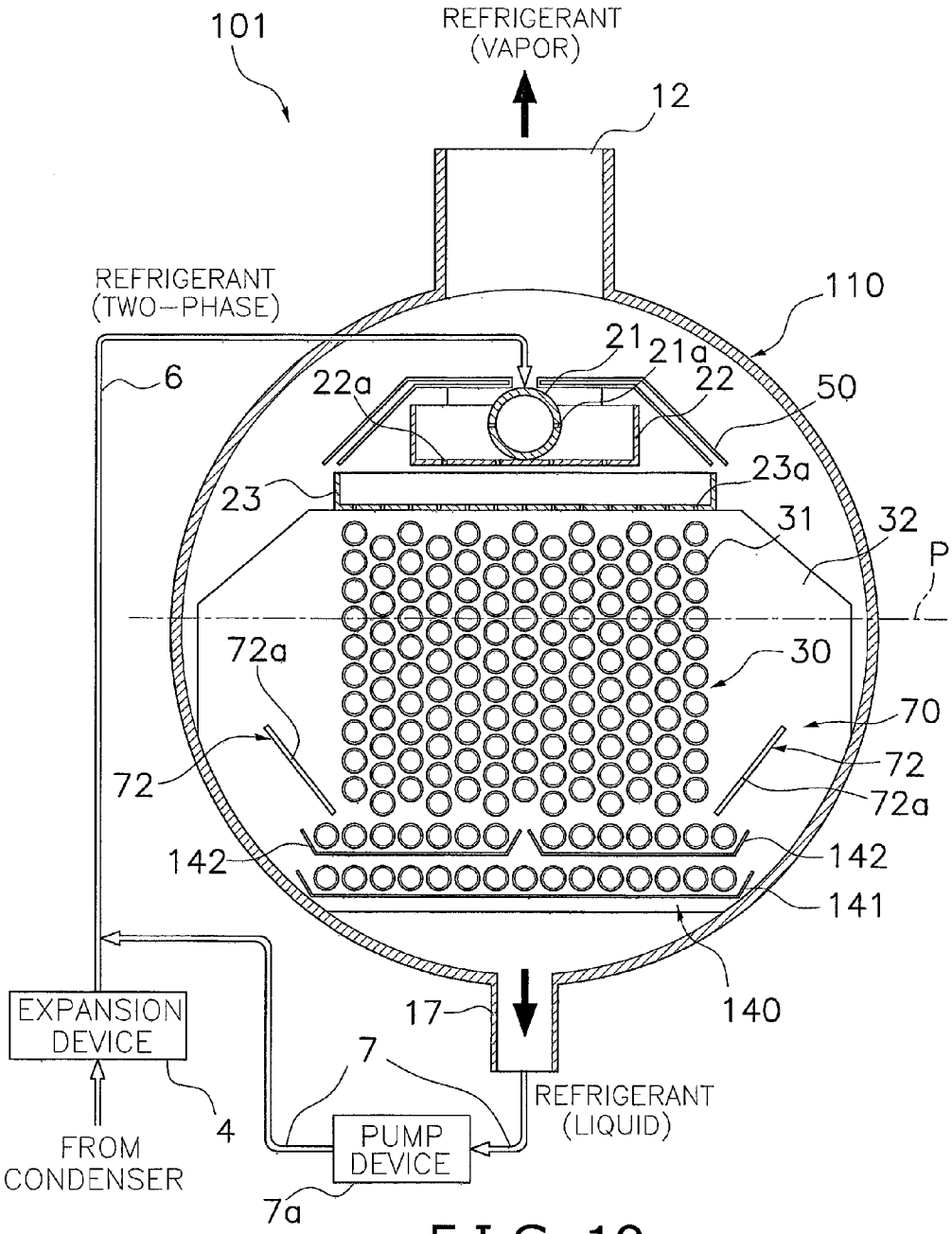
FIG. 19 is a simplified transverse cross sectional view of a heat exchanger according to a second embodiment of the present invention.

Referring now to FIG. 19, an evaporator 101 in accordance with a second embodiment will now be explained. In view of the similarity between the first and second embodiments, the parts of the second embodiment that are identical to the parts of the first embodiment will be given the same reference numerals as the parts of the first embodiment. Moreover, the descriptions of the parts of the second embodiment that are identical to the parts of the first embodiment may be omitted for the sake of brevity.

The evaporator 101 according to the second embodiment is basically the same as the evaporator 1 of the first embodiment except that the evaporator 101 of the second embodiment is provided with a refrigerant recirculation system. A trough part 140 of the second embodiment is basically the same as the trough part 40 of the first embodiment. In the first embodiment as described above, if the liquid refrigerant is distributed from the distributing part 20 over the tube bundle 30 relatively uniformly (e.g., ±10%), the refrigerant charge can be set to a prescribed amount with which almost all the liquid refrigerant evaporates in the falling film region F or the accumulating region A. In such a case, there is little liquid refrigerant that overflows from the first trough section 41 towards the bottom portion of the shell 10. However, when distribution of the liquid refrigerant from the distributing part 20 over the tube bundle 30 is significantly uneven (e.g., ±20%), there is a greater chance of dry patches being formed in the tube bundle 30. Therefore, in such a case, more than the prescribed amount of refrigerant needs to be supplied to the system in order to prevent formation of the dry patches. Thus, in the second embodiment, the refrigerant recirculation system is provided to the evaporator 101 for recirculating the liquid refrigerant, which has overflowed from the trough part 140 and accumulated in a bottom portion of a shell 110. The shell 110 includes a bottom outlet pipe 17 in fluid communication with a conduit 7 that is coupled to a pump device 7*a* as shown in FIG. 19. The pump device 7*a* is selectively operated so that the liquid refrigerant accumulated in the bottom portion of the shell 110 recirculates back to the distribution part 20 of the evaporator 110 via the conduit 6 and the inlet pipe 11 (FIG. 1). The bottom outlet pipe 17 may be placed at any longitudinal position of the shell 110.

Alternatively, the pump device 7*a* may be replaced by an ejector device which operates on Bernoulli's principal to draw the liquid refrigerant accumulated in the bottom portion of the shell 110 using the pressurized refrigerant from the condenser 3. Such an ejector device combines the functions of an expansion device and a pump.

Accordingly, with the evaporator 110 according to the second embodiment, the liquid refrigerant that did not evaporate can be efficiently recirculated and reused for heat transfer, thereby reducing the amount of refrigerant charge.

In the second embodiment, the arrangements for a tube bundle 130 and the trough part 140 are not limited to the ones illustrated in FIG. 19. It will be apparent to those skilled in the art from this disclosure that various changes and modifications can be made herein without departing from the scope of the invention. For example, the arrangements of the tube bundle and the trough part shown in FIGS. 12-15, 17 and 18 can also be used in the evaporator 110 according to the second embodiment.

Third Embodiment

Referring now to FIGS. 20 to 25, an evaporator 201 in accordance with a third embodiment will now be explained. In view of the similarity between the first, second and third embodiments, the parts of the third embodiment that are identical to the parts of the first or second embodiment will be given the same reference numerals as the parts of the first or second embodiment. Moreover, the descriptions of the parts of the third embodiment that are identical to the parts of the first or second embodiment may be omitted for the sake of brevity.

The evaporator 201 of the third embodiment is similar to the evaporator 101 of the second embodiment in that the evaporator 201 is provided with the refrigerant recirculation system, which recirculates the liquid refrigerant accumulated at the bottom portion of a shell 210 via the bottom outlet pipe 17 and the conduit 7. When the compressor 2 (FIG. 1) of the vapor compression system utilizes lubrication oil, the oil tends to migrate from the compressor 2 into the refrigeration circuit of the vapor compression system. In other words, the refrigerant that enters the evaporator 201 contains the compressor oil (refrigerant oil). Therefore, when the refrigerant recirculation system is provided in the evaporator 201, the oil is recirculated within the evaporator 201 along with the liquid refrigerant, which causes high concentration of the oil in the liquid refrigerant in the evaporator 201, thereby decreasing performance of the evaporator 201. Therefore, the evaporator 201 of the third embodiment is configured and arranged to accumulate the oil using a trough part 240, and discharge the accumulated oil outside of the evaporator 201 toward the compressor 2.

More specifically, the evaporator 201 includes the trough part 240 that is disposed below a part of the lowermost row of the heat transfer tubes 31 in a tube bundle 230. The trough part 240 is fluidly connected to a valve device 8*a* via a bypass conduit 8. The valve device 8*a* is selectively operated when the oil accumulated in the trough part 240 reaches a prescribed level to discharge the oil from the trough part 240 to outside of the evaporator 201.

As mentioned above, when the refrigerant that enters the evaporator 201 contains the compressor oil, the oil is recirculated with the liquid refrigerant by the refrigerant recirculation system. In the third embodiment, the trough part 240 is arranged such that the liquid refrigerant accumulated in the trough part 240 does not overflow from the trough part 240. The accumulated liquid refrigerant in the trough part 240 boils and/or evaporates as it absorbs heat from the water flowing inside the heat transfer tubes 31 immersed in the accumulated liquid refrigerant, while the oil remains in the trough part 240. Therefore, concentration of the oil in the trough part 240 gradually increases as recirculation of the liquid refrigerant in the evaporator 201 progresses. Once an amount of the oil accumulated in the trough part 240 reaches a prescribed level, the valve device 8*a* is operated and the oil is discharged from the evaporator 201. Similarly to the first embodiment, the overlapping distance between the trough part 240 of the third embodiment and the heat transfer tube 31 disposed directly above the trough part 240 is preferably set to be equal to or greater than one-half (0.5), and more preferably equal to or greater than three-quarters (0.75), of the height of the heat transfer tube 31 as viewed along the horizontal direction perpendicular to the longitudinal center axis C.

In the third embodiment, a region of a tube bundle 230 where the trough part 240 is disposed constitutes the accumulating region A while the rest of the tube bundle 230 constitutes the falling film region F.

Accordingly, with the evaporator 201 of the third embodiment, the compressor oil that has been migrated from the compressor 2 to the refrigeration circuit can be accumulated in the trough part 240 and discharged from the evaporator 201, thereby improving heat transfer efficiency in the evaporator 201.

Figure 20:
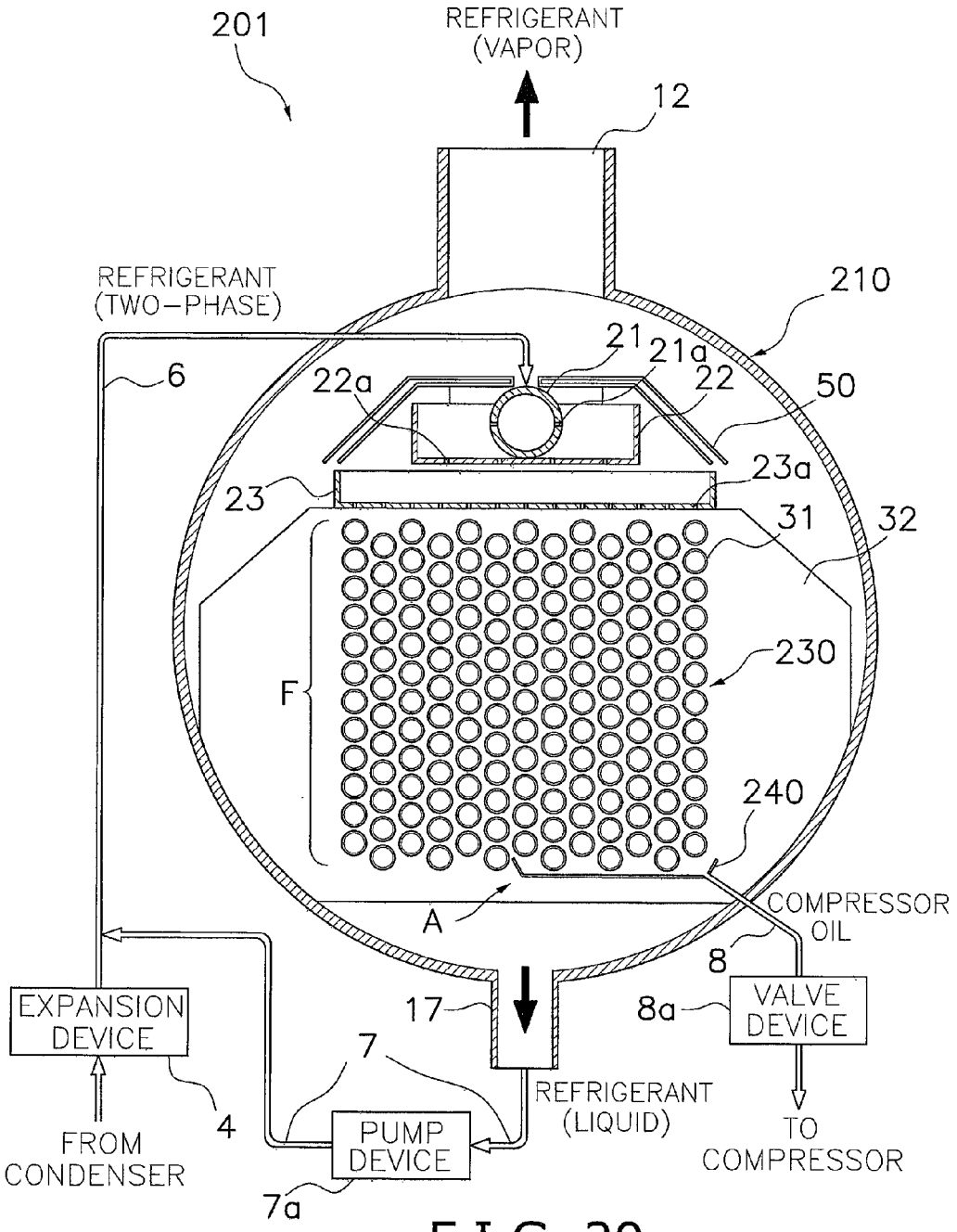
FIG. 20 is a simplified transverse cross sectional view of a heat exchanger according to a third embodiment of the present invention.

In the third embodiment, the arrangements for the tube bundle 230 and the trough part 240 are not limited to the ones illustrated in FIG. 20. It will be apparent to those skilled in the art from this disclosure that various changes and modifications can be made herein without departing from the scope of the invention. Several modified examples will be explained with reference to FIGS. 21 to 23.

Figure 21:
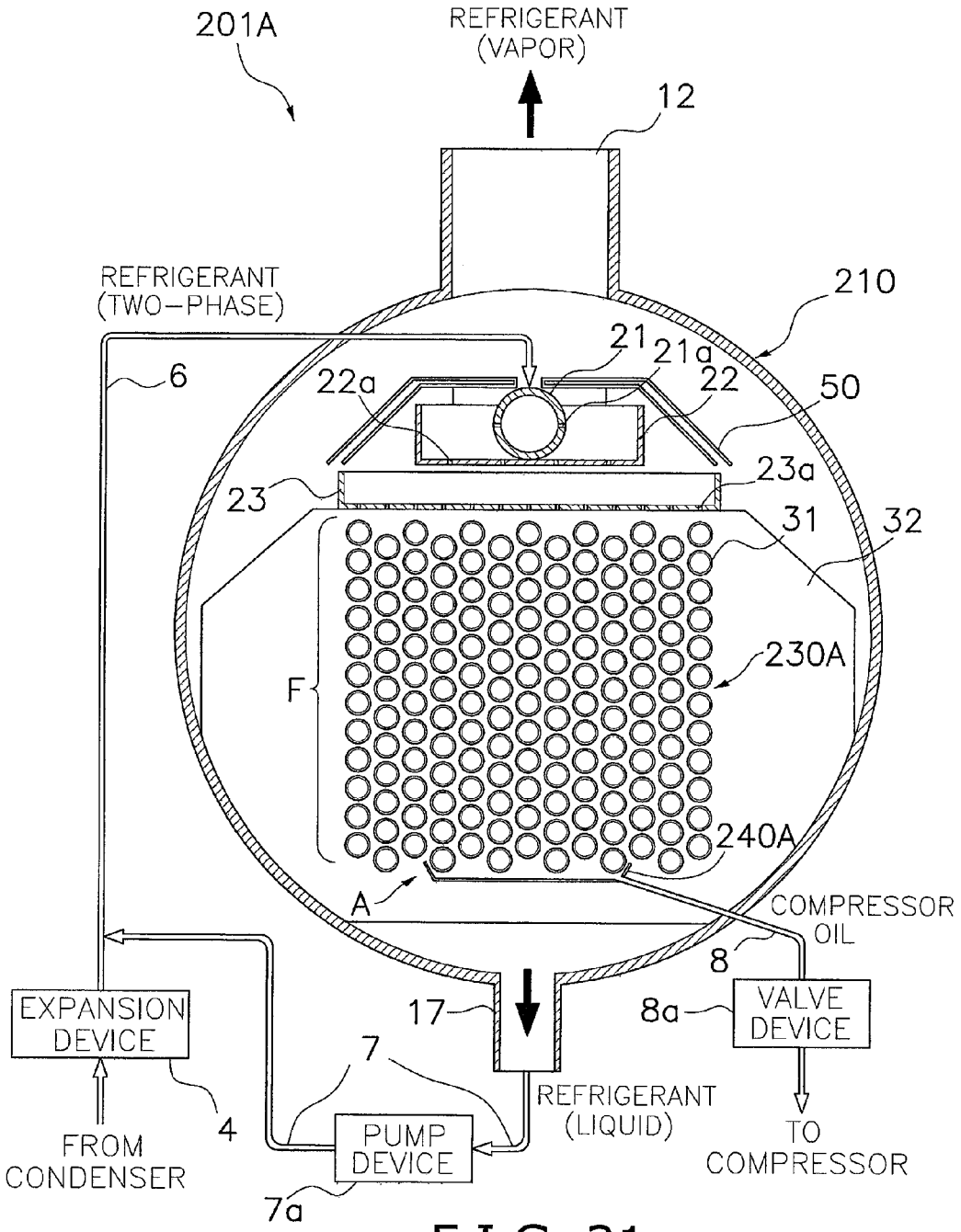
FIG. 21 is a simplified transverse cross sectional view of a heat exchanger illustrating a first modified example for an arrangement of a tube bundle and a trough part according to the third embodiment of the present invention.

FIG. 21 is a simplified transverse cross sectional view of an evaporator 201A illustrating a first modified example for an arrangement of a tube bundle 230A and a trough part 240A according to the third embodiment. As shown in FIG. 21, the trough part 240A may be placed at a center region below the lowermost row of the heat transfer tubes 31, instead of the side region as shown in FIG. 20.

Figure 22:
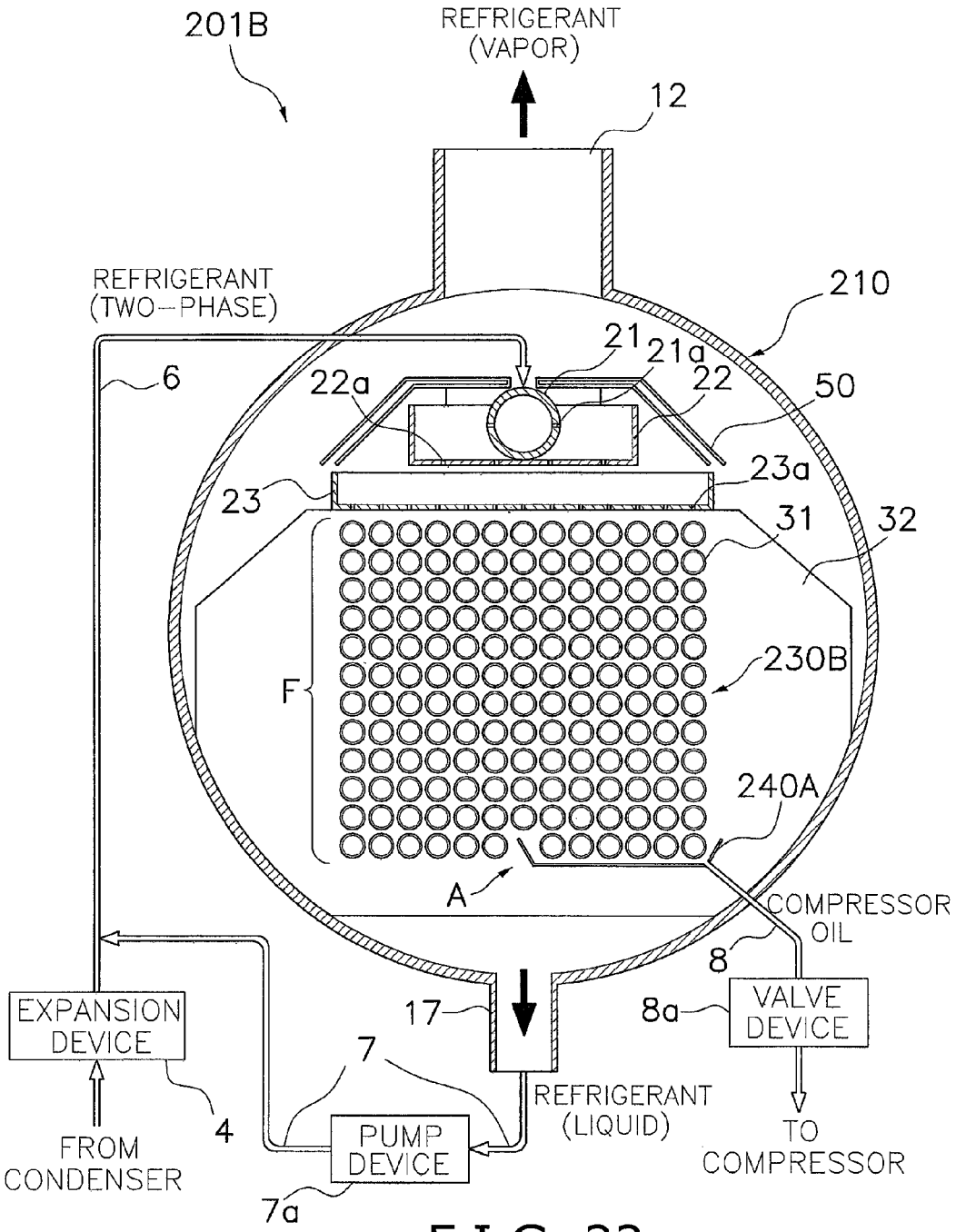
FIG. 22 is a simplified transverse cross sectional view of a heat exchanger illustrating a second modified example for an arrangement of a tube bundle and a trough part according to the third embodiment of the present invention.

FIG. 22 is a simplified transverse cross sectional view of an evaporator 201B illustrating a second modified example for an arrangement of a tube bundle 230B and a trough part 240B according to the third embodiment. The heat transfer tubes 31 of the tube bundle 230B are arranged not in a staggered pattern, but in a matrix as shown in FIG. 22.

Figure 23:
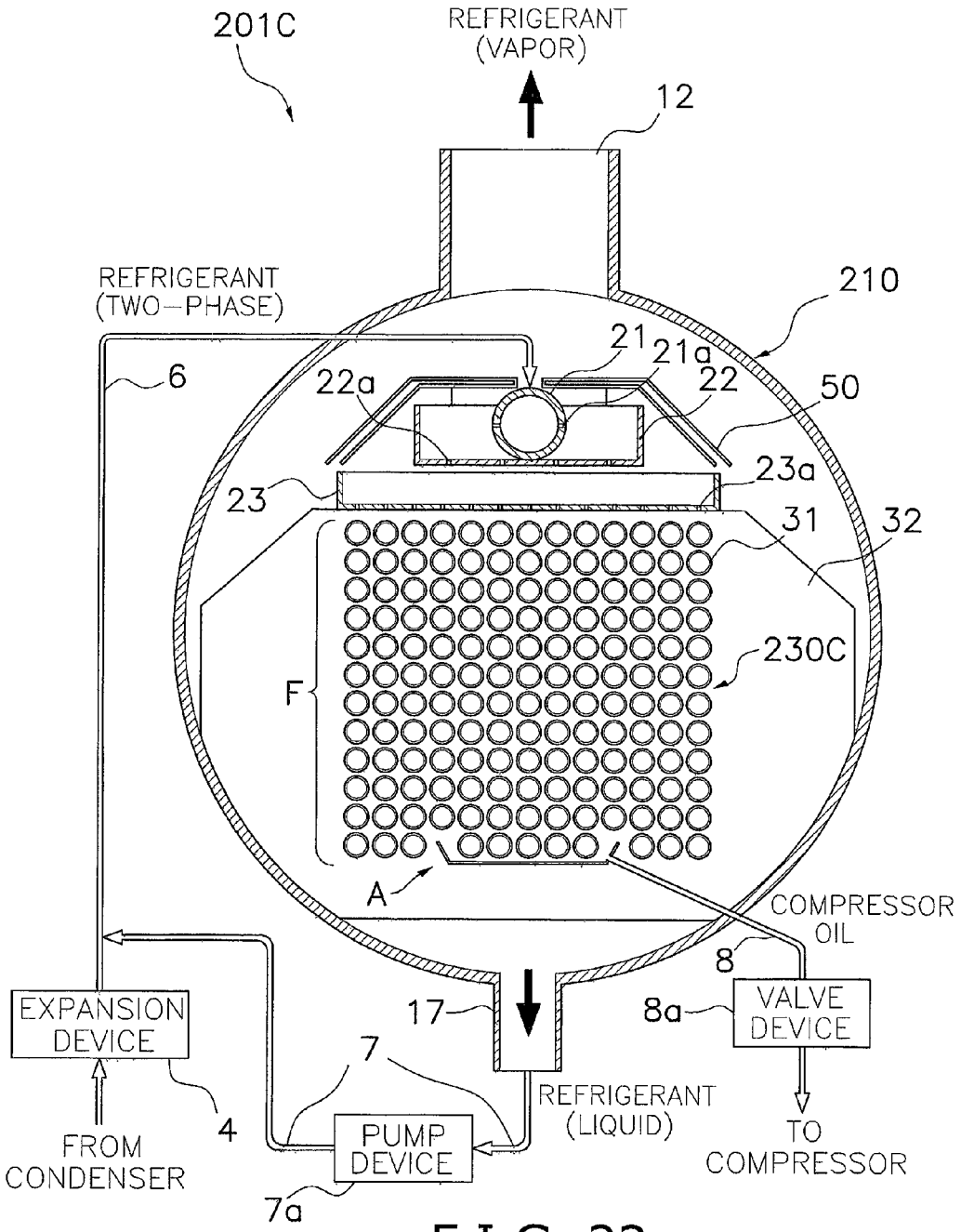
FIG. 23 is a simplified transverse cross sectional view of a heat exchanger illustrating a third modified example for an arrangement of a tube bundle and a trough part according to the third embodiment of the present invention.

FIG. 23 is a simplified transverse cross sectional view of an evaporator 201C illustrating a third modified example for an arrangement of a tube bundle 230C and a trough part 240C according to the third embodiment. In this example, the heat transfer tubes 31 of the tube bundle 230C are arranged in a matrix. The trough part 240C is disposed in the center region below the lowermost row of the heat transfer tubes 31.

Moreover, the heat transfer tubes 31 of the tube bundle 230 according to the third embodiment may be arranged in a similar manner as the heat transfer tubes 31 of the tube bundle 30F as shown in FIG. 18. In other words, the heat transfer tubes 31 of the tube bundle 230 of the third embodiment may be arranged so that a vertical pitch between the heat transfer tubes 31 is larger in an upper region of the tube bundle 230 than in a lower region of the tube bundle 230, and a horizontal pitch between the heat transfer tubes 31 is larger in an outer region of the tube bundle 230 than in a center region of the tube bundle 230.

Fourth Embodiment

Figure 24:
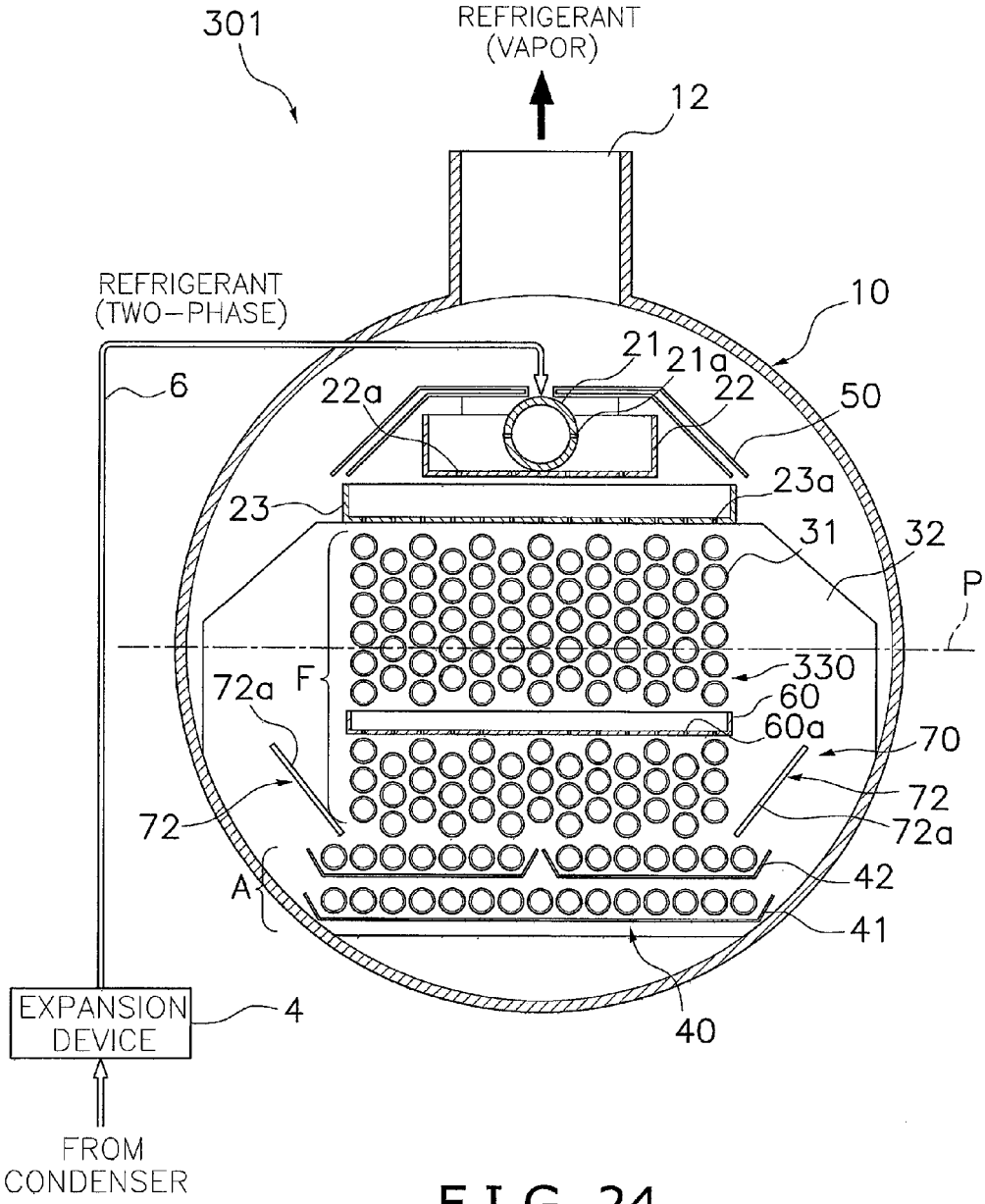
FIG. 24 is a simplified transverse cross sectional view of a heat exchanger according to a fourth embodiment of the present invention.
Figure 25:
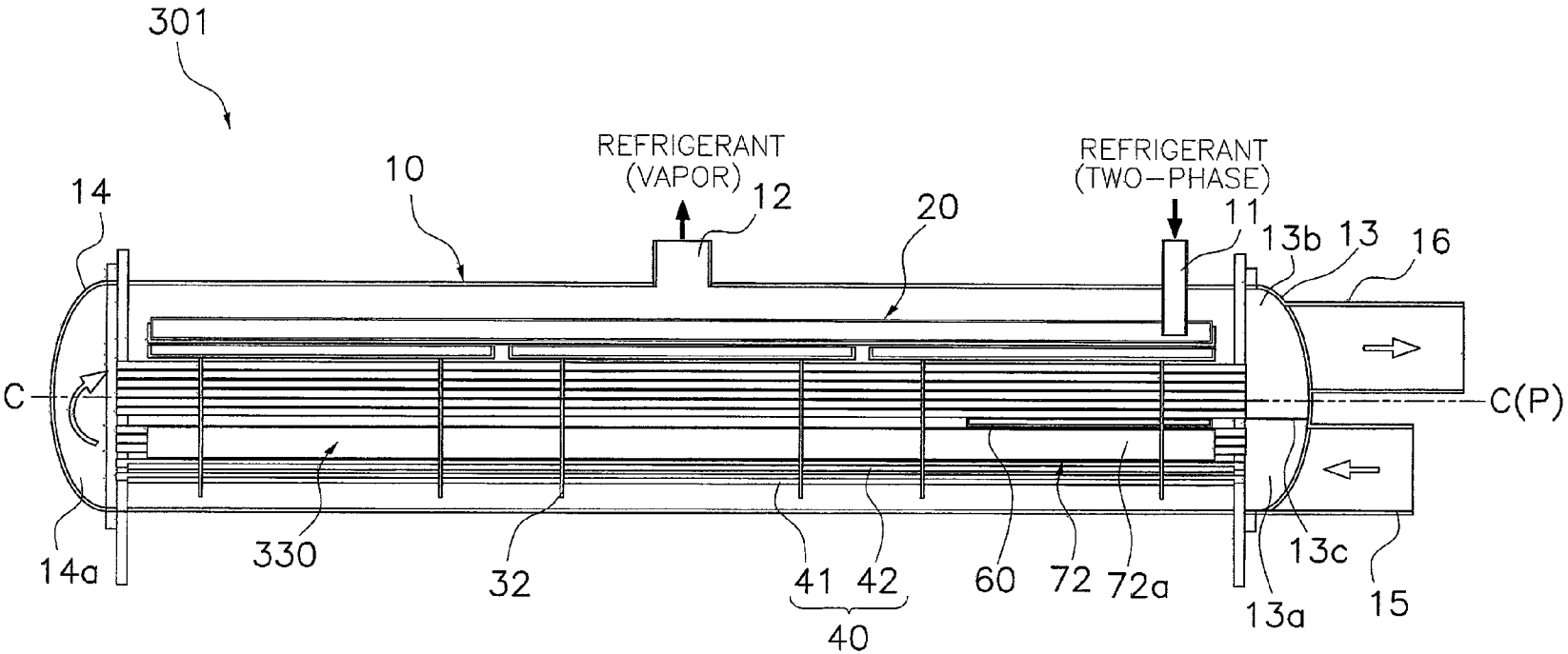
FIG. 25 is a simplified longitudinal cross sectional view of the heat exchanger according to the fourth embodiment of the present invention.
Figure 26:
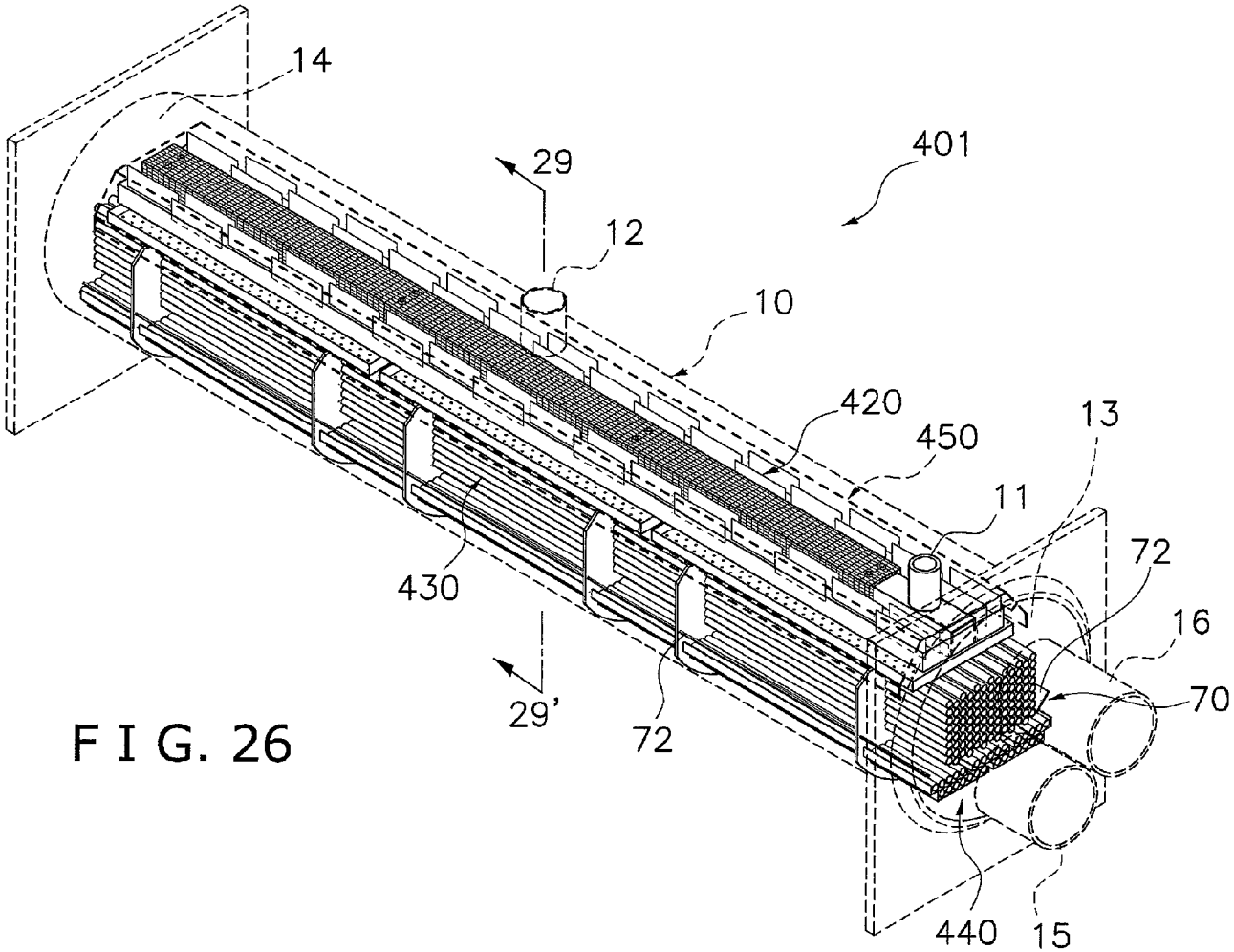
FIG. 26 is a simplified perspective view of an internal structure of the heat exchanger according to the fifth embodiment of the present invention.
Figure 27:
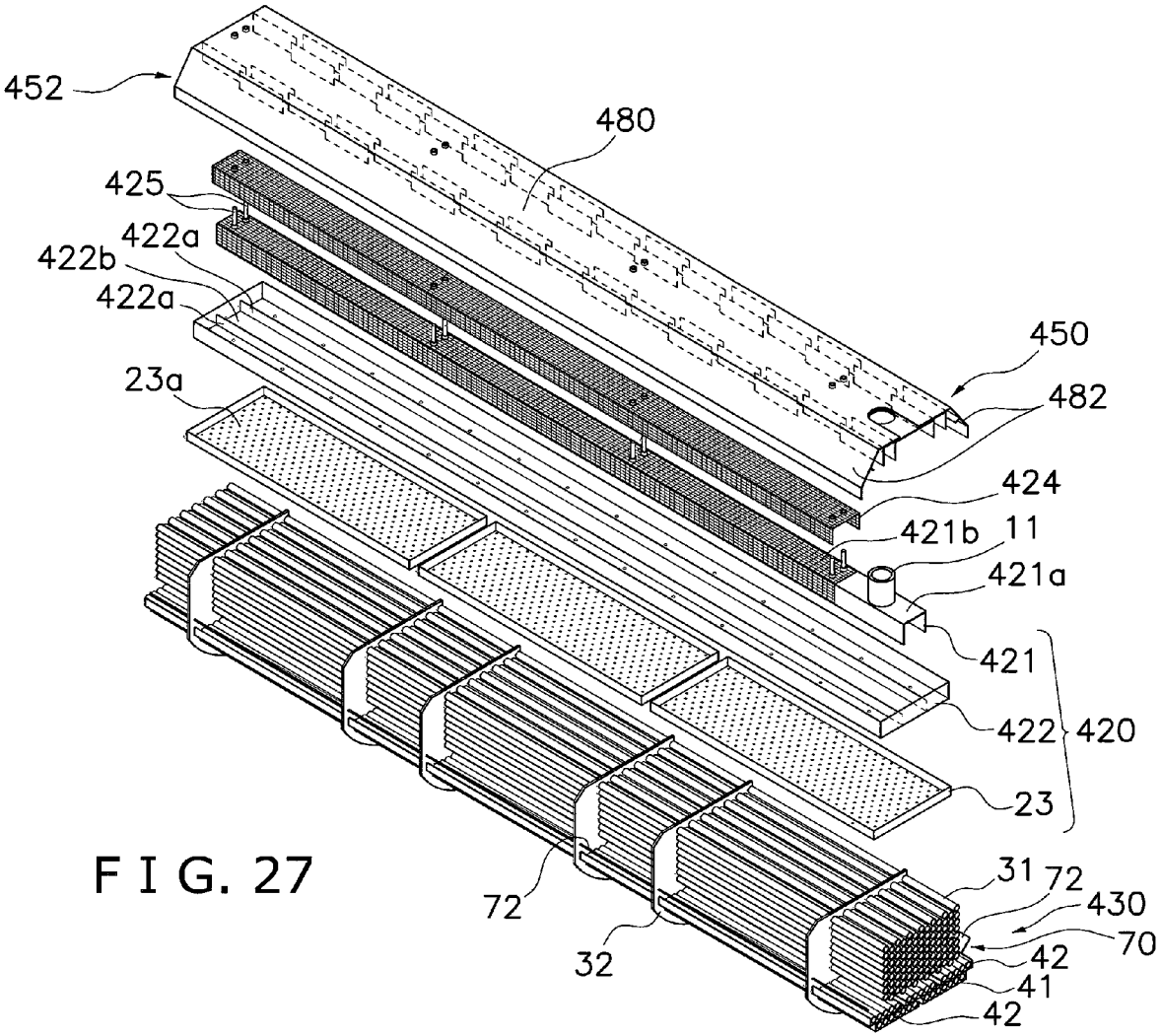
FIG. 27 is an exploded view of the internal structure of the heat exchanger according to the fifth embodiment of the present invention.
Figure 28:
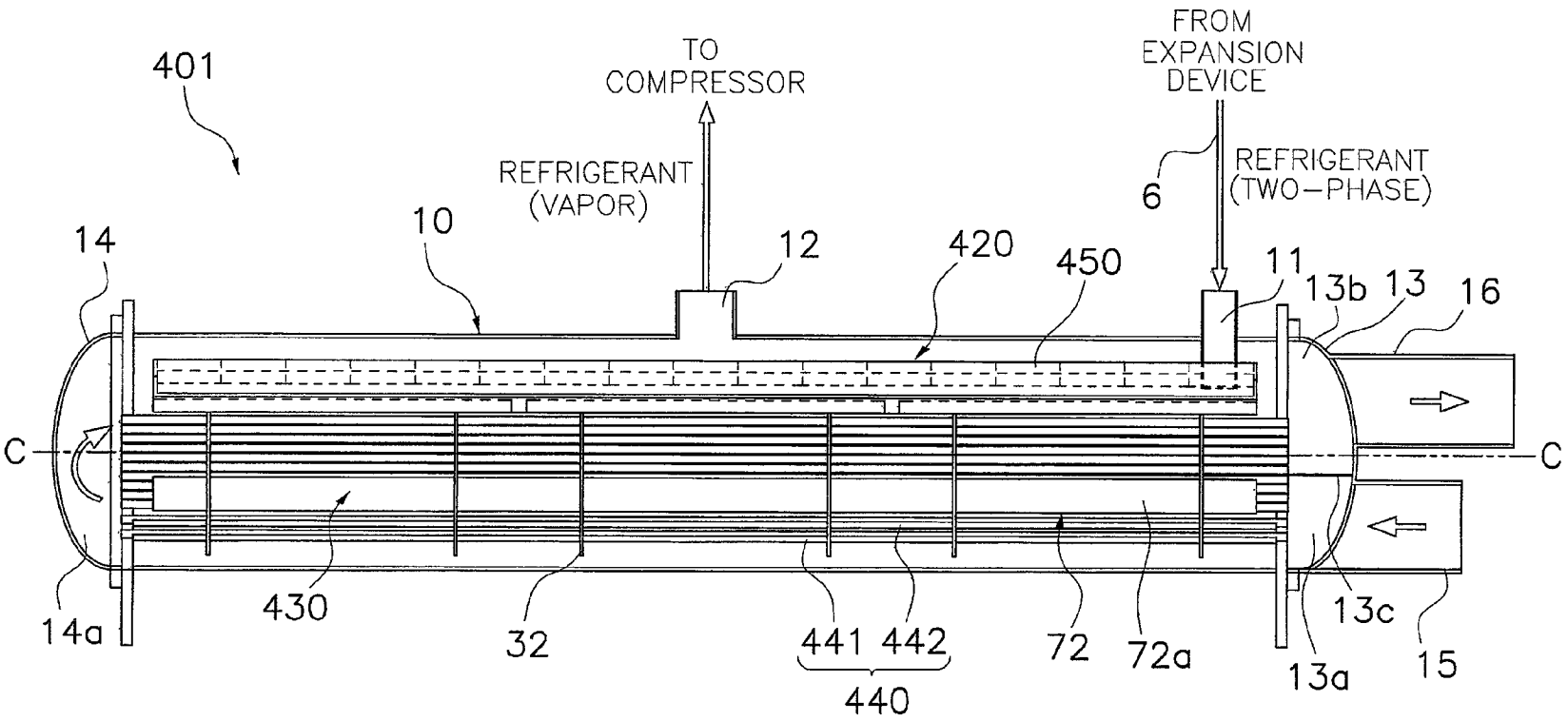
FIG. 28 is a simplified longitudinal view of the heat exchanger according to the fifth embodiment of the present invention with portions broken away for the purpose of illustration (the same section as FIG. 6, as viewed along section line 6-6' of FIG. 3)

Referring now to FIGS. 24 and 25, an evaporator 301 in accordance with a fourth embodiment will now be explained. In view of the similarity between the first through fourth embodiments, the parts of the fourth embodiment that are identical to the parts of the first, second or third embodiment will be given the same reference numerals as the parts of the first, second or third embodiment. Moreover, the descriptions of the parts of the fourth embodiment that are identical to the parts of the first, second or third embodiment may be omitted for the sake of brevity.

The evaporator 301 of the fourth embodiment is basically the same as the evaporator 1 of the first embodiment except that an intermediate tray part 60 is provided in the falling film region F between the heat transfer tubes 31 in the supply line group and the heat transfer tubes 31 in the return line group. The intermediate tray part 60 includes a plurality of discharge openings 60*a* through which the liquid refrigerant is discharged downwardly.

As discussed above, the evaporator 301 incorporates a two pass system in which the water first flows inside the heat transfer tubes 31 in the supply line group, which is disposed in a lower region of the tube bundle 30, and then is directed to flow inside the heat transfer tubes 31 in the return line group, which is disposed in an upper region of the tube bundle 30. Therefore, the water flowing inside the heat transfer tubes 31 in the supply line group near the inlet water chamber 13*a* has the highest temperature, and thus, a greater amount of heat transfer is required. For example, as shown in FIG. 25, the temperature of the water flowing inside the heat transfer tubes 31 near the inlet water chamber 13*a* is the highest. Therefore, a greater amount of heat transfer is required in the heat transfer tubes 31 near the inlet water chamber 13*a*. Once this region of the heat transfer tubes 31 dries up due to uneven distribution of the refrigerant from the distributing part 20, the evaporator 301 is forced to perform heat exchange by using limited surface areas of the heat transfer tubes 31 that are not dried up, and the evaporator 301 is held in equilibrium with the pressure at the time. In such a case, in order to rewet the dried up portions of the heat transfer tubes 31, more than the rated amount (e.g., twice as much) of the refrigerant charge will be required.

Therefore, in the fourth embodiment, the intermediate tray part 60 is disposed at a location above the heat transfer tubes 31 which requires a greater amount of heat transfer. The liquid refrigerant falling from above is once received by the intermediate tray part 60, and redistributed evenly toward the heat transfer tubes 31, which requires a greater amount of heat transfer. Accordingly, these portions of the heat transfer tubes 31 are readily prevented from drying up, ensuring good heat transfer performance.

Although in the fourth embodiment the intermediate tray part 60 is provided only partially with respect to the longitudinal direction of the tube bundle 330 as shown in FIG. 25, the intermediate tray part 60 or a plurality of intermediate tray parts 60 may be provided to extend substantially the entire longitudinal length of the tube bundle 330.

Similarly to the first embodiment, the arrangements for the tube bundle 330 and the trough part 40 in the fourth embodiment are not limited to the ones illustrated in FIG. 24. It will be apparent to those skilled in the art from this disclosure that various changes and modifications can be made herein without departing from the scope of the invention. For example, the intermediate tray part 60 can be combined in any of the arrangements shown in FIGS. 12-15 and 17-23.

Fifth Embodiment

Referring now to FIGS. 26-34, an evaporator 401 in accordance with a fifth embodiment will now be explained. In view of the similarity between the first through fifth embodiments, the parts of the fifth embodiment that are identical to the parts of other embodiments will be given the same reference numerals as the parts of the other embodiments. Moreover, the descriptions of the parts of the fifth embodiment that are identical to the parts of the other embodiments may be omitted for the sake of brevity. Moreover, it will be apparent to those skilled in the art from this disclosure that the descriptions and illustrations of the preceding embodiments also apply to this fifth embodiment, except as explained and illustrated herein.

Figure 31:
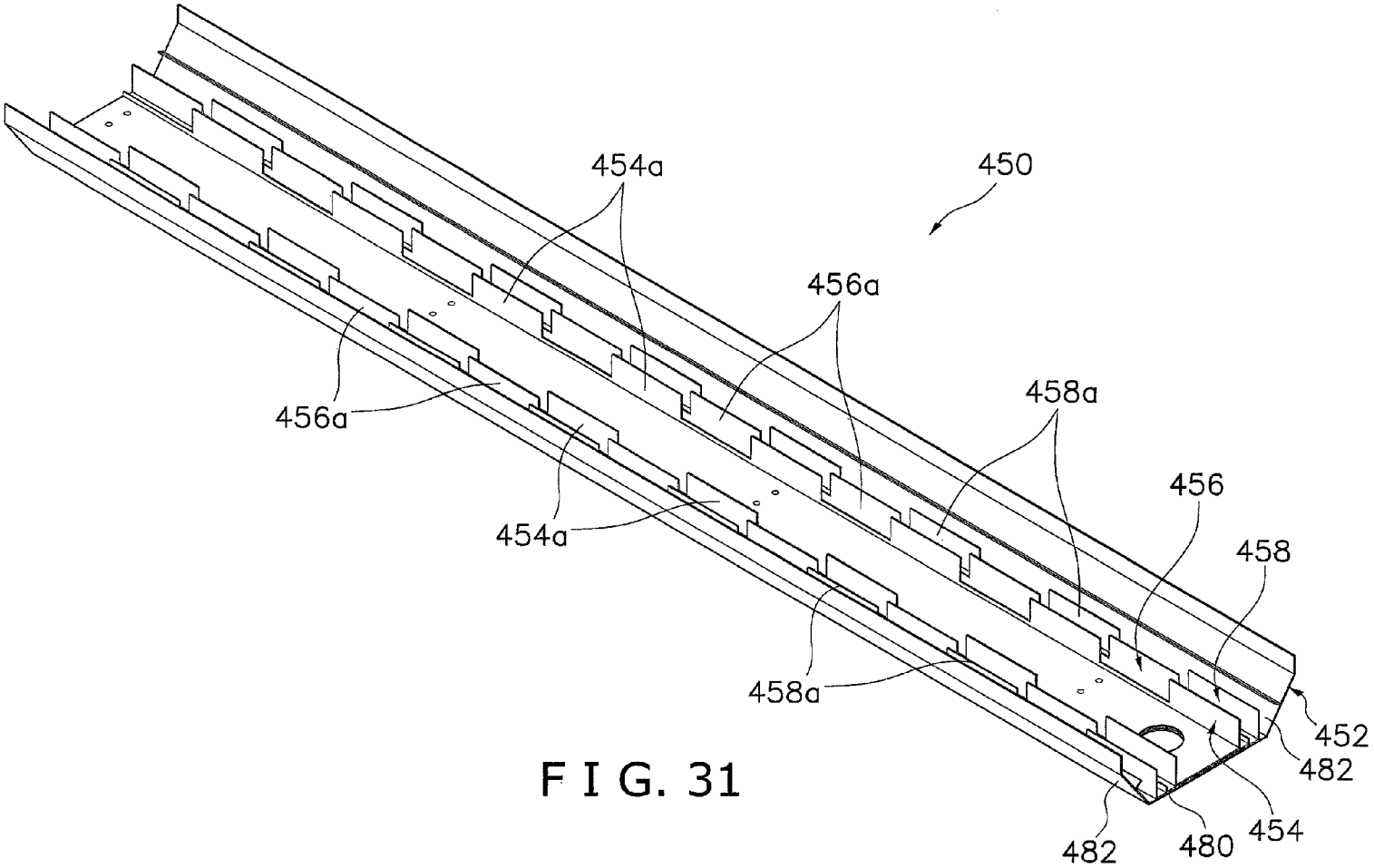
FIG. 31 is an inverted perspective view of the baffle structure of the fifth embodiment.
Figure 32:
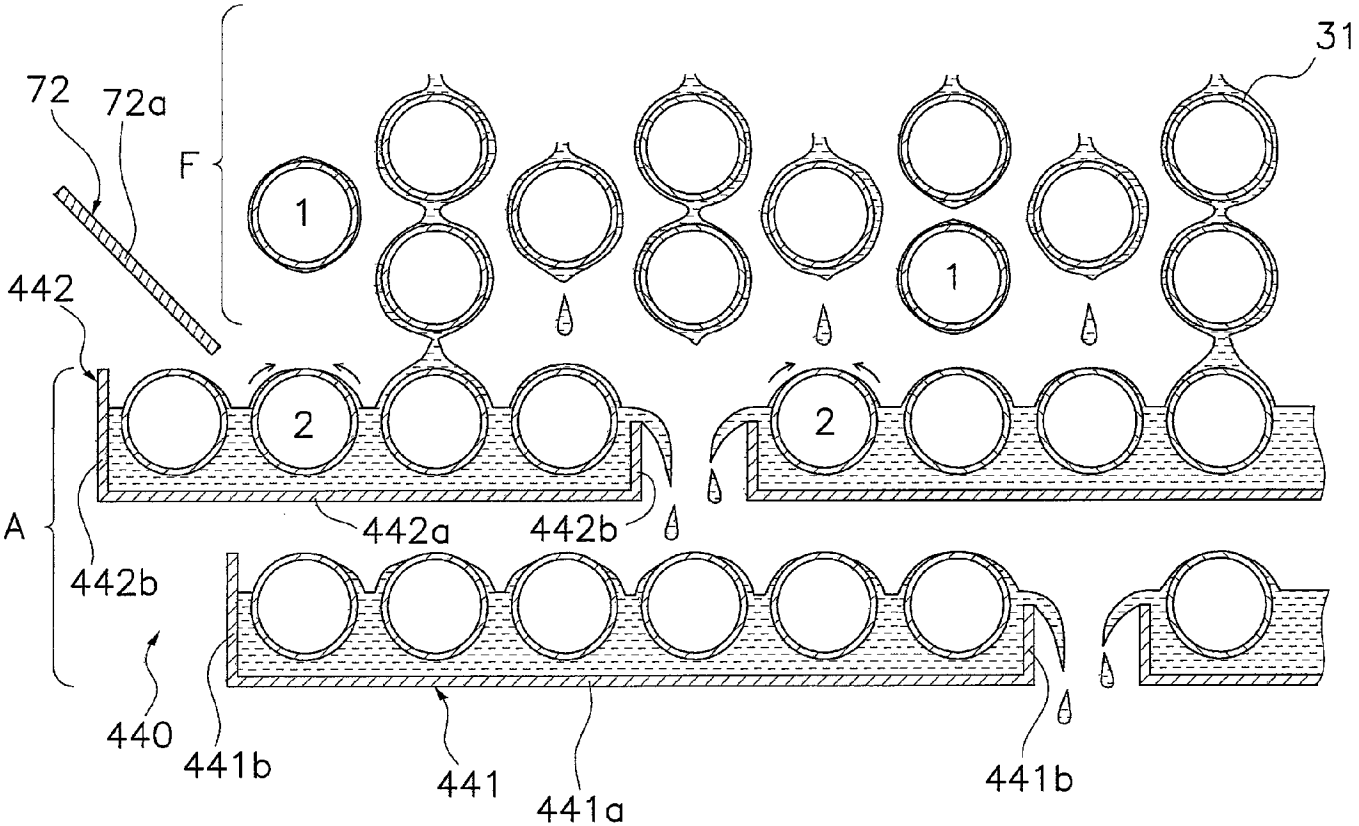
FIG. 32 is an enlarged schematic cross sectional view of heat transfer tubes, a trough part and a guide part disposed in region X in FIG. 29 illustrating a state in which the heat exchanger is in use according to the fifth embodiment of the present invention.
Figure 33:
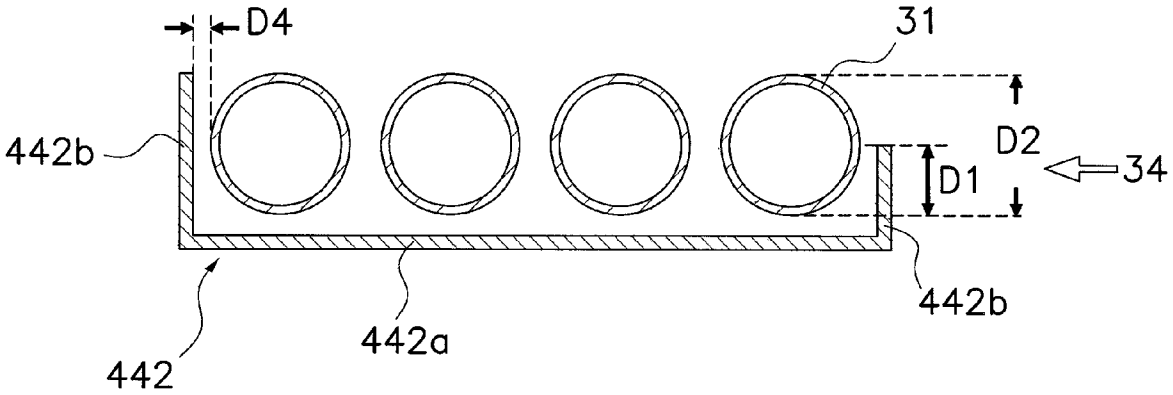
FIG. 33 is an enlarged cross sectional view of the heat transfer tubes and one of trough sections of the trough part of FIG. 32.
Figure 34:
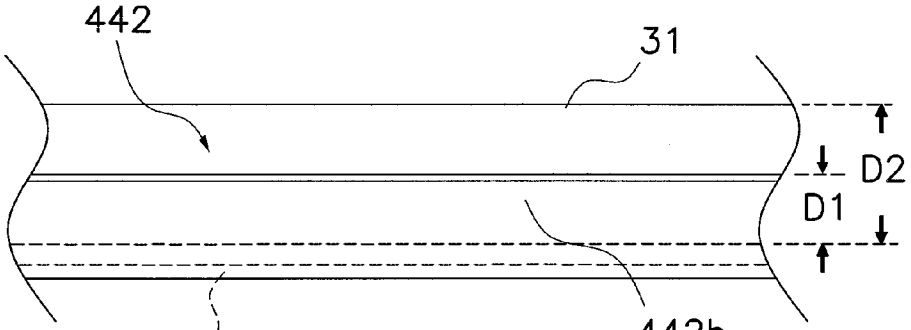
FIG. 34 is a partial side elevational view of the heat transfer tubes and the trough section of FIG. 33 as seen in a direction along an arrow 34 in FIG. 33.
Figure 35:
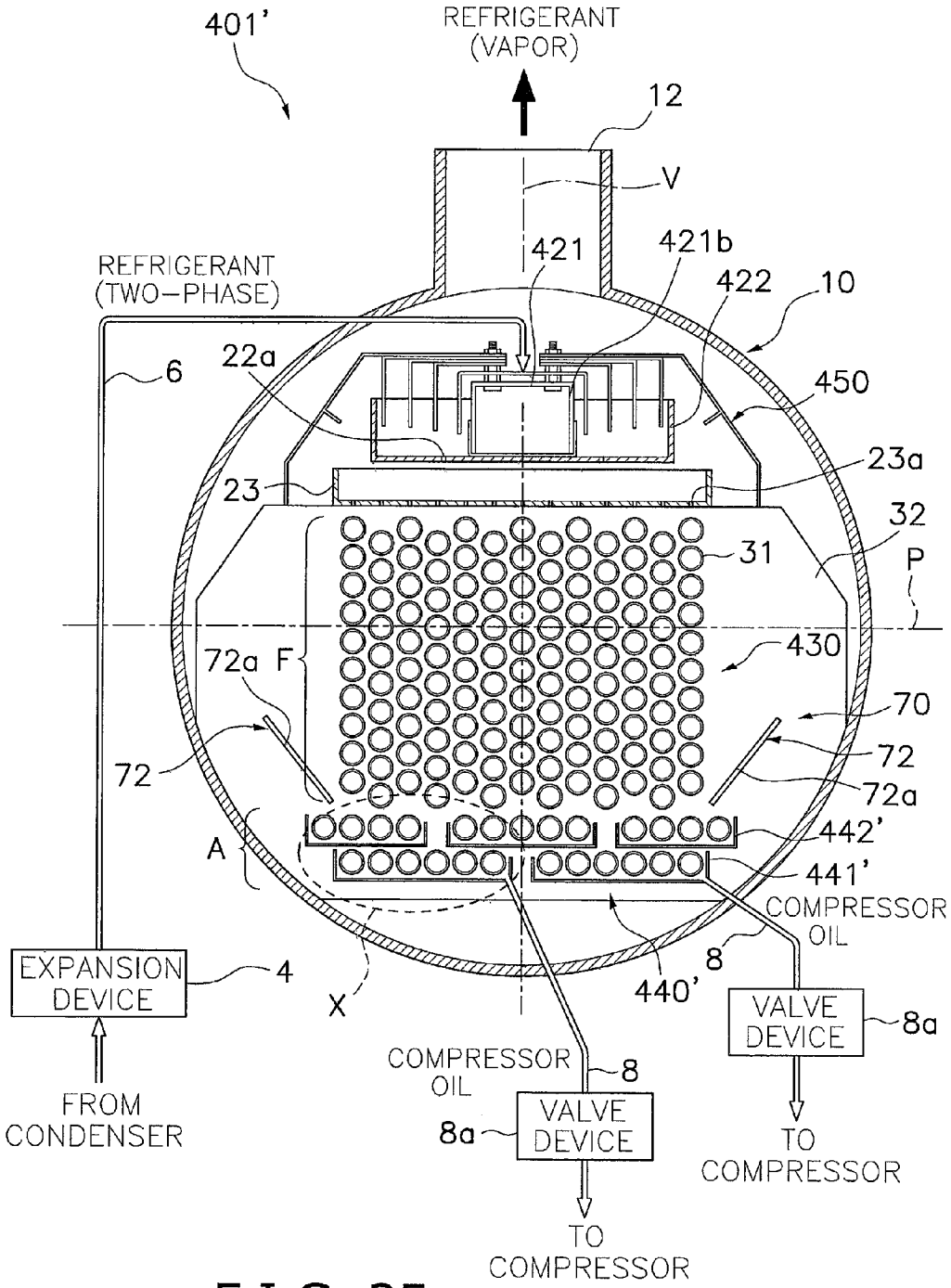
FIG. 35 is a simplified transverse cross sectional view of the heat exchanger illustrating a modified example for an arrangement of a tube bundle and a trough part according to the fifth embodiment of the present invention.
Figure 36:
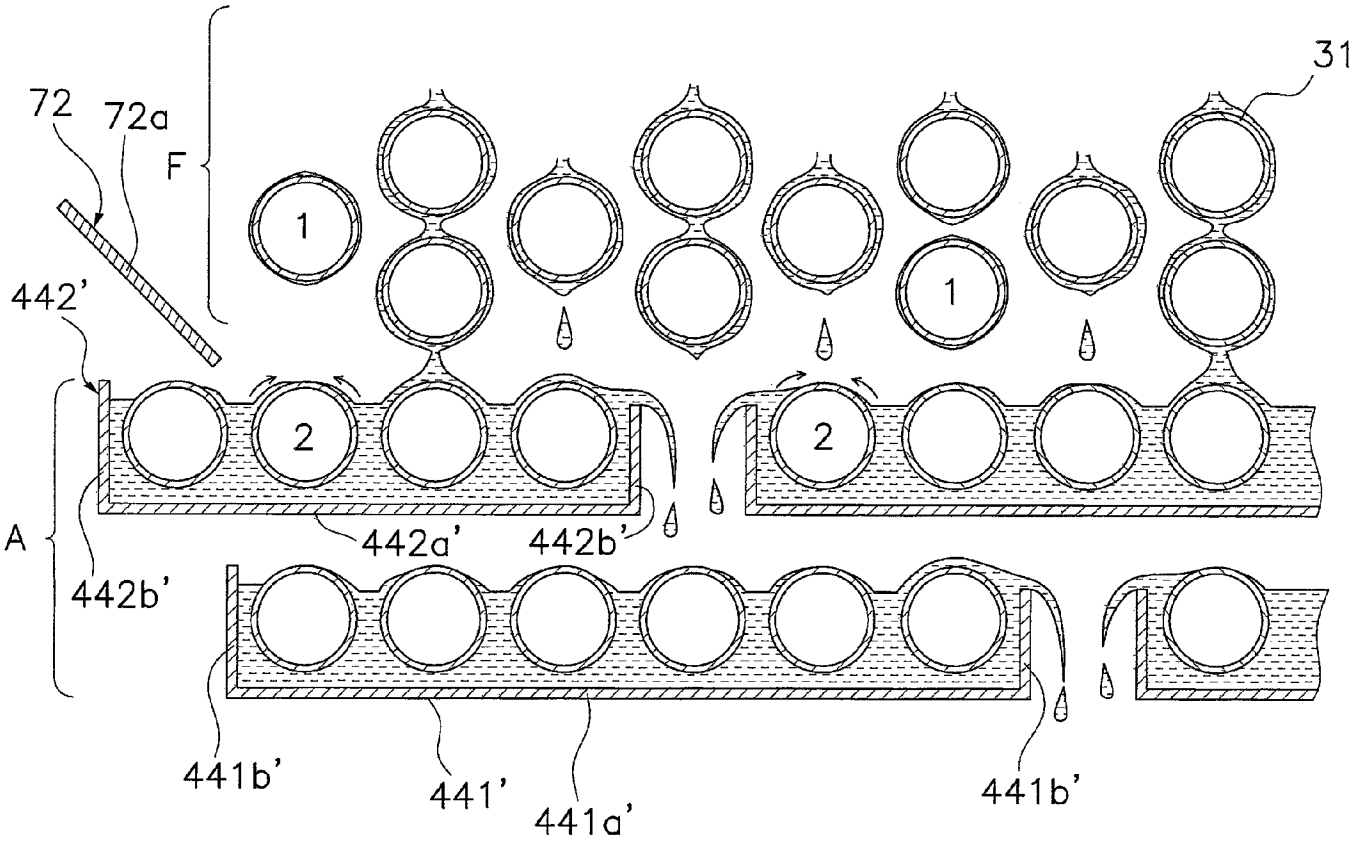
FIG. 36 is an enlarged schematic cross sectional view of heat transfer tubes, a trough part and a guide part disposed in region X in FIG. 35 illustrating a state in which the heat exchanger is in use according to the modified example of the fifth embodiment of the present invention.
Figure 37:
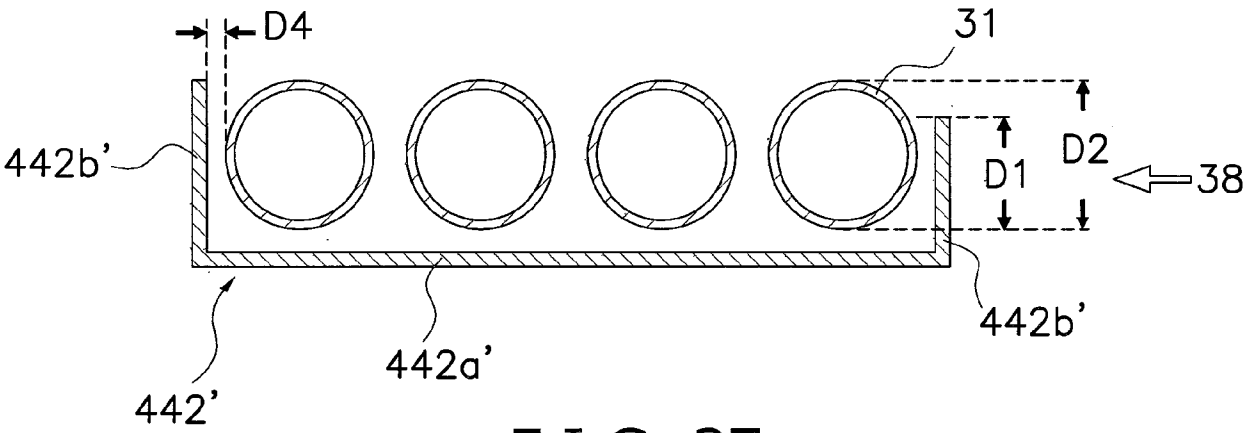
FIG. 37 is an enlarged cross sectional view of the heat transfer tubes and one of the trough sections of the trough part of FIG. 36.
Figure 38:
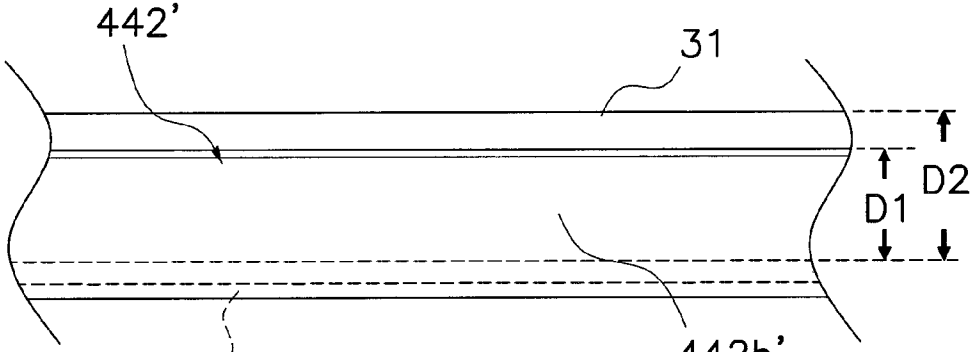
FIG. 38 is a partial side elevational view of the heat transfer tubes and the trough section of FIG. 37 as seen in a direction along an arrow 38 in FIG. 37.

The evaporator 401 in accordance with this fifth embodiment basically includes the shell 10, a modified distributing part 420, a modified tube bundle 430 (heat transferring unit), a modified trough part 440 and the guide part 70. The evaporator 1 preferably further includes a modified baffle structure 450 as best shown in FIG. 31.

Referring to FIGS. 26-31, the modified distributing part 420 is configured and arranged to serve as both a gas-liquid separator and a refrigerant distributor like the preceding embodiments. The distributing part 420 includes a modified inlet pipe part 421, a modified first tray part 422 and a plurality of second tray parts 23. The inlet pipe part 421 is functionally identical to the inlet pipe portion 21 and extends generally parallel to the longitudinal center axis C of the shell 10. However, the inlet pipe portion 421 in this embodiment has a rectangular cross-sectional configuration. Similarly, the first tray part 422 is functionally identical to the first tray part 22. However the first tray part 422 has a structure that mates with the inlet pipe part 421 to form part of the rectangular cross-sectional shape of the inlet pipe portion 421.

The inlet pipe part 421 is fluidly connected to the refrigerant inlet pipe 11 of the shell 10 so that the two-phase refrigerant is introduced into the inlet pipe part 421 via the refrigerant inlet pipe 11. The inlet pipe part 421 preferably includes a first (supply) inverted U-shaped member 421*a* and a second (distribution) inverted U-shaped member 421*b* that are attached to the first tray part 422. The first (supply) inverted U-shaped member 421*a* is formed of a rigid metal sheet/plate material, which prevents liquid and gas refrigerant from passing therethrough. On the other hand, the second (distribution) inverted U-shaped member 421*b* is preferably formed of a rigid metal mesh (screen) material, which allows refrigerant liquid and gas to pass therethrough. The first and second inverted U-shaped members 421*a* and 421*b* are separate members (even though illustrated together in FIGS. 26-27), which are attached to the longitudinal center of the first tray part 422.

Referring to FIGS. 27-30, the first tray part 422 includes a pair of longitudinally extending flanges 422*a* extending upwardly from a bottom surface thereof to form a central longitudinal channel 422*b* along a direction parallel to the center longitudinal axis C. The flanges 422*a* can be integrally formed with the first tray part 422, can be separate flanges that are fixed to the first tray part 422 (e.g., by welding), or can be parts of a U-shaped channel that is attached to the bottom surface of the first tray part 422. In any case, the central longitudinal channel 422*b* is preferably free of openings. In the illustrated embodiment, since the second (distribution) inverted U-shaped member 421*b* is preferably formed of a rigid metal mesh, the flanges 422*a* preferably extend to a predetermined height so that liquid refrigerant disposed in the channel 422*b* will flow over the flanges 422*a* upon exceeding the predetermined height.

Alternatively, the second (distribution) inverted U-shaped member 421*b* can be formed of solid sheet/plate metal, but with holes formed therein to allow liquid and or gas refrigerant to pass therethrough. In such a case, the holes should be disposed at the predetermined height. Also, in such a case, it is not necessary that the height of the flanges 422*a* determine when liquid refrigerant flows out of the second (distribution) inverted U-shaped member 421*b*, and thus, it is possible to make the flanges 422*a* shorter, if desired (i.e., because the height of the holes in the second (distribution) inverted U-shaped member 421*b* will determine at which height liquid refrigerant will flow through the holes.

Other than the presence of the flanges 422*a* and the channel 422*b*, the first tray part 422 is identical to the first tray part 22. Thus, there are no holes formed within the channel 422*b*. The first and second inverted U-shaped members 421*a* and 421*b* are preferably dimensioned/sized to have free ends thereof received in the longitudinal channel to form a rectangular cross-sectional tube structure together with the flanges 422*a* and the bottom surface of the first tray part 422. The first and second inverted U-shaped members 421*a* and 421*b* are attached to the flanges or the bottom of the first tray 22 by welding, by fasteners such as nuts/bolts or any other suitable attachment technique. In the illustrated embodiment, welding is used to attach first and second inverted U-shaped members 421*a* and 421*b* to the first tray part 422.

Figure 29:
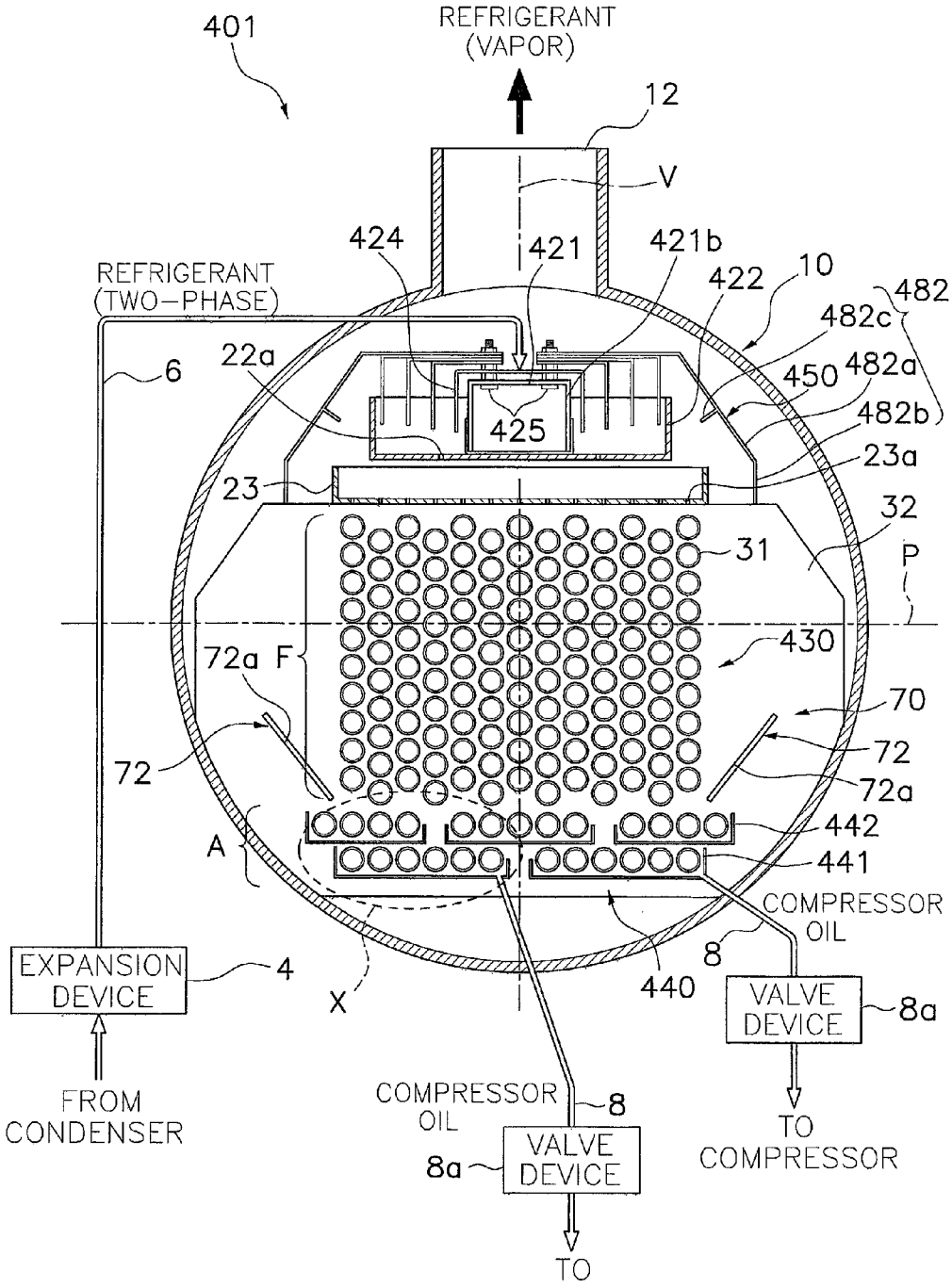
FIG. 29 is a simplified transverse cross sectional view of the heat exchanger according to the fifth embodiment of the present invention as taken along a section line 29-29' in FIG. 26.
Figure 30:
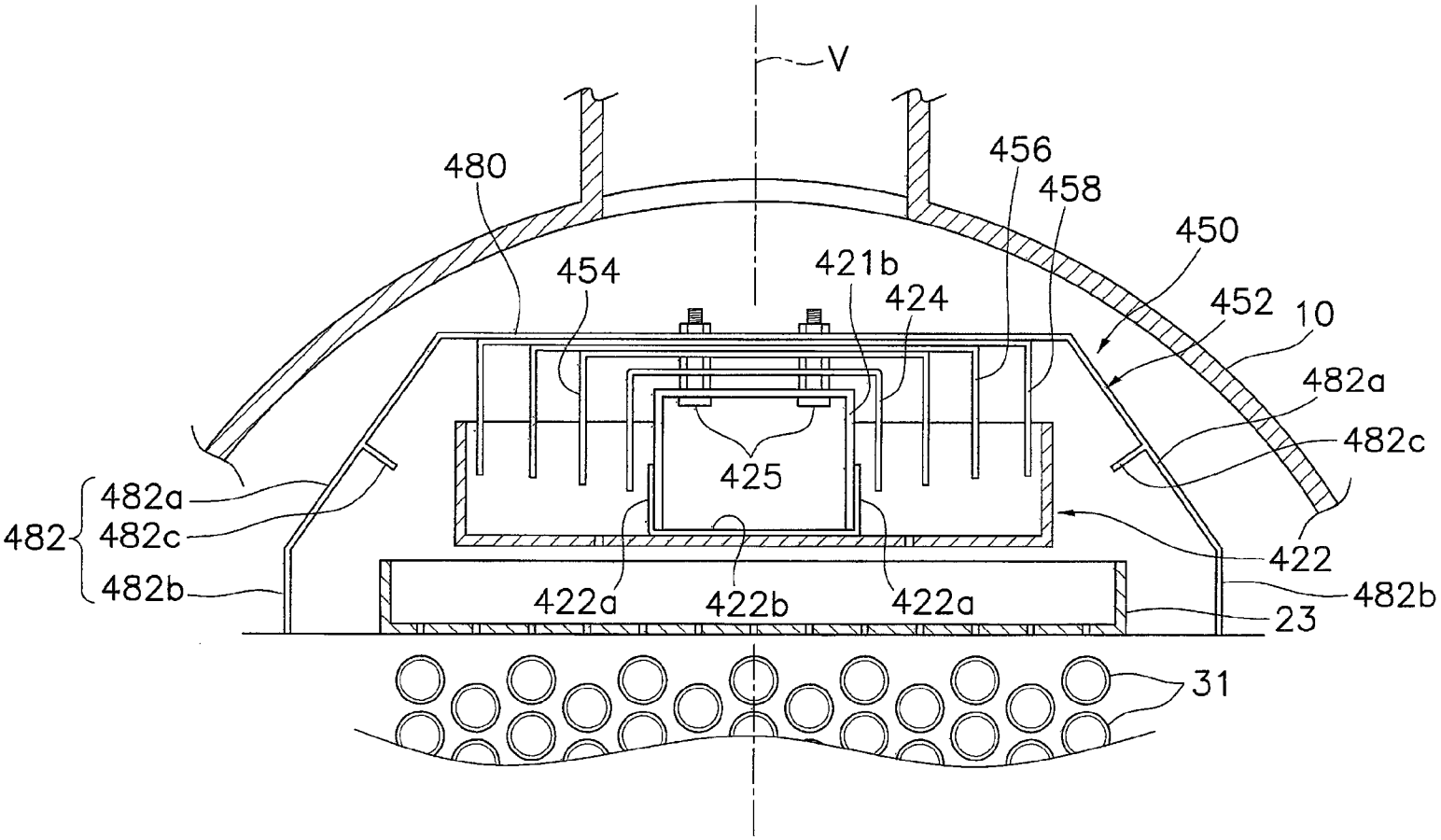
FIG. 30 is a further enlarged cross-sectional view of the upper portion of the heat exchanger illustrated in FIG. 29.

Referring still to FIGS. 27-30, an additional, larger third (distribution) inverted U-shaped member 424 is attached over the second (distribution) inverted U-shaped member 421*b* in a spaced relationship. Specifically, a plurality of bolts 425 extend upwardly through the second (distribution) inverted U-shaped member 421*b* and are attached thereto using nuts. The nuts act as spacers to mount the third (distribution) inverted U-shaped member 424 above the member 421*b*. The third (distribution) inverted U-shaped member 424 is laterally wider than the second (distribution) inverted U-shaped member 421*b* and has a height about the same or a little smaller. However, the nuts that act as spacers are relatively thin so that the free ends of the third (distribution) inverted U-shaped member 424 project downwardly below the top edges of the flanges 422*a* and are disposed above the bottom of the first tray 422, as best seen in FIG. 30. The free ends of the bolts 425 also extend through the third (distribution) inverted U-shaped member 424, and additional nuts are used to fix the third (distribution) inverted U-shaped member 424 to the second (distribution) inverted U-shaped member 421*b*. These additional nuts also act as spacers to space the baffle structure 450 upwardly from the third (distribution) inverted U-shaped member 424.

The third (distribution) inverted U-shaped member 424 impedes the flow of refrigerant vapor therethrough. When the two-phase refrigerant is discharged from the first inverted U-shaped member 421*a* of the inlet pipe part 421, the liquid component of the two-phase refrigerant discharged is received by the first tray part 422. On the other hand, the vapor component of the two-phase refrigerant flows upwardly and impinges the baffle structure 450 so that liquid droplets entrained in the vapor are captured by the baffle structure 450 and flow of gaseous refrigerant from the baffle structure 450 directly to the outlet pipe 12 is reduced.

Referring to FIGS. 26-31, the baffle structure 450 basically includes a canopy member 452, a first baffle member 454, a second baffle member 456 and a third baffle member 458 that are fixed together by welding or any suitable attachment technique. The canopy member 452 is the upper most part of the baffle. The third baffle member 458 is immediately under the canopy member 452. The second baffle member 456 is immediately below the third baffle member 458. The first baffle member 454 is immediately below the second baffle member 456. Each of the first, second and third baffle members 454, 456 and 458 are formed as inverted U-shaped members from a metal sheet/plate material. The legs of the first, second and third baffle members 454, 456 and 458 have cutouts formed in linearly spaced, alternating manner as best seen in FIG. 31. Specifically, the third baffle member 458 includes a plurality of longitudinally spaced plate-shaped tab sections 458*a* that are longitudinally aligned with longitudinally spaced plate-shaped tab sections 454*a* of the first baffle member 454. The second baffle member 456 includes a plurality of longitudinally spaced plate-shaped tab 456*b* disposed longitudinally in the gaps between the tabs 454*a* and 458*a*. This arrangement of the tabs 454*a*, 456*b* and 458*a* form a serpentine route (in the gaps) for the flow of gaseous refrigerant, to impinge the flow of gaseous refrigerant, but to allow gaseous refrigerant to flow to some degree through the baffle members 454, 456 and 458.

As best seen in FIGS. 30-31, the canopy member 452 includes a central portion 480 and a pair of lateral side portions 482. The lateral side portions 482 are identical to each other, except that they are mirror images of each other. The first, second and third baffle members 454, 456 and 458 are attached to the central portion 480 so that the tabs 454*a*, 456*b* and 458*a* project downwardly from the central portion 480 in the mounted position shown in FIG. 30. The central portion 480 and the first, second and third baffle members 454, 456 and 458 have opening formed therein to receive the bolts 425. The nuts used to secure third (distribution) inverted U-shaped member 424 space the baffle structure 450 upwardly by contacting the first baffle member 454. Nuts are then attached to the free ends of the bolts 425 to secure the baffle structure 450 so that the central portion 480 is positioned above the distributing part 420. The distributing part 420 can also be referred to as a refrigerant distribution assembly. The central portion 480 forms an attachment portion of the canopy member 452 attached at an upper end of the refrigerant distribution assembly.

The central portion 480 is a planar-shaped portion. The lateral side portions 482 extend laterally from lateral ends of the central portion. More specifically, the lateral side portions 482 extend laterally outwardly and downwardly from a position above the refrigerant distribution assembly 420, as viewed along the longitudinal center axis C. Each lateral side portion 482 includes an inclined section 482*a*, a vertical section 482*b* and a flange section 482*c*. Each lateral side portion 482 has a free end formed at a bottom end of the vertical section 482*b* that is disposed further from a vertical plane V passing through the longitudinal center axis C than the refrigerant distribution assembly 420, as viewed along the longitudinal center axis C, and lower than an upper edge of the outermost lateral end of the refrigerant distribution assembly 420 (an upper edge of the lateral ends of the second trays 23), as viewed along the longitudinal center axis C, as seen in FIG. 30.

The refrigerant distribution assembly 420 has a pair of outermost lateral ends, formed at the lateral ends of the second tray parts 23. The upper edge of the tray parts 23 form upper edges of the laterally outermost ends of the refrigerant distribution assembly 420. In the illustrated embodiment, the pair of lateral side portions 482 extend laterally outwardly and downwardly from positions above the refrigerant distribution assembly 420 so their free ends are disposed to contact the vertical plates 32 (i.e., to a vertical position corresponding to the bottom of the second trays 23). However, it will be apparent to those skilled in the art from this disclosure that the free ends of the lateral side portions 482 can be spaced upwardly from the vertical plates 32. In the illustrated embodiment, the flange sections 482*c* extend perpendicularly relative to the inclined sections 482*a* toward the refrigerant distribution assembly 420, and are approximately equally spaced from the central portion 480 and the vertical sections 482*b*.

The liquid droplets captured by the baffle structure 450 are guided toward the first and/or second tray parts 22 and 23. The vapor component flows laterally through the first, second and third baffle members 454, 456 and 458, downwardly along the lateral side portions 482 and then changes its direction upwardly toward the outlet pipe 12 at the free ends of the lateral side portions 482. The vapor refrigerant is discharged toward the compressor 2 via the outlet pipe 12. Due to the structure of the baffle structure 450 (i.e., the canopy member 452), vapor refrigerant velocity around the free end of the lateral side portions 482 is about 0.7 m/sec as compared to about 1.0 m/s with the baffle member 50 of the preceding embodiments. Liquid drops in this 0.7 m/s velocity range are not accompanied by gas, and thus, almost all fall downward. Therefore, hardly any liquid refrigerant will be introduced in the gas refrigerant pipe. The baffle member 450 (e.g. canopy member 452 can improve performance regardless of the structure of the heat transferring unit (tube bundle 430). Thus, the illustrated heat transferring units (tube bundles) illustrated herein are merely preferable examples.

The tube bundle 430 is disposed below the distributing part 420 so that the liquid refrigerant discharged from the distributing part 420 is supplied onto the tube bundle 430. The tube bundle 430 along with the modified trough part 440 form part of a heat transferring unit the disposed inside of the shell 10 below the refrigerant distribution assembly 420 so that the refrigerant discharged from the refrigerant distribution assembly 420 is supplied to the heat transferring unit. Thus, the heat transferring unit includes a plurality of heat transfer tubes 31 that extend generally parallel to the longitudinal center axis C of the shell 10. The tube bundle 430 is identical to the tube bundle 30, except as explained and illustrated herein. Mainly, the modified trough part 440 requires a slightly different configuration of the lowermost heat transfer tubes 31 in the accumulating region A.

Referring to FIGS. 26-29 and 32-34, the trough part 440 is configured and arranged to accumulate the liquid refrigerant flowing from above so that the heat transfer tubes 31 in the accumulating region A are at least partially immersed in the liquid refrigerant that is accumulated in the trough part 440. However, the trough part 440 includes modified first trough sections 441 and modified second trough sections 442. The first trough sections 441 and the second trough sections 442 extend generally parallel to the longitudinal center axis C of the shell 10 over a longitudinal length that is substantially the same as a longitudinal length of the heat transfer tubes 31.

The first trough sections 441 are wider and fewer in number than the second trough sections 442. The first trough sections 441 are narrower and more in number than the first trough sections 41. Similarly, the second trough sections 442 are narrower and more in number than the second trough sections 42. In other words, the number/width configurations of the trough sections 441 and 442 are different than the preceding embodiments (e.g., to house different numbers of the heat transfer tubes 31 as best illustrated in FIG. 29. In addition the trough sections 441 and 442 have different shaped ends than the trough sections 41 and 42. Specifically, each of the trough sections 441 includes a bottom wall portion 441*a* and a pair of side wall portions 441*b*. Similarly, each of the trough sections 442 includes a bottom wall portion 442*a* and a pair of side wall portions 442*b*. The side wall portions 441*b* and 442*b* have different heights depending on their location. The side wall portions 441*b* and 442*b* of the respective trough sections are mirrors images of each other, except for their heights in certain locations. Other than different heights (in some cases) and being mirror images of each other, the side wall portions 441*b* and 442*b* are identical to each other, and thus, will be given the same reference numerals for the sake of convenience.

The heat transfer tubes 31 in the accumulating region A are arranged in at least two horizontal rows when viewed along the longitudinal center axis C of the shell 10. The trough part 440 includes a plurality of trough sections 441 and 442 disposed below the horizontal rows in a number of tiers (e.g., two in this embodiment) corresponding to a number of the horizontal rows of the heat transfer tubes 31 in the accumulating region A as viewed along the longitudinal center axis C. Two of the sidewall portions 441*b* in the first (lower) tier form outermost lateral ends of the first (lower) tier and a remaining number of the side wall portions 441*b* form inner side wall portions of the first (lower) tier. Any inner side wall portions 441*b* of the first (lower) tier have vertical heights smaller than the two of the side wall portions 441*b* forming the outermost lateral ends of the first (lower) tier. Similarly, two of the sidewall portions 442*b* in the second (upper) tier form outermost lateral ends of the second (upper) tier and a remaining number of the side wall portions 442*b* form inner side wall portions of the second (upper) tier. Any inner side wall portions 442*b* of the second (upper) tier have vertical heights smaller than the two of the side wall portions 442*b* forming the outermost lateral ends of the second (upper) tier. This arrangement can be best understood from FIGS. 29 and 32-34.

Thus, two of the side wall portions 441*b*/442*b* of the trough sections 441/442 in each tier form outermost lateral ends of the tier and a remaining number of the side wall portions 441*b*/442*b* form inner side wall portions of the tier, and any inner side wall portions 441*b*/442*b* of each tier have vertical heights smaller than the two of the side wall portions 441*b*/442*b* forming the outermost lateral ends of the tier. The inner side wall portions 441*b*/442*b* of each tier extend vertically upward from the bottom wall portions 441*a*/442*b* to positions overlapping at least 50% of the heat transfer tubes 31 in the horizontal row above the tier. In the illustrated embodiment 50% of the heat transfer tubes 31 in the tier are overlapped by the inner side wall portions 441*b*/442*b*. The outer side wall portions 441*b*/442*b* vertically overlap about 100% of the heat transfer tubes in the tier.

Like the first embodiment, an outermost one of the heat transfer tubes 31 in the accumulating region A is positioned outwardly of an outermost one of the columns of the heat transfer tubes 31 in the falling film region F with respect to a transverse direction when viewed along the longitudinal center axis C of the shell 10. In the illustrated embodiment, the heat transfer tubes 31 in the accumulating region A are arranged in two horizontal rows when viewed along the longitudinal center axis C of the shell 10, and the trough part 441 continuously extends laterally under the heat transfer tubes 31 disposed in the accumulating region A. In this embodiment D1 represents an overlapping distance (height) of the inner side wall portions 441*b*/442*b*, while D2 represents an overlapping distance (height) of the outermost side wall portions 441*b*/442*b*. Preferably D1/D2≥0.5 as mentioned above (e.g. 0.5 in the illustrated embodiment).

In this embodiment, the trough part 440 is fluidly connected to a pair of valve devices 8*a* via a pair of bypass conduits 8 (e.g. like the third embodiment). The valve devices 8*a* are selectively operated when the oil accumulated in the trough part 440 reaches a prescribed level to discharge the oil from the trough part 440 to outside of the evaporator 401. However, it will be apparent to those skilled in the art from this disclosure that the valve devices 8*a* and the bypass conduits 8 could be eliminated. Moreover, it will be apparent to those skilled in the art from this disclosure that a single valve device 8*a* could be coupled to the pair of bypass conduits 8.

Modification of Fifth Embodiment

Referring now to FIGS. 35-38, an evaporator 401' is illustrated in accordance with a modification of the fifth embodiment. The evaporator 401' is identical to the evaporator 401, except the evaporator includes a modified trough part 440'. In view of the similarity between this modification of the fifth embodiment and the fifth embodiment, the parts of this modification of the fifth embodiment that are identical to the parts of other embodiments will be given the same reference numerals as the parts of the other embodiments. Moreover, the descriptions of the parts of this modification of the fifth embodiment that are identical to the parts of the other embodiments may be omitted for the sake of brevity. Moreover, it will be apparent to those skilled in the art from this disclosure that the descriptions and illustrations of the preceding fifth embodiment also apply to this modification of the fifth embodiment, except as explained and illustrated herein.

The modified trough part 440' is identical to the trough part 440, except the modified trough part 440' includes modified trough sections 441' and 442'. The modified trough sections 441' and 442' are identical to the trough sections 441 and 442, except the dimension D1 is set to overlap 75% of the heat transfer tubes disposed in the tier at inner ends of the trough sections 441' and 442'. Thus, each of the trough sections 441' includes a bottom wall portion 441*a*' and a pair of side wall portions 441*b*'. Similarly, each of the trough sections 442' includes a bottom wall portion 442*a*' and a pair of side wall portions 442*b*'. The side wall portions 441*b*' and 442*b*' have different heights depending on their location. The side wall portions 441*b*' and 442*b*' of the respective trough sections are mirrors images of each other, except for their heights in certain locations. Other than different heights (in some cases) and being mirror images of each other, the side wall portions 441*b*' and 442*b*' are identical to each other, and thus, will be given the same reference numerals for the sake of convenience.

Sixth Embodiment

Figure 39:
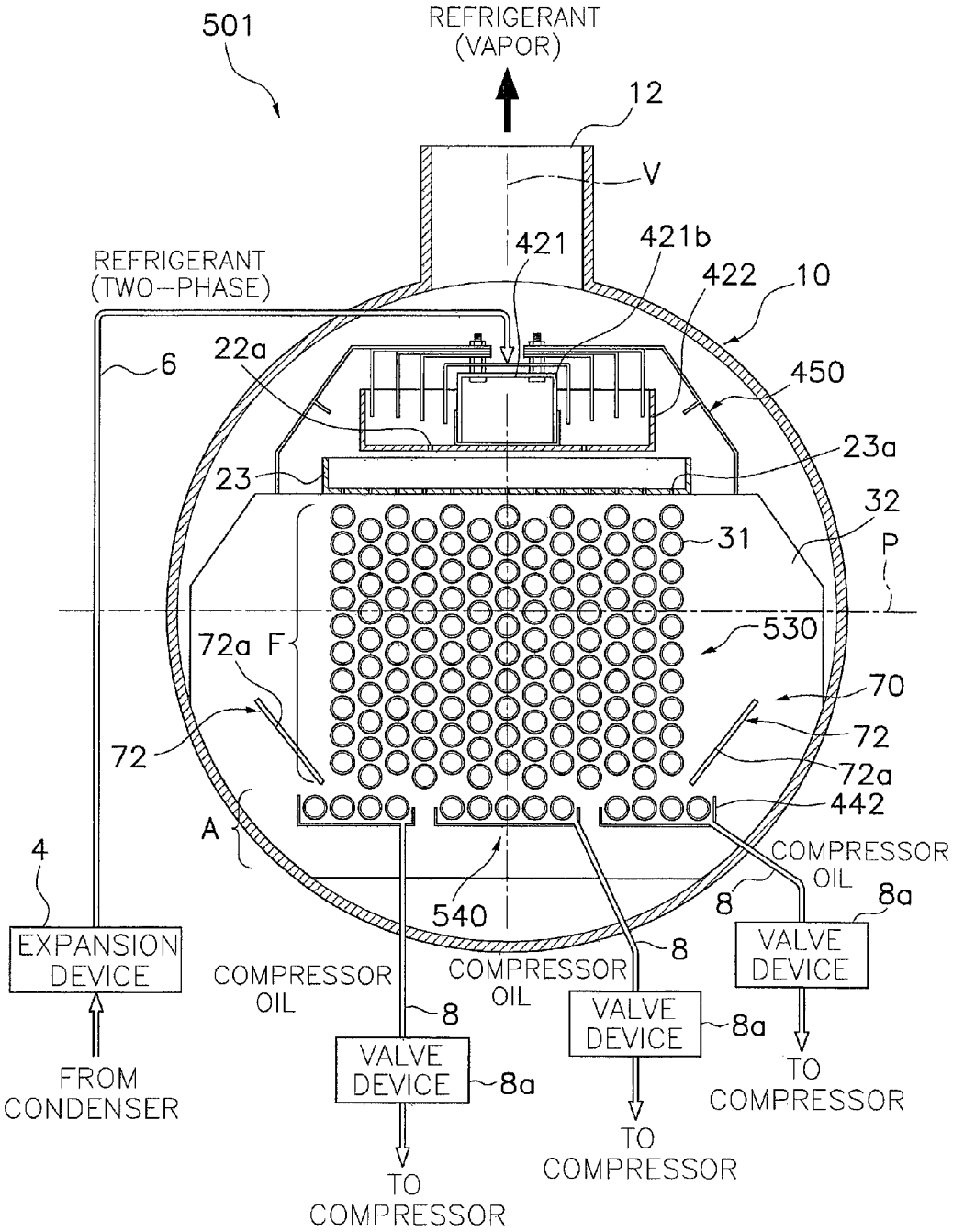
FIG. 39 is a simplified transverse cross sectional view of the heat exchanger illustrating an arrangement of a tube bundle and a trough part according to a sixth embodiment of the present invention.

Referring now to FIG. 39, an evaporator 501 in accordance with a sixth embodiment will now be explained. This sixth embodiment is identical to the fifth embodiment, except this sixth embodiment includes a modified trough part 540. Therefore, the descriptions and illustrations of the fifth embodiment also apply to this sixth embodiment, except as discussed and illustrated herein. In view of the similarity between the sixth embodiment and the preceding embodiments, the parts of the sixth embodiment that are identical to the parts of other embodiments will be given the same reference numerals as the parts of the other embodiments. Moreover, the descriptions of the parts of the sixth embodiment that are identical to the parts of the other embodiments may be omitted for the sake of brevity. As just mentioned, the evaporator 501 in accordance with this sixth embodiment is identical to the evaporator 401 of the fifth embodiment, except the evaporator 501 includes a modified trough part 540. Specifically, the modified trough part 540 includes the trough sections 442, but the trough sections 441 from the fifth embodiment are omitted. The heat transfer tubes 31 in the trough sections 441 are also eliminated to form a modified tube bundle 530. Otherwise, the tube bundle 530 (heat transferring unit) is identical to the tube bundle 430.

Since the first trough sections 441 are eliminated in this embodiment, the trough part 540 is fluidly connected to three valve devices 8*a* via three bypass conduits 8. The valve devices 8*a* are selectively operated when the oil accumulated in the trough part 540 reaches a prescribed level to discharge the oil from the trough part 540 to outside of the evaporator 501. However, it will be apparent to those skilled in the art from this disclosure that the valve devices 8*a* and the bypass conduits 8 could be eliminated. Moreover, it will be apparent to those skilled in the art from this disclosure that a single valve device 8*a* could be coupled to the three bypass conduits 8.

Other than the above mentioned differences, this sixth embodiment is identical to the fifth embodiment. Therefore, in this sixth embodiment, the heat transfer tubes 31 in the accumulating region A are arranged in a (single) horizontal row when viewed along the longitudinal center axis C of the shell 10, and the trough part 540 includes a plurality of laterally arranged trough sections 442 disposed below the horizontal row of the heat transfer tubes 31 in the accumulating region A as viewed along the longitudinal center axis C. Moreover, like the fifth embodiment, each trough section 442 includes a bottom wall portion 442*a* and a pair of side wall portions 442*b*, with two of the side wall portions 442*b* forming the outermost lateral ends of the trough part 540 and a remaining number of the side wall portions 442*b* forming inner side wall portions. Like the fifth embodiment, the inner side wall portions 442*b* have vertical heights smaller than the two of the side wall portions 442*b* forming the outermost lateral ends of the trough part 540. Also, like the fifth embodiment, the inner side wall portions 442*b* extend vertically upward from the bottom wall portions to positions overlapping at least 50% of the heat transfer tubes 31 in the horizontal row. Furthermore, like the fifth embodiment, an outermost one of the heat transfer tubes 31 in the accumulating region A is positioned outwardly of an outermost one of the columns of the heat transfer tubes 31 in the falling film region F with respect to a transverse direction when viewed along the longitudinal center axis C of the shell 10.

Modification of Sixth Embodiment

Figure 40:
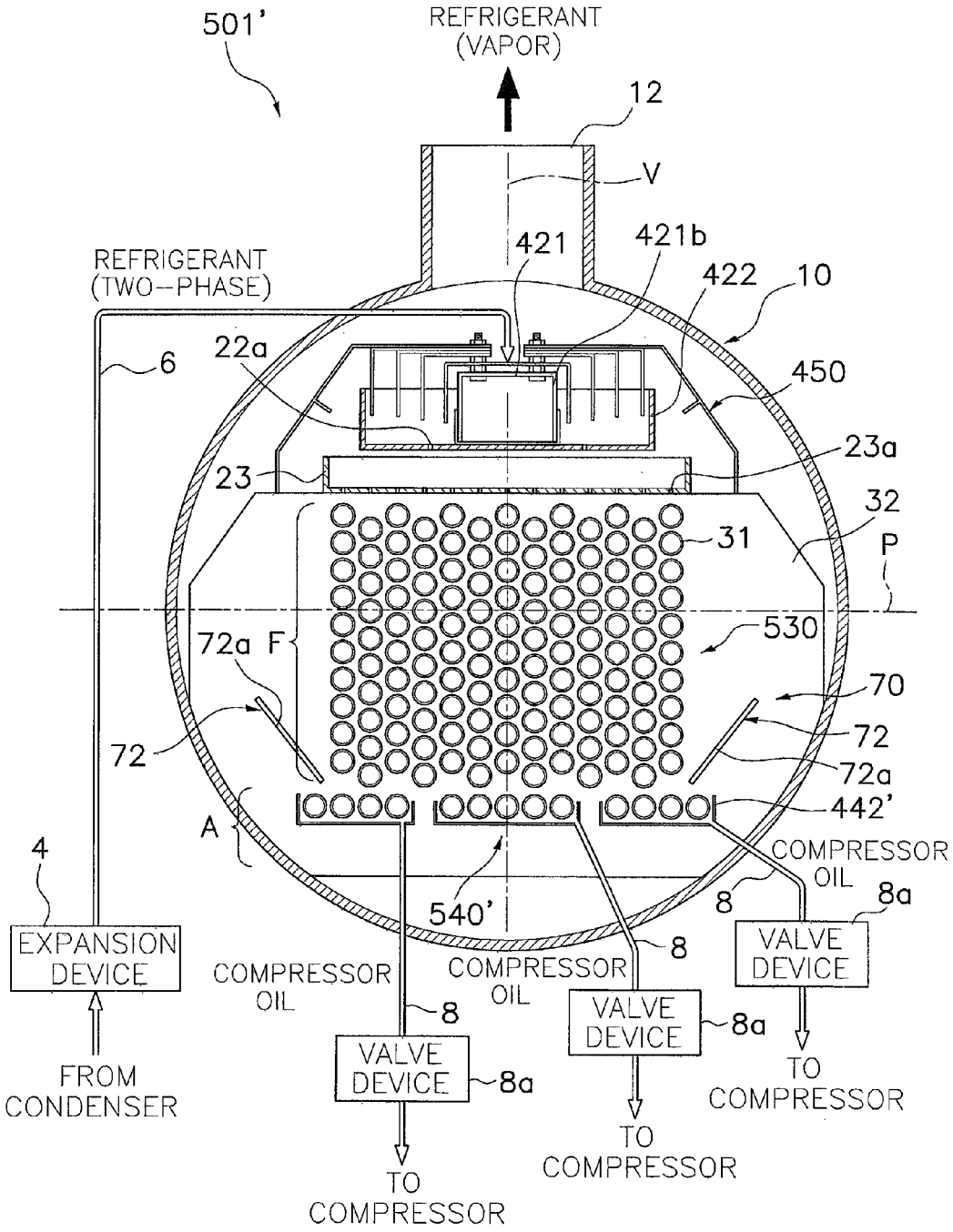
FIG. 40 is a simplified transverse cross sectional view of the heat exchanger illustrating a modified example for an arrangement of a tube bundle and a trough part according to the sixth embodiment of the present invention.

Referring now to FIG. 40, an evaporator 501' is illustrated in accordance with a modification of the sixth embodiment. The evaporator 501' is identical to the evaporator 501, except the evaporator includes a modified trough part 540'. In view of the similarity between this modification of the sixth embodiment and the sixth embodiment, the parts of this modification of the sixth embodiment that are identical to the parts of other embodiments will be given the same reference numerals as the parts of the other embodiments. Moreover, the descriptions of the parts of this modification of the sixth embodiment that are identical to the parts of the other embodiments may be omitted for the sake of brevity. Moreover, it will be apparent to those skilled in the art from this disclosure that the descriptions and illustrations of the preceding sixth embodiment also apply to this modification of the sixth embodiment, except as explained and illustrated herein.

The modified trough part 540' is identical to the trough part 540, except the modified trough part 540' includes modified trough sections 442' identical to the modified trough sections 442' of the modification of the fifth embodiment. Thus, the modified trough sections 442' are identical to the trough sections 442, except the dimension D1 is set to overlap 75% of the heat transfer tubes disposed in the tier.

Seventh Embodiment

Figure 41:
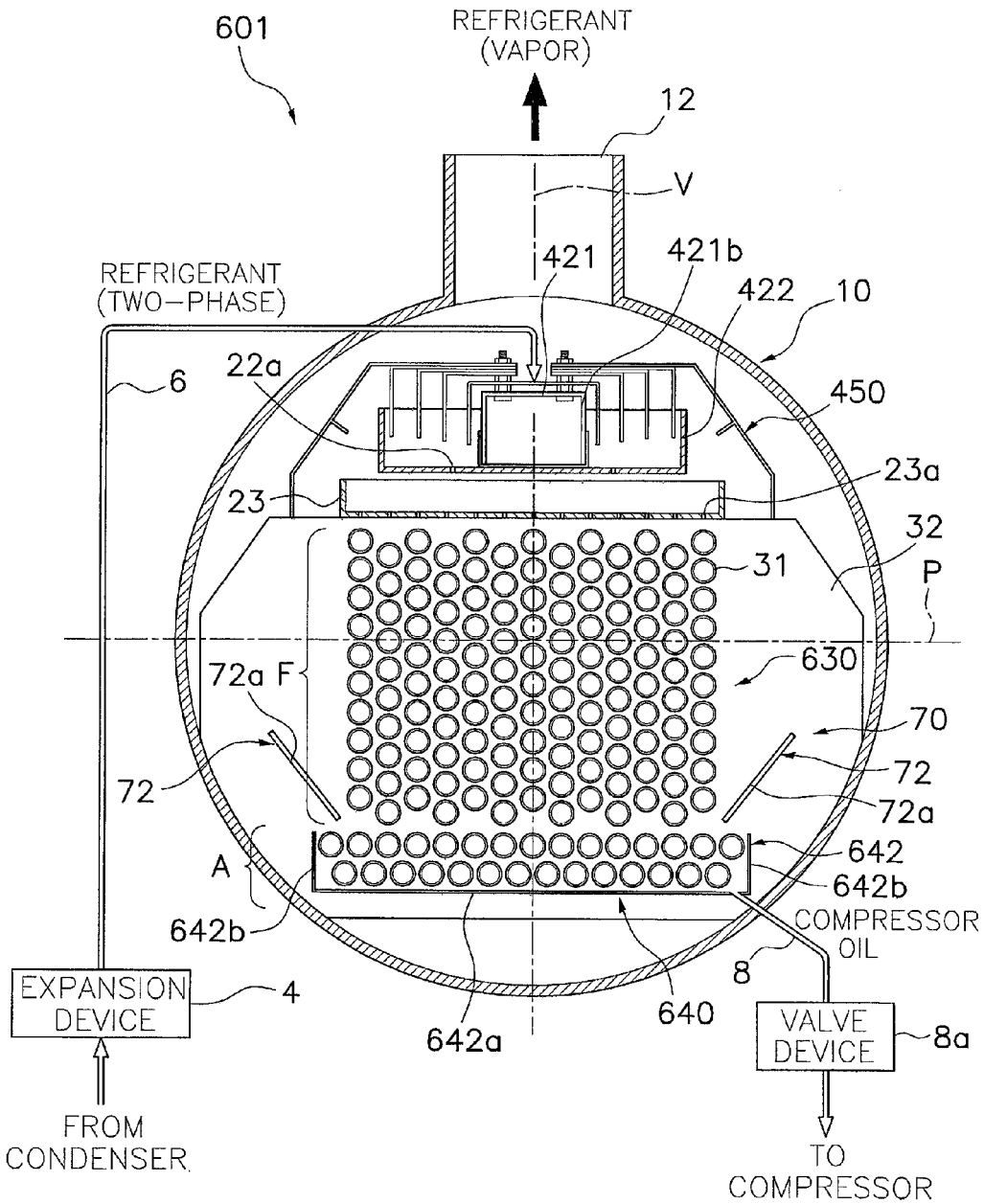
FIG. 41 is a simplified transverse cross sectional view of the heat exchanger illustrating an arrangement of a tube bundle and a trough part according to a seventh embodiment of the present invention.

Referring now to FIG. 41, an evaporator 601 in accordance with a seventh embodiment will now be explained. This seventh embodiment is identical to the fifth embodiment, except this seventh embodiment includes a modified trough part 640. Therefore, the descriptions and illustrations of the fifth embodiment also apply to this seventh embodiment, except as discussed and illustrated herein. In view of the similarity between the seventh embodiment and the preceding embodiments, the parts of the sixth embodiment that are identical to the parts of other embodiments will be given the same reference numerals as the parts of the other embodiments. Moreover, the descriptions of the parts of the seventh embodiment that are identical to the parts of the other embodiments may be omitted for the sake of brevity. As just mentioned, the evaporator 601 in accordance with this sixth embodiment is identical to the evaporator 401 of the fifth embodiment, except the evaporator 601 includes a modified trough part 640. Specifically, the modified trough part 640 includes a single trough section 642 in place of the rough sections 441 and 442 of the fifth embodiment. Due to the configuration of the trough section 642, a modified tube bundle 630 is formed. Otherwise, the tube bundle 630 (heat transferring unit) is identical to the tube bundle 430.

The trough section 642 is deeper than the trough sections 441 and 442 (about twice as deep) so that two tiers of the refrigerant tubes 31 can be disposed therein. Preferably, the trough part 642 includes a bottom wall 642*a* and a pair of side walls 642*b*. The side walls 642*b* preferably overlap 100% of the two tiers of heat transfer tubes 31 disposed therein. The trough section 642 is fluidly connected to a valve device 8*a* via a bypass conduits 8. The valve device 8*a* is selectively operated when the oil accumulated in the trough part 640 reaches a prescribed level to discharge the oil from the trough part 640 to outside of the evaporator 601. However, it will be apparent to those skilled in the art from this disclosure that the valve device 8*a* and the bypass conduit 8 could be eliminated. Other than the above mentioned differences, this seventh embodiment is identical to the fifth embodiment.

Eighth Embodiment

Figure 42:
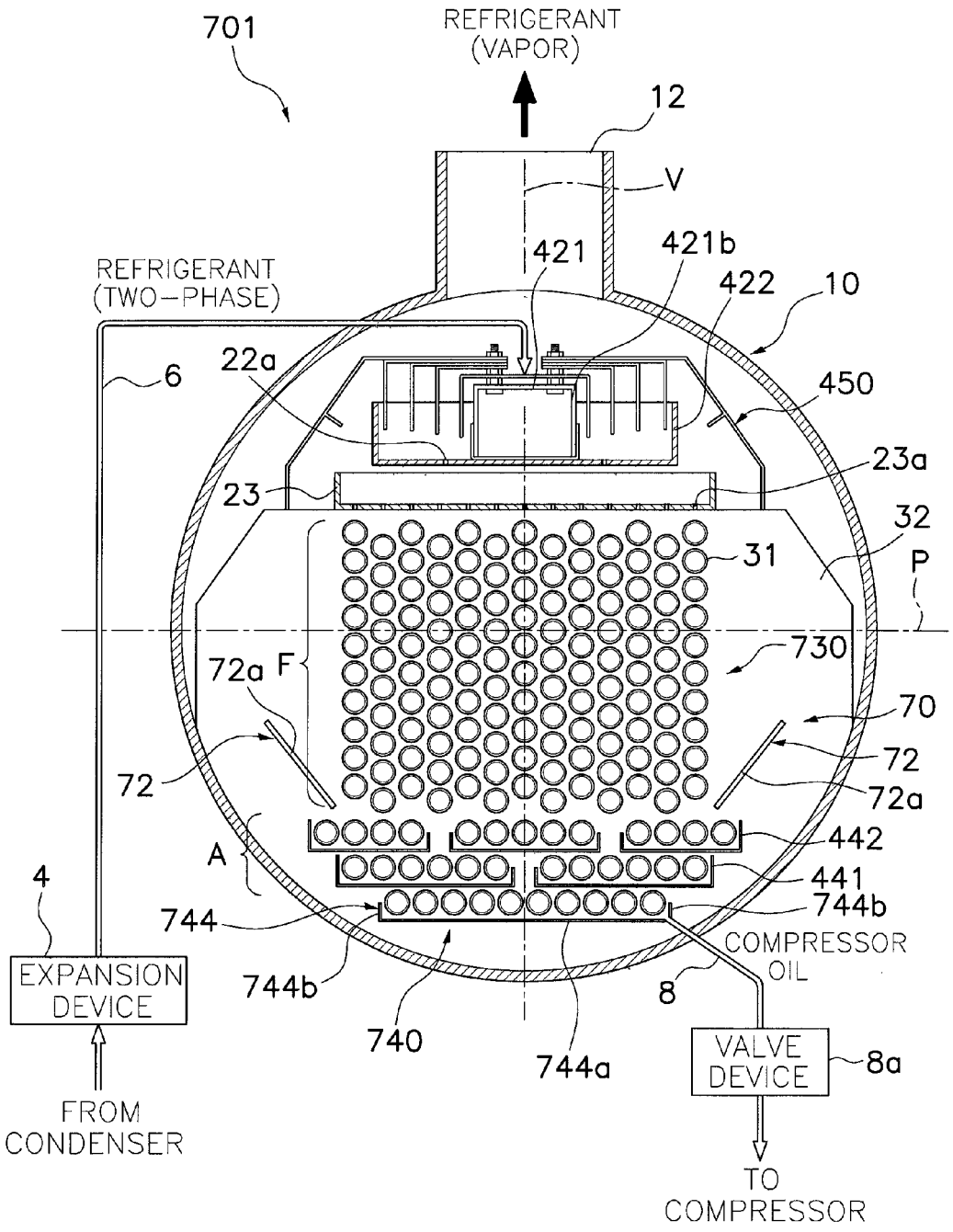
FIG. 42 is a simplified transverse cross sectional view of the heat exchanger illustrating an arrangement of a tube bundle and a trough part according to an eighth embodiment of the present invention.

Referring now to FIG. 42, an evaporator 701 in accordance with an eighth embodiment will now be explained. This eighth embodiment is identical to the fifth embodiment, except this eighth embodiment includes a modified trough part 740. Therefore, the descriptions and illustrations of the fifth embodiment also apply to this eighth embodiment, except as discussed and illustrated herein. In view of the similarity between the eighth embodiment and the preceding embodiments, the parts of the eighth embodiment that are identical to the parts of other embodiments will be given the same reference numerals as the parts of the other embodiments. Moreover, the descriptions of the parts of the eighth embodiment that are identical to the parts of the other embodiments may be omitted for the sake of brevity. As just mentioned, the evaporator 701 in accordance with this eighth embodiment is identical to the evaporator 401 of the fifth embodiment, except the evaporator 701 includes a modified trough part 740. Specifically, the modified trough part 740 includes the trough sections 442 and the trough sections 441 (of the fifth embodiment), but also includes an additional single trough section 744 disposed below the trough sections 441. The trough section 744 includes a bottom wall 744*a* and a pair of side walls 744*b*. The side walls 744*b* have heights corresponding to the inner side walls 441*b* and 442*b*. Thus, the side walls 744*b* have heights to overlap at least 50% of the heat transfer tubes 31 disposed in the trough section 744. In the illustrated embodiment, the heights overlap 50% of the heat transfer tubes disposed in the additional trough section 744. Additional heat transfer tubes 31 are provided in the trough section 744 to form a modified tube bundle 730. Otherwise, the tube bundle 730 (heat transferring unit) is identical to the tube bundle 430.

Since the trough section 744 is added, the valve devices 8*a* and bypass conduits 8 of the fifth embodiment are replaced with a single valve device 8*a* and single bypass conduit connected to the additional trough section 744. The valve device 8*a* is selectively operated when the oil accumulated in the trough part 740 (trough section 744) reaches a prescribed level to discharge the oil from the trough part 740 to outside of the evaporator 701. However, it will be apparent to those skilled in the art from this disclosure that the valve device 8*a* and the bypass conduit 8 could be eliminated. Other than the above mentioned differences, this eighth embodiment is identical to the fifth embodiment.

Modification of Eighth Embodiment

Figure 43:
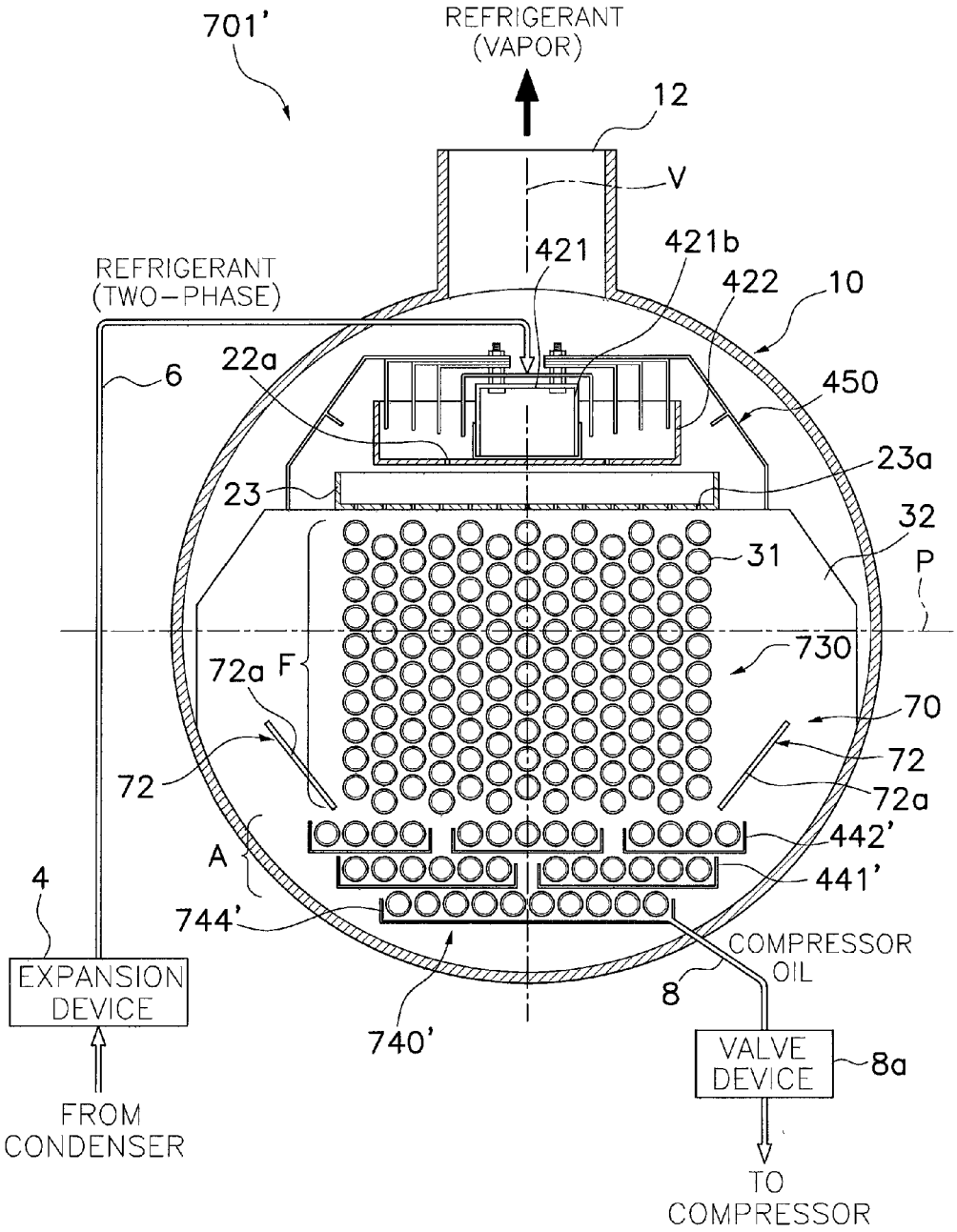
FIG. 43 is a simplified transverse cross sectional view of the heat exchanger illustrating a modified example for an arrangement of a tube bundle and a trough part according to the eighth embodiment of the present invention.

Referring now to FIG. 43, an evaporator 701' is illustrated in accordance with a modification of the eighth embodiment. The evaporator 701' is identical to the evaporator 701, except the evaporator includes a modified trough part 740'. In view of the similarity between this modification of the eighth embodiment and the eighth embodiment, the parts of this modification of the eighth embodiment that are identical to the parts of other embodiments will be given the same reference numerals as the parts of the other embodiments. Moreover, the descriptions of the parts of this modification of the eighth embodiment that are identical to the parts of the other embodiments may be omitted for the sake of brevity. Moreover, it will be apparent to those skilled in the art from this disclosure that the descriptions and illustrations of the preceding eighth embodiment also apply to this modification of the eighth embodiment, except as explained and illustrated herein.

The modified trough part 740' is identical to the trough part 740, except the modified trough part 740' includes modified trough sections 442', 441' (from the modification of the fifth embodiment) and a modified additional trough section 744'. The modified trough section 744' is set to overlap 75% of the heat transfer tubes 31 disposed in the tier, but is otherwise identical to the additional trough section 744 of the eighth embodiment.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. As used herein to describe the above embodiments, the following directional terms "upper", "lower", "above", "downward", "vertical", "horizontal", "below" and "transverse" as well as any other similar directional terms refer to those directions of an evaporator when a longitudinal center axis thereof is oriented substantially horizontally as shown in FIGS. 6 and 7. Accordingly, these terms, as utilized to describe the present invention should be interpreted relative to an evaporator as used in the normal operating position. Finally, terms of degree such as "substantially", "about" and "approximately" as used herein mean a reasonable amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. A heat exchanger adapted to be used in a vapor compression system, the heat exchanger comprising:

a shell with a longitudinal center axis extending generally parallel to a horizontal plane;

a refrigerant distribution assembly disposed inside the shell, the refrigerant distribution assembly extending generally parallel to the longitudinal center axis of the shell to receive a refrigerant that enters the shell and to discharge the refrigerant, and the refrigerant distribution assembly having at least one outermost lateral end;

a heat transferring unit disposed inside of the shell below the refrigerant distribution assembly so that the refrigerant discharged from the refrigerant distribution assembly is supplied to the heat transferring unit, the heat transferring unit including a plurality heat transfer tubes extending generally parallel to the longitudinal axis; and a canopy member disposed inside the shell, the canopy member including at least one lateral side portion extending laterally outwardly and downwardly from a position above the refrigerant distribution assembly, as viewed along the longitudinal center axis, the lateral side portion having a free end disposed further from a vertical plane passing through the longitudinal center axis than the refrigerant distribution assembly, as viewed along the longitudinal center axis, lower than an upper edge of the outermost lateral end of the refrigerant distribution assembly, as viewed along the longitudinal center axis, and above an upper edge of the heat transferring unit, and the outermost lateral end of the refrigerant distribution assembly being disposed laterally further from the vertical plane than the heat transfer tubes, as viewed along the longitudinal center axis.

2. The heat exchanger according to claim 1, wherein the refrigerant distribution assembly has a pair of outermost lateral ends, and the canopy member includes a pair of lateral side portions extending laterally outwardly and downwardly from positions above the refrigerant distribution assembly; and each of the lateral side portion has a free end disposed further from a vertical plane passing through the longitudinal center axis than the refrigerant distribution assembly, as viewed along the longitudinal center axis, lower than an upper edge of one of the outermost lateral ends, as viewed along the longitudinal center axis, and above the upper edge of the heat transferring unit.

3. The heat exchanger according to claim 2, wherein the canopy member includes a central portion attached at an upper end of the refrigerant distribution assembly, with the pair of lateral side portions extending laterally from opposite lateral ends of the central portion.

4. The heat exchanger according to claim 2, wherein the outermost lateral ends of the refrigerant distribution assembly are disposed laterally further from the vertical plane than the heat transfer tubes, as viewed along the longitudinal center axis.

5. The heat exchanger according to claim 2, wherein each of the lateral side portions includes an inclined section that is inclined relative to the vertical plane.

6. The heat exchanger according to claim 2, wherein the refrigerant distribution assembly includes a first tray part disposed inside of the shell and extending generally parallel to the longitudinal center axis of the shell to receive a refrigerant that enters the shell, the first tray part having a plurality of first discharge apertures;

a second tray part disposed inside of the shell below the first tray part to receive the refrigerant discharged from the first discharge apertures, the second tray part having a plurality of second discharge apertures, and the free ends of the lateral side portions are disposed lower than an upper end of the second tray part, and the second tray part forms the outermost lateral ends of the refrigerant distribution assembly.

7. The heat exchanger according to claim 1, wherein the lateral side portion includes an inclined section that is inclined relative to the vertical plane.

8. The heat exchanger according to claim 1, wherein the refrigerant distribution assembly includes a first tray part disposed inside of the shell and extending generally parallel to the longitudinal center axis of the shell to receive a refrigerant that enters the shell, the first tray part having a plurality of first discharge apertures;

a second tray part disposed inside of the shell below the first tray part to receive the refrigerant discharged from the first discharge apertures, the second tray part having a plurality of second discharge apertures, and the free end is disposed lower than an upper end of the second tray part, and the second tray part forms the outermost lateral end of the refrigerant distribution assembly.

9. The heat exchanger according to claim 8, wherein the free end of the lateral side portion is aligned with a bottom of the second tray part.

10. The heat exchanger according to claim 1, wherein the canopy member includes an attachment portion attached at an upper end of the refrigerant distribution assembly, with the lateral side portion extending laterally from a lateral end of the attachment portion.

11. A heat exchanger adapted to be used in a vapor compression system, the heat exchanger comprising:

a shell with a longitudinal center axis extending generally parallel to a horizontal plane;

a refrigerant distribution assembly disposed inside the shell, the refrigerant distribution assembly extending generally parallel to the longitudinal center axis of the shell to receive a refrigerant that enters the shell and to discharge the refrigerant, and the refrigerant distribution assembly having a pair of outermost lateral ends;

a heat transferring unit disposed inside of the shell below the refrigerant distribution assembly so that the refrigerant discharged from the refrigerant distribution assembly is supplied to the heat transferring unit, the heat transferring unit including a plurality heat transfer tubes extending generally parallel to the longitudinal axis; and a canopy member disposed inside the shell, the canopy member including a pair of lateral side portions extending laterally outwardly and downwardly from positions above the refrigerant distribution assembly, as viewed along the longitudinal center axis, each lateral side portion having an inclined section that is inclined relative to the vertical plane, a flange section extending from the inclined section toward the refrigerant distribution assembly, and a free end disposed further from a vertical plane passing through the longitudinal center axis than the refrigerant distribution assembly, as viewed along the longitudinal center axis, and lower than an upper edge of the outermost lateral end of the refrigerant distribution assembly, as viewed along the longitudinal center axis.

12. The heat exchanger according to claim 11, wherein each of the lateral side portions further includes a vertical section extending downwardly from the inclined section thereof to form one of the free ends at a lower end of the vertical section.

13. The heat exchanger according to claim 11, wherein each free end is disposed above the upper edge of the heat transferring unit.

14. The heat exchanger according to claim 11, wherein the flange section extends from the inclined section at a position spaced vertically upward from a bottom of the flange section.

15. A heat exchanger adapted to be used in a vapor compression system, the heat exchanger comprising:

a shell with a longitudinal center axis extending generally parallel to a horizontal plane;

a refrigerant distribution assembly disposed inside the shell, the refrigerant distribution assembly extending generally parallel to the longitudinal center axis of the shell to receive a refrigerant that enters the shell and to discharge the refrigerant, and the refrigerant distribution assembly having at least one outermost lateral end;

a heat transferring unit disposed inside of the shell below the refrigerant distribution assembly so that the refrigerant discharged from the refrigerant distribution assembly is supplied to the heat transferring unit, the heat transferring unit including a plurality heat transfer tubes extending generally parallel to the longitudinal axis; and a canopy member disposed inside the shell, the canopy member including at least one lateral side portion extending laterally outwardly and downwardly from a position above the refrigerant distribution assembly, as viewed along the longitudinal center axis, the lateral side portion having an inclined section that is inclined relative to the vertical plane, a flange section extending from the inclined section toward the refrigerant distribution assembly, and a free end disposed further from a vertical plane passing through the longitudinal center axis than the refrigerant distribution assembly, as viewed along the longitudinal center axis, and lower than an upper edge of the outermost lateral end of the refrigerant distribution assembly, as viewed along the longitudinal center axis.

16. The heat exchanger according to claim 15, wherein the lateral side portion further includes a vertical section extending downwardly from the inclined section to form the free end at a lower end of the vertical section.

17. The heat exchanger according to claim 15, wherein the free end is disposed above the upper edge of the heat transferring unit.

18. The heat exchanger according to claim 15, wherein the flange section extends from the inclined section at a position spaced vertically upward from a bottom of the flange section.

19. A heat exchanger adapted to be used in a vapor compression system, the heat exchanger comprising:

a shell with a longitudinal center axis extending generally parallel to a horizontal plane;

a refrigerant distribution assembly disposed inside the shell, the refrigerant distribution assembly extending generally parallel to the longitudinal center axis of the shell to receive a refrigerant that enters the shell and to discharge the refrigerant, the refrigerant distribution assembly having a pair of outermost lateral ends, and the refrigerant distribution assembly including a first tray part disposed inside of the shell and extending generally parallel to the longitudinal center axis of the shell to receive a refrigerant that enters the shell, the first tray part having a plurality of first discharge apertures, and a second tray part disposed inside of the shell below the first tray part to receive the refrigerant discharged from the first discharge apertures, the second tray part having a plurality of second discharge apertures, and the second tray part forming the outermost lateral ends of the refrigerant distribution assembly;

a heat transferring unit disposed inside of the shell below the refrigerant distribution assembly so that the refrigerant discharged from the refrigerant distribution assembly is supplied to the heat transferring unit, the heat transferring unit including a plurality heat transfer tubes extending generally parallel to the longitudinal axis; and a canopy member disposed inside the shell, the canopy member including a pair of lateral side portions extending laterally outwardly and downwardly from positions above the refrigerant distribution assembly, as viewed along the longitudinal center axis, each of the lateral side portions having a free end disposed further from a vertical plane passing through the longitudinal center axis than the refrigerant distribution assembly, as viewed along the longitudinal center axis, disposed lower than an upper edge of one of the outermost lateral ends of the refrigerant distribution assembly, as viewed along the longitudinal center axis, disposed above an upper edge of the heat transferring unit, disposed lower than an upper end of the second tray part, and aligned with a bottom of the second tray part.

* * * * *